US007129032B2

(12) United States Patent
Mori et al.

(10) Patent No.: US 7,129,032 B2
(45) Date of Patent: Oct. 31, 2006

(54) BLACK AND WHITE PHOTOTHERMOGRAPHIC MATERIAL AND IMAGE FORMING METHOD

(75) Inventors: Takayoshi Mori, Kanagawa (JP); Genichi Furusawa, Kanagawa (JP); Hiroyuki Mifune, Kanagawa (JP)

(73) Assignee: Fuji Photo Film Co., LTD, Kanagawa (JP)

( * ) Notice: Subject to any disclaimer, the term of this patent is extended or adjusted under 35 U.S.C. 154(b) by 6 days.

(21) Appl. No.: 10/969,067

(22) Filed: Oct. 21, 2004

(65) Prior Publication Data

US 2005/0118542 A1 Jun. 2, 2005

(30) Foreign Application Priority Data

| | | |
|---|---|---|
| Oct. 24, 2003 | (JP) | 2003-364355 |
| Dec. 10, 2003 | (JP) | 2003-411330 |
| Mar. 29, 2004 | (JP) | 2004-097153 |
| May 24, 2004 | (JP) | 2004-153910 |

(51) Int. Cl.
*G03C 1/035* (2006.01)
*G03C 1/498* (2006.01)

(52) U.S. Cl. ..... 430/502; 430/139; 430/567; 430/569; 430/619

(58) Field of Classification Search ..... 430/619, 430/567, 569, 502, 139
See application file for complete search history.

(56) References Cited

U.S. PATENT DOCUMENTS

| | | | | |
|---|---|---|---|---|
| 4,459,353 | A | 7/1984 | Maskasky | |
| 2002/0068247 | A1* | 6/2002 | Ihama et al. | 430/567 |
| 2002/0150847 | A1* | 10/2002 | Ihama et al. | 430/567 |
| 2003/0190561 | A1* | 10/2003 | Kikuchi et al. | 430/567 |
| 2004/0002022 | A1* | 1/2004 | Ii et al. | 430/375 |
| 2004/0038160 | A1* | 2/2004 | Yanagi et al. | 430/567 |
| 2004/0067459 | A1* | 4/2004 | Kikuchi et al. | 430/567 |
| 2004/0131983 | A1* | 7/2004 | Ohzeki et al. | 430/619 |
| 2005/0069827 | A1* | 3/2005 | Nariyuki et al. | 430/619 |

FOREIGN PATENT DOCUMENTS

| | | |
|---|---|---|
| EP | 0111919 A2 | 6/1984 |
| JP | A 59-119344 | 7/1984 |
| JP | A 59-119350 | 7/1984 |

* cited by examiner

*Primary Examiner*—Richard L. Schilling
(74) *Attorney, Agent, or Firm*—Margaret A. Burke; Sheldon J. Moss

(57) ABSTRACT

The invention provides a black and white photothermographic material including, on at least one surface of a support, at least a photosensitive silver halide, a non-photosensitive organic silver salt, a reducing agent and a binder, wherein 50% or more of the total projected area of the photosensitive silver halide grains is occupied by tabular grains having an aspect ratio of 2 or more, and at least one apex portion of each tabular grain has an epitaxial junction. An image forming method is also provided, the method including bringing the photothermographic material into close contact with a fluorescent intensifying screen containing a fluorescent substance, wherein 50% or more of emission light of the fluorescent substance has a wavelength of 350 nm to 420 nm, and applying X-ray exposure. The black and white photothermographic material has high sensitivity and is superior in image storability and raw stock storability.

18 Claims, 1 Drawing Sheet

BLACK AND WHITE PHOTOTHERMOGRAPHIC MATERIAL AND IMAGE FORMING METHOD

CROSS-REFERENCE TO RELATED APPLICATIONS

This application claims priority under 35 USC 119 from Japanese Patent Application Nos. 2003-364355, 2003-411330, and 2004-97153, the disclosures of which are incorporated by reference herein.

BACKGROUND OF THE INVENTION

1. Field of the Invention

The present invention relates to a black and white photothermographic material and an image forming method. More particularly, the invention relates to a black and white photothermographic material and an image forming method which use a silver halide emulsion having an epitaxial junction and exhibit high sensitivity, excellent image storability and excellent raw stock storability.

2. Description of the Related Art

In recent years, in the medical field and the graphic arts field, there has been a strong desire for a dry photographic process from the viewpoints of environmental conservation and economy of space. Further, the development of digitization in these fields has resulted in the rapid development of systems in which image information is captured and stored in a computer, and then when necessary processed and output by communicating it to a desired location where the image information is output onto a photosensitive material using a laser image setter or a laser imager, and developed to form an image at the location on the photosensitive material. It is necessary for the photosensitive material to be able to record an image with high-intensity laser exposure and that a clear black-tone image with a high resolution and sharpness can be formed.

While various kinds of hard copy systems using a pigment or a dye, such as ink-jet printers or electrophotographic systems, have been distributed as general image forming systems using such digital imaging recording material, images in the digital imaging recording material obtained by such a general image forming system are insufficient in terms of image quality (sharpness, granularity, gradation, and tone) needed for medical images used in making diagnoses and high recording speed (sensitivity). These kinds of digital imaging recording materials have not reached a level at which they can replace medical silver halide film processed with conventional wet development.

A thermographic system using an organic silver salt has already been known. This system has an image forming layer including a reducible silver salt (for example, an organic silver salt), a photosensitive silver halide, and if necessary, a toner for controlling the color tone of silver, dispersed in a binder.

A photothermographic material forms a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. There is much literature in which photothermographic materials are described, and the Fuji Medical Dry Imager FM-DP L is a practical example in of a medical image forming system using a photothermographic material that has been marketed.

Since this kind of image forming system utilizing an organic silver salt has no fixing step, undeveloped silver halide remains inside the film after thermal development. Thus, there have intrinsically been two serious problems in the system.

One problem is that of instability in preserving an image after a thermal developing process, particularly fogging due to print-out when the material is exposed to light. As a way to improve the print-out, a method making use of silver iodide is known. However, the sensitivity of silver iodide grains known until now is extremely low, and silver iodide grains do not achieve a level of sensitivity that can be used in an actual system. Further, when a measure for preventing recombination between photoelectrons and positive holes is effected to improve the sensitivity, there is an inherent problem that the characteristic of having good print-out resistance will be lost.

As a way of increasing the sensitivity of a silver iodide photographic emulsion, academic literature discloses addition of a halogen acceptor such as sodium nitrite, pyrogallol, hydroquinone or the like, immersion in an aqueous silver nitrate solution, sulfur sensitization at the pAg of 7.5, and the like. For example, these are described in the Journal of Photographic Science, vol. 8, p. 119 (1960) and vol. 28, p. 163 (1980), Photographic Science and Engineering, vol. 5, p. 216 (1961), and the like. However, the effect is insufficient for use in photothermographic materials of the invention.

Another problem is that light scattering due to the remaining silver halide grains may cause cloudiness, whereby the film turns translucent or opaque and image quality is degraded. To solve this problem, ways in which the grain size of photosensitive silver halide grains is made fine (to within a range of practical use of 0.08 μm to 0.15 μm) and the addition amount is reduced as much as possible to suppress the cloudiness caused by the silver halide have been practically employed. However, the compromise results in decreasing the sensitivity further, the problem of cloudiness is not completely solved, and a dark milky color continues to remain and generate haze in the film.

In the case of a conventional wet developing process, the remaining silver halide is removed by processing with a fixing solution containing a silver halide solvent after the developing process. For the silver halide solvent, many kinds of inorganic and organic compounds are known which can form complexes with silver ions.

Even in the case of a dry thermal developing process, many attempts to introduce similar fixing measures in the material have been made. For example, a method has been proposed where a compound capable of forming complexes with silver ions is incorporated in the film and the silver halide is solubilized (usually referred to as fixing) through thermal development. However, this proposal only applies to silver bromide and silver chlorobromide, and the process also requires an additional heat treatment step for fixing, and the heating conditions require a high temperature within a range of 155° C. to 160° C. Thus, the system is one in which fixing is difficult to achieve.

In another proposal, a separate sheet (referred to as a fixing sheet) that includes a compound able to form complexes with silver ions is prepared, and after thermally developing the photothermographic material to form an image, the fixing sheet is overlaid on the developed photothermographic material, heating is carried out, and the remaining silver halide is dissolved and removed. However, since this proposal requires two sheets, from a practical viewpoint the obstacles are that the processing step is complicated and the operational stability of the process is hard to maintain, and that there is a necessity to discard the fixing sheets after processing, resulting in generation of waste.

As another fixing method usable in thermal development, a method is proposed where a fixing agent for the silver halide is encapsulated in microcapsules, and thermal development releases the fixing agent and causes it to act. However, it is difficult to achieve a design that effectively releases the fixing agent. A method for fixing using a fixing solution after thermal development is also proposed, but it requires a wet process and therefore is not adequate for a completely dry process.

As described above, known methods for improving the turbidity of film have negative effects, and there have been substantial difficulties in their practical application.

Attempts have also been made at applying the above-mentioned photothermographic material as photosensitive material for photographing. The "photosensitive material for photographing" as used herein means a photosensitive material on which images are recorded by a one-shot exposure through a lens, rather than by writing the image information by a scanning exposure with a laser beam or the like. Conventionally, photosensitive materials for photographing are generally known in the field of wet developing photosensitive materials, and include films for medical use such as direct or indirect radiography films and mammography films, various kinds of photomechanical films used in printing, industrial recording films, films for photographing with general-purpose cameras, and the like. For example, an X-ray photothermographic material coated on both sides containing tabular silver iodobromide grains using a blue fluorescent intensifying screen is described in JP-A No. 59-142539. As another example, a photosensitive material for medical use containing tabular grains that have a high content of silver chloride and have (100) major faces, and that are coated on both sides of a support, is described in JP-A No. 10-282606. Double-sided coated photothermographic materials are also disclosed in other patent documents. However, according to these known examples, although fine particle silver halide grains having a grain size of 0.1 μm or less do not cause further hazing, the sensitivity is very low. These grains are therefore not usable for practical applications in photographing. And conversely, when using silver halide grains having a grain size of 0.3 μm or more, because the remaining silver halide increases the degree of haze and adversely affects the print-out, there is severe deterioration of the image quality, and the grains are not usable for practical applications.

SUMMARY OF THE INVENTION

A first aspect of the invention is to provide a black and white photothermographic material comprising, on at least one surface of a support, at least a photosensitive silver halide, a non-photosensitive organic silver salt, a reducing agent and a binder, wherein 50% or more of a total projected area of photosensitive silver halide grains is occupied by tabular grains having an aspect ratio of 2 or more and at least one apex portion of each tabular grain has an epitaxial junction.

A second aspect of the invention is to provide an image forming method comprising bringing the photothermographic material according to the first aspect into close contact with a fluorescent intensifying screen containing a fluorescent substance, wherein 50% or more of emission light of the fluorescent substance has a wavelength of 350 nm to 420 nm, and applying X-ray exposure.

DETAILED DESCRIPTION OF THE INVENTION

Figure 1:
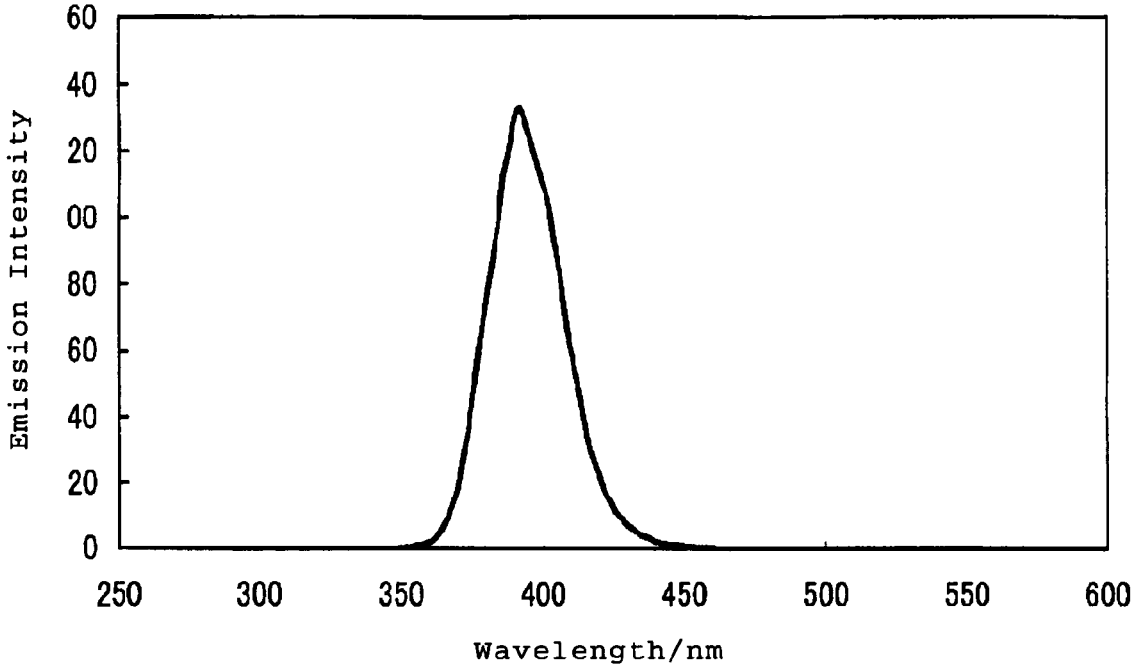
FIG. 1 is a diagram of light emission spectrum of a fluorescent intensifying screen A.

An object of the present invention is to provide a black and white photothermographic material with improved sensitivity, image storability and raw stock storability, and an image forming method using the photothermographic material.

A photosensitive silver halide grain having an epitaxial junction is well known in the art. As the result of investigations on the epitaxial junction useful for the photothermographic material, the inventors have revealed that especially effective techniques are a) to concentrate the epitaxial junctions at the apex portion of the host grain, b) to introduce dislocation lines in the epitaxial junction parts, and c) to reduce the silver iodide content of the epitaxial junction parts to low level. This effect is especially pronounced in host grains formed of a silver iodide-rich emulsion having a silver iodide content of 40 mol % or higher, and moreover in materials where organic polyhalogen compounds are used as an antifoggant. As an image forming method, the inventors have further discovered an image forming method where the photothermographic material comprising silver halide grains having a high silver iodide content are subjected to exposure by an X-ray with a fluorescent intensifying screen having an emission peak in the region from 350 nm to 420 nm.

The inventors have noticed that conventional preparation conditions may result in large variation in the epitaxial junction portions among grains. Moreover, their investigation reveals that the variation may adversely affect the improvement of sensitivity. By setting the forming conditions of epitaxial deposition to new conditions that have not been conventionally known, epitaxial junctions can be concentrated at the apex portions of the grains, whereby significantly high sensitivity can be attained.

Further, in the case of tabular silver halide grains having a high silver iodide content, the sensitizing effect due to the epitaxial junction turns out to be very small. As the result of their analysis on the cause, the inventors have found out that even if the epitaxial junctions are formed with silver bromide, a part of the silver bromide may be converted to silver iodide by migrating iodide ions from the tabular high silver iodide host grains. It is revealed from the advanced research that the modification of grain forming conditions of the epitaxial junction can depress the conversion to silver iodide in the epitaxial parts, and that excellent improvement in sensitivity, image storability and raw stock storability can be attained thereby.

The present invention is explained in detail below.

1. Photosensitive Silver Halide

The photosensitive silver halide grain in the present invention is a tabular grain, wherein 50% or more of the total projected area is occupied by the tabular grains having an aspect ratio of 2 or more, and each tabular grain has an epitaxial junction on at least one apex portion.

Preferably 60% or more, more preferably 70% or more, and most preferably 80% or more of the total projected area is preferably occupied by the tabular grains having an aspect ratio of 2 or more and each tabular grain has an epitaxial junction on at least one apex portion. Here, it is advantageous to the enhancement in sensitivity that the epitaxial junctions are formed uniformly among grains.

The photosensitive silver halide grains used for the present invention are explained below in detail.

1) Tabular Silver Halide Grain

The tabular grain used herein means a silver halide grain having two facing parallel principal planes (hereinafter referred to as "tabular grain"). On viewing the tabular grain from the vertical direction with respect to the principal plane, the tabular gain often have a shape such as a hexagonal form, a triangle form, a square form, a rectangular form or a circular form with rounded corner. Any form beside the above forms may be used. However, in order to apply uniformly an epitaxial sensitization among grains, monodisperse in size and form is preferred.

The tabular silver halide grain used in the present invention is defined as a silver halide grain having an aspect ratio (equivalent circular diameter/grain thickness of principal plane) of 2 or more. The equivalent circular diameter of a tabular silver halide grain is determined from a diameter (equivalent circular diameter) of a circle having the same area as projected area of a silver halide grain, for example, measured by photomicrographs of transmission electron microscope image with a replica method. The grain thickness can not be easily derived from a length of the shadow of the replica because of their epitaxial deposition. However, the thickness may be derived from the measurement of a length of the shadow of the replica before the epitaxial deposition. Or even after the epitaxial deposition, the grain thickness can be easily derived from electron photomicrographs of the cross section of sliced specimens of a coated sample containing tabular grains. The tabular grain in the present invention has an aspect ratio of 2 or more, and preferably the tabular grain used in the present invention has an aspect ratio of 5 or more, more preferably 7 or more, and most preferably 10 or more.

2) Halogen Composition

For the tabular silver halide grains used in the invention, there is no particular restriction on the halogen composition but silver halide grains having a high silver iodide content of 40 mol % or higher are preferably used. Other components are not particularly limited and can be selected from silver halides such as silver chloride, silver bromide, and organic silver salts such as silver thiocyanate, silver phosphate and the like. Among them, silver bromide, silver chloride and silver thiocyanate are preferably used. The silver iodide content used herein means a content of silver iodide comprised in silver halide grains including epitaxial parts. Using such silver halide grains having a high silver iodide content, the photothermographic materials exhibiting excellent properties in the image storability after thermal development, especially the remarkable depression of fog increase caused by light exposure can be attained.

The halogen composition of the tabular grains used in the present invention more preferably have a silver iodide content of 80 mol % or higher, and most preferably 90 mol % or higher.

The X-ray diffraction method is well known in the art as for the technique of determination of halogen composition in silver halide crystals. The X-ray diffraction method is fully described in "X-Ray Diffraction Method" of Kiso Bunseki Kagaku Kouza (Lecture Series on Basic Analytical Chemistry), No.24. Normally, an angle of diffraction is measured by the powder method with copper Kβ radiation as a beam source.

The lattice constant a can be calculated from Bragg's equation by finding the angle of diffraction 2θ as follows.

$$2d \sin \theta = \lambda$$

$$d = a/(h^2+k^2+l^2)^{1/2}$$

wherein, 2θ is an angle of diffraction of (hkl) face, λ is a wavelength of X-ray beam used, d is spacing between (hkl) faces. The relation between the halogen composition of silver halide solid solution and the lattice constant a is already known (for example, described in T. H. James, "THE THEORY OF THE PHOTOGRAPHIC PROCESS, FOURTH EDITION" (Macmillan New York). Therefore, the halogen composition can be determined from the lattice constant obtained.

The tabular grain of the invention can assume any of a β phase or a γ phase. The term "β phase" described above means a high silver iodide structure having a wurtzite structure of a hexagonal system and the term "γ phase" means a high silver iodide structure having a zinc blend structure of a cubic crystal system. An average content of γ phase in the present invention is determined by a method presented by C. R. Berry. In the method, an average content of γ phase is calculated from the peak ratio of the intensity owing to γ phase (111) to that owing to β phase (100), (101), (002) in powder X ray diffraction method. Detail description, for example, is described in Physical Review, volume 161 (No.3), p. 848 to 851 (1967).

As for the tabular grains used in the present invention, the distribution of the halogen composition in a host tabular grain may be uniform or the halogen composition may be changed stepwise, or it may be changed continuously. Further, a silver halide grain having a core/shell structure can be preferably used. Preferred structure is a twofold to fivefold structure and, more preferably, core/shell grain having a twofold to fourfold structure can be used. A core-high-silver iodide-structure which has a high content of silver iodide in the core part, and a shell-high-silver iodide-structure which has a high content of silver iodide in the shell part can also be preferably used. In order to attain the photothrmographic material exhibiting the image storability after development and the depression of fog increase caused by light exposure, the tabular host grains having a higher silver iodide content are preferred, and more preferred is the tabular grains having a silver iodide content of 90 mol % or higher.

As for the tabular grains used in the present invention, the distribution of the halogen composition in epitaxial parts may be uniform or the halogen composition may be changed stepwise, or it may be changed continuously.

It is preferred that the silver halide in the epitaxial junction parts of the present invention preferably have an average silver iodide content of 0.1 mol % to 20 mol %, or a surface silver iodide content of the epitaxial junction parts of 0.1 mol % to 25 mol %.

The average silver iodide content of the epitaxial junction parts is more preferably in the range from 0.1 mol % to 10 mol %, further preferably from 0.1 mol % to 5 mol %, and most preferably from 0.1 mol % to 3 mol %.

The surface silver iodide content of the epitaxial junction parts is more preferably in the range from 0.1 mol % to 15 mol %, further preferably from 0.1 mol % to 10 mol %, and most preferably from 0.1 mol % to 5 mol %.

The silver halide other than silver iodide in the epitaxial junction parts can be preferably selected from silver chloride, silver bromide and silver chlorobromide. Among them, more preferred are silver bromide and silver chlorobromide, and further preferred is silver chlorobromide.

In the case where the silver halide other than silver iodide is silver chlorobromide in the epitaxial junction parts, silver chloride content is preferably in the range from 3 mol % to 70 mol %, more preferably from 5 mol % to 60 mol %, and further preferably from 5 mol % to 50 mol %. And any organic silver salt such as silver thiocyanate may preferably be included except silver chloride and silver bromide.

By the X-ray powder diffraction method, the host part and the epitaxial part of the tabular grains can not be distinguished and therefore the halogen composition of the epitaxial part can not be determined. According to this invention, the following method is applied for determining the halogen composition of the epitaxial part.

<Measuring Method of Average Silver Iodide Content of Epitaxial Part>

According to the invention, an average silver iodide content of the epitaxial part of silver halide grains can be measured by the following method.

The tabular grains in the photosensitive material can be sampled at random from the sample treated with a protolytic enzyme and then centrifuged. Thereafter, the obtained grains are subjected to redispersion and laid on a copper mesh with supporting membrane. Here the used amount of the protolytic enzyme is preferably as small as possible to prevent the deterioration of the grains. The method where the sample is sliced into thin section using a microtome and the grains with the binders are taken out may also be applicable depending on the situation. The obtained grains are observed from the principal plane direction and then the silver iodide content of an epitaxial part is measured by an analytical electron microscope, where an epitaxial part region protruded from the corner of the host grains is scanned with a beam focused to a spot diameter of 2 nm or less. The silver iodide content can be calculated from the calibration curve where the ratio between silver intensity and halogen intensity is measured in advance using the silver halide grains having a known content made by similar treatment. As the electron gun for the analytical electron microscope used, an electron gun with field emission type having a high electron density than an electron gun with thermoelectron type is preferably used. Thereby, the silver iodide content of the ultrafine epitaxial parts can easily be analyzed. By the above method, an average silver iodide content of averaged epitaxial parts can be determined based on the information of the thickness observed from the principal plane direction.

<Measuring Method of Surface Silver Iodide Content of Epitaxial Part>

According to the invention, surface silver iodide content of the epitaxial part of silver halide grains can be measured by the following method.

The tabular grains in the photosensitive material can be sampled at random from the sample treated with a protolytic enzyme and then centrifuged. Here the used amount of the protolytic enzyme is preferably as small as possible to prevent the deterioration of the grains. The obtained grains are coated on a cellulose triacetate support, and then embedding them in a resin. The sample is sliced into thin sections using microtome to produce a specimen having a thickness of about 50 nm, and laid on a copper mesh with supporting membrane. The method where the sample is sliced into thin section using a microtome and the grains with the binders are taken out may also be applicable depending on the situation. A portion of the thus-obtained grains is scanned with a beam focused to a spot diameter of 2 nm or less by an analytical electron microscope, and then the silver iodide content of an epitaxial deposit is measured. The silver iodide content can be calculated from the calibration curve where the ratio between silver intensity and halogen intensity is measured in advance using the silver halide grains having a known content made by similar treatment. As the electron gun for the analytical electron microscope used, an electron gun with field emission type having a high electron density than an electron gun with thermoelectron type is preferably used. Thereby, the silver iodide content of the ultrafine epitaxial parts can easily be analyzed. By the above method, a local surface silver iodide content of an epitaxial part can be found.

3) Grain Size

As for the tabular grains used in the present invention, any grain size enough to reach the required high sensitivity can be selected. In the present invention, preferred silver halide grains are those having a mean-equivalent spherical diameter of 0.3 μm to 5.0 μm, and more preferred are those having a mean equivalent spherical diameter of 0.35 μm to 3.0 μm. The term "equivalent spherical diameter" used here means a diameter of a sphere having the same volume as the volume of a silver halide grain. As for measurment method, an equivalent spherical diameter is calculated from measuring equvalent circular diameter and thickness similar to the aforesaid measurement of an aspect ratio. The smaller equivalent circular diameter and the thinner grain thickness may normally result in increasing the number of grain and broadening the distribution of epitaxial junctions among grains. Thereby, the effect of the present invention becomes more remarkable.

The size of epitaxial part according to the present invention, with respect to host grain part, preferably is in a range from 1 mol % to 60 mol %, based on mole of silver ion, more preferably from 3 mol % to 50 mol %, further preferably from 5 mol % to 30 mol %, and most preferably from 10 mol % to 20 mol %.

4) Epitaxial Junction

The apex portion used herein means, in a sector centered in one apex on viewing a tabular grain from the vertical direction with respect to the principal plane and defined by two sides constituting that apex, the area within a radius corresponding to one-third of the length of the shorter side out of those two sides. In the case where the principal plane of the tabular grain has a rounded triangular form or a hexagonal form, or a square form or a rectangular form, the apex and sides of the principal plane are the apex and sides of an imaginary triangle or hexagon, or square or rectangular formed by extending respective sides.

Namely, according to the present invention, the number of the host apex portion correspond to six in a hexagonal form, three in a triangle form, and four in a quadrilateral form.

Usually, the epitaxial junction may also be formed onto the principal plane or the edge portion of the grains other than the apex portion. On viewing the tabular grains from the direction vertical to the principal plane, the case where no protrusion exists in the outside of the sides consisting of the principal plane of the host grain indicates the epitaxial junction onto the principal planes. The case where the protrusion exists in the outside indicates the epitaxial junction onto the edge portion. The epitaxial junction crossed over the apex portion and the principal plane or the edge portion other than the apex portion is considered as the epitaxial junction of the principal plane or the edge portion.

The silver halide emulsion having epitaxial junctions preferred in the present invention can be judged as follows. From an electron photomicrography of tabular grains with a replica process, 100 or more grains are selected arbitrary and classified into three groups; the grains having epitaxial junctions at one or more apex portion, the grains having epitaxial junctions only onto edge portion or principal plane, and a group having no epitaxial junction. An emulsion where the grains having an epitaxial junction at one or more apex portions account for 50% or more of the total projected area comes under the epitaxial emulsion preferred in the present invention. An emulsion where the tabular silver halide grains having an epitaxial junction at least at one or more apex portions account for 60% or more, more preferably 70% or more, and most preferably 80% or more of the total projected area is also preferred.

As for the tabular grains of the present invention, 50% or more of the total projected area is preferably occupied by the tabular silver halide grains having an epitaxial junction at the apex portion of a number exceeding two-third of the number of host apex portions. Preferably 60% or more, more preferably 70% or more, and most preferably 80% or more of the total projected area is occupied by the tabular silver halide grains having an epitaxial junction at the apex portion of a number exceeding two-third of the number of host apex portions. The formation of the uniform epitaxial junctions at the apex portions within a grain, that is, the formation of the epitaxial junctions at all apex portions may often attain the formation of the uniform epitaxial junctions among grains and favor high sensitization.

The tabular grains of the present invention preferably account for 50% or more of the total projected area where the projected area occupied by the epitaxial junction onto the principal plane other than the apex portions make up less than 10% of a projected area other than that of the apex portions. The tabular grains more preferably account for 60% or more, further preferably 70%, and most preferably 80% of the total projected area where the projected area occupied by the epitaxial junction onto the principal plane other than the apex portions make up less than 10% of a projected area other than that of the apex portions. In order to attain high sensitivity, the ratio of the epitaxial junctions onto the principal plane to the epitaxial junctions at the apex portion is preferably small. By comparison between the case where the epitaxial junctions are formed both at the apex portions and the principal planes other than the apex portions and the case where the epitaxial junctions are formed at the apex portions only, the latter may be advantageous to the high sensitization.

The tabular grains of the present invention preferably account for 50% or more of the total projected area where the length of edges occupied by epitaxial junctions onto the edge portions other than the apex portions make up less than 30% of the length of edges other than those of the apex portions. The tabular grains more preferably account for 60% or more, further preferably 70% and most preferably 80% or more of the total projected area where the length of edges occupied by epitaxial junctions onto the edge portions other than the apex portions make up less than 30% of the length of edges other than those of the apex portions. If the epitaxial junction are formed onto the edge portions, more larger epitaxial junctions may be easily formed by combining with the epitaxial junctions formed at the apex portions or the epitaxial junctions formed onto the principal planes other than the apex portions during the epitaxial deposition. Thereby the epitaxial junctions among grains are liable to be non-uniform.

The grains can be judged by classifying, from the electron photomicrography with the replica process set forth above, into three groups; grains having epitaxial junctions at all apex portions, grains having no epitaxial junction onto the principal plane other than the apex portions, and grains having no epitaxial junction at the edge portions other than the apex portions.

The epitaxial tabular grain of the present invention preferably has at least one dislocation line in the epitaxial part. In respect to the dislocation line in the epitaxial part, the increase in the number is favored. The dislocation line is often formed accidentally in the epitaxial part caused by the composition difference between the tabular host grain and the epitaxial part, but the intended introduction of dislocation lines in the grains by controlling the condition for the epitaxial deposition is more preferred. Here, it is preferred that no dislocation line is substantially observed in the tabular host grain. The coexistence of the dislocation lines in both the tabular host grain and the epitaxial part is not preferred because the efficiency of latent image formation is depressed to give a low sensitivity.

The dislocation lines in the epitaxial parts according to the present invention preferably have a reticulate form.

The reticulate dislocation line used herein means a plurality of uncountable dislocation lines crossing each other like a mesh.

The dislocation line of the tabular grain can be observed by a direct method using a transmission electron microscope at low temperature described, for example, in J. F. Hamilton, Phot. Sci. Phot. Eng., vol. 11, page 57, (1967) and T. Shiozawa, J. Soc. Phot. Sci. Japan, vol. 35, page 213, (1972). More specifically, silver halide grains are taken out from an emulsion while taking care not to impose a pressure high enough to cause generation of a dislocation line on grains and then placed on a mesh for the observation by an electron microscope. Here the sample cooled to prevent the damage (e.g., print-out) by an electron beam is observed according to the transmission process. At this time, as the thickness of the grain is larger, the electron beam is more difficult to transmit. Therefore a high pressure type electron microscope (200 kV or more for a grain having a thickness of 0.25 μm) is used for more clearly observing the grains. From the electron photomicrograph of grains obtained in the above method, the site and number of dislocation lines when viewed from the vertical direction with respect to the principal plane can be determined on each grain.

The surface index (Miller index) of the epitaxial part of the epitaxial tabular grain of the invention is preferable that the ratio occupied by the {100} face is rich, because of showing high spectral sensitization efficiency when a spectral sensitizing dye is adsorbed. The ratio is preferably 50% or more, more preferably 65% or more, and further preferably 80% or more. The ratio of the {100} face, Miller index, can be determined by a method described in T. Tani; J. Imaging Sci., vol. 29, page 165 (1985) utilizing adsorption dependency of the {111} face and {100} face in adsorption of a sensitizing dye.

5) Coating Amount

Generally, in the case of photothermographic material where all components are remained thereon after thermal development, the coating amount of silver halide is limited to a lower level in spite of the requirement for high sensitivity. It is because the increase of the coating amount of silver halide grains may result in decreasing the film transparency and deteriorating the image quality. However, according to the present invention, more silver halide grains can be coated because thermal development can decrease the haze of film caused by the residual silver halide grains. In the present invention, the preferred coating amount is in the range from 0.5 mol % to 100 mol %, per 1 mol of non-photosensitive organic silver salt, and more preferably from 5 mol % to 50 mol %.

6) Method of Grain Formation

The method of forming photosensitive silver halide is well known in the relevant art and, for example, methods described in Research Disclosure No. 10729, June 1978, and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

As for the method of forming tabular grains of silver iodide, the method described in JP-A Nos. 59-119350 and 59-119344 are preferably used.

The preparation method of tabular host grain emulsion of the present invention is explained below.

As for the preparation of tabular host grain of the present invention, any grain forming procedure including three steps such as nucleation, ripening, and grain growth, two steps of nucleation and grain growth, and single step combined of nucleation and grain growth is preferably applicable.

Preferably at low pI in the nucleation process, the nucleation can be executed in a short time. Here the pI is defined as a logarithm of a reciprocal of $I^-$ ion concentration in the system. According to the present invention, especially the preparation where silver nitrate solution and halide solution are added in the presence of gelatin while stirring at a temperature of from 20° C. to 80° C. is preferably executed. Where the pI in the system is preferably 3 or lower, and the pH is preferably 7 or lower. The concentration of the aqueous silver nitrate solution is preferably at the concentration of 1.5 mol/L or less. By applying the above nucleating method, the formation of the epitaxial emulsion can be easily attained.

In the ripening process, the preferred temperature is in the range from 50° C. to 80° C. The additional gelatin is preferably added thereto, during soon after the nucleation to the finish of the ripening process. Especially, a phthalated gelatin is used as the preferred gelatin. Using these gelatins, the preparation of the epitaxial emulsion of the present invention can be easily executed.

In the grain growth process of the present invention, the addition of an aqueous silver nitrate solution and an iodide-containing aqueous halogen solution can be preferably added simultaneously. More preferably, an aqueous silver nitrate solution and an iodide-containing aqueous halogen solution, and a silver iodide fine grain emulsion are added simultaneously. The silver iodide fine grain emulsion used are substantially those consisted of silver iodide grains, but silver bromide and/or silver chloride may be included as for as the mixed crystal can be formed. Preferably the emulsion comprise a pure silver iodide grain. As for the crystal structure of silver iodide grain, there are crystal structures such as β phase and γ phase, and also α phase and α-like phase described in U.S. Pat. No. 4,672,026. The crystal structure used for the present invention are not particularly limited, but preferably the mixture of β phase and γ phase, and more preferably β phase structure is used. The silver iodide fine grain emulsion used may be an emulsion prepared prior to the addition as described in U.S. Pat. No. 5,004,679, or an emulsion after normal water washing process. The emulsion after normal water washing process is preferably used for the present invention. The silver iodide fine grain emulsion can be easily prepared in the process described in U.S. Pat. No. 4,672,026. A method of double jet addition where an aqueous silver nitrate solution and an iodide-containing aqueous solution are added while keeping the pI at constant value during the grain formation process is preferably applied. The preparation conditions such as the temperature, the pI, the pH, the kind and concentration of protective colloids such as gelatin, and the kind and concentration of silver halide solvent and with or without the solvent are not particularly limited. The grain size in the range of 0.1 μm or less, and more preferably 0.07 μm or less, is preferred for the present invention. It is very difficult to specify the grain shape precisely because of the fine particle, but a variation coefficient of a grain size distribution is preferably 25% or less. Especially in the case of 20% or less, the effect of the present invention is more pronounced. The size and size distribution of the silver iodide fine grain emulsion can be determined by the method where silver iodide fine grains are placed on the mesh used for electron microscope observation and observed directly by a transmission method, not by a replica method. Because the grain size is too small, the observation by a carbon replica method may give a big measuring error. Here the grain size is defined as a diameter of a circle having the same projected area equivalent to the grain to be examined. In respect to the grain size distribution, the size distribution is derived from a diameter of a circle equal to the projected area. According to the present invention, more preferred is silver iodide fine grains having a grain size from 0.02 μm to 0.06 μm and a variation coefficient the grain size distribution of 18% or less.

The more preferred grain growth process used for the present invention is the grain growth process similar to the procedures described in JP-A No.2-188741, where silver halide ultrafine grain emulsion consisted from silver iodide grain, silver iodobromide grain, or silver chloroiodide grain prepared prior to the addition are added successively during the grain growth process of the tabular silver halide grains, and the tabular grains are grown up by dissolving the ultrafine grains added. The outer mixing apparatus for the preparation of the ultrafine grains must install a powerful stirring devise where the aqueous silver nitrate solution, the aqueous halogen solution and the aqueous gelatin solution are mixed thereto. The gelatin may be added by the mixed solution prepared prior to the addition with the aqueous silver nitrate solution and/or the aqueous halogen solution, or by the aqueous gelatin solution alone. The gelatin having a lower molecular weight than usual is preferably used. The gelatin having a molecular weight of from 10,000 to 50,000 is particularly preferably used. Preferred gelatin used in the present invention is the gelatin where 90% of the amino group is modified by phthalic acd, succinic acid, or trimellitic acid, and/or the oxidation-treated gelatin reduced in the methionine group. Among them, phthalated gelatin is more preferably used. Using the above method, the epitaxial emulsion of the present invention can be easily prepared.

<Gelatin>

Various kinds of gelatin may be used as the protective colloid for the silver halide grains in the preparation of the tabular host grains used in the present invention. The stability of dispersing state of the silver halide emulsion in coating solution containing organic silver salt is required, and therefore the low molecular gelatin having a molecular weight of from 10,000 to 100,000 are preferably used. Moreover, phthalated gelatin may be preferably used. These gelatins can be used in grain formation and/or dispersing step after desalting process, but more preferably used in the grain formation process.

Various kinds of silver halide solvents or surface adsorbing agents can be used in the preparation of the tabular host grain used in the present invention. In order to form the grains having the required grain size and aspect ratio, the preparation conditions such as the temperature, the pH, the pAg can be selected arbitrary. The tabular host grain is preferably monodispersed as possible for easy performing the preparation of the epitaxial emulsion according to the present invention.

<Preparing Method of Epitaxial Junction Parts>

The preparing method of the epitaxial junction parts of the present invention is explained below.

The epitaxial deposition can be preferably performed soon after the tabular host grain formation or after the normal desalting process. More preferably, the epitaxial deposition is performed after the normal desalting process. Preferably the tabular host grain emulsion of the present invention is well washed for desalting and dispersed in a newly prepared protective colloid solution. As for the protective colloid for dispersing the tabular host grain emulsion after the desalting process, gelatin is more preferred.

According to the present invention, the control of the silver iodide content in the epitaxial junction parts is required.

It is a characteristics of the present invention that the average silver iodide content of the epitaxial junction parts and the surface silver iodide content of the epitaxial junction parts are low as mentioned above.

In the present invention, in order to reduce the silver iodide content of the epitaxial junction parts with respect to the tabular silver iodide-rich host grains, the method of reducing the solubility by lowering the temperature in the epitaxial deposition process is more effective. The depression of the mixed crystal formation is possible by applying an absorbable compounds on the host grains as a site director on the epitaxial junction mentioned below.

However, the formation of the epitaxial deposits uniformly among grains is performed at high temperature where the solubility is high. Therefore, for the tabular host grain having a high silver iodide content, it is very hard to form the epitaxial deposition uniformly among grains merely by means of lowering the temperature during the epitaxial deposition. Therefore, the following control method would be useful to attain both the uniformity of the epitaxial junction parts among grains and the reduction of the silver iodide content.

According to the present invention, the formation of the epitaxial junction parts in two grain formation processes differing in temperature is more preferred for a control method. Specifically, a first grain formation process is done at the comparatively high temperature to form the epitaxial deposition uniformly among grains, and a second grain formation process is done at comparatively low temperature. The temperature of the first grain formation process preferably is in the range from 60° C. to 80° C., and more preferably 70° C. to 80° C. The temperature of the second grain formation process preferably is in the range from 25° C. to 50° C., and more preferably from 25° C. to 40° C.

In the first grain formation process according to the present invention, an amount of silver contained in silver halide is preferably in a range from 1 mol % to 10 mol % with respect to the amount of silver contained in host grains, based on mole of silver, and more preferably from 1 mol % to 5 mol %.

Concerning the temperature of the first grain formation process, uniform formation of the epitaxial junction parts among grains is difficult at lower temperature than the above, and diffusion of iodide ions from the host grain to the epitaxial junction parts become pronounced at higher temperature than the above. Concerning the temperature of the second grain formation process, because the grain growth in the epitaxial junction parts may proceed at lower temperature than that of the first grain formation process, the temperature is preferably lower as possible in the above range to depress the diffusion of iodide ion from the host grain and form the epitaxial junction parts having a low silver iodide content.

The water temperature can be selected arbitrary according to the purpose, but is preferably selected in the range from 5° C. to 50° C. The pH at water washing can also be selected arbitrary according to the purpose, but is preferably selected from 2 to 10, and more preferably selected from 3 to 8. The pAg at water washing can also be selected arbitrary according to the purpose, but is preferably selected from 4 to 10. Especially, more careful selection is required in the case of the tabular host grain having a high silver iodide content, because a slightly form change occurred during the water washing step may give a big influence in the epitaxial deposition set forth below. The water washing method may be selected from the noodle washing, the dialysis using a semipermeable membrane, the centrifugal separation, the coagulation precipitation and the ion exchanging. In the case of the coagulation precipitation, the method can be selected from a method of using a sulfate, a method of using an organic solvent, a method of using a water-soluble polymer and a method of using a gelatin derivative.

For the dispersion process after desalting, the pH, the pAg, and the kind, concentration and viscosity of gelatin used must be selected to prepare the epitaxial emulsion of the present invention. According to the present invention, the pH is preferably in a range from 5 to 8, more preferably from 5.3 to 7, and particularly preferably from 5.5 to 6.8. By setting the pH to the above range, the epitaxial deposition can be uniformly formed among grains and the effect of the present invention can be remarkably brought out. As for the kind of gelatin being used, the use of phthalated gelatin is especially advantageous to the condition of the epitaxial deposition of the present invention.

According to the present invention, it is preferred that physical ripening process is preferably executed at high temperature prior to the epitaxial deposition. The physical ripening process at the high temperature results in forming a rounded shaped apex portions of the host grain and thereby the epitaxial deposition may easily proceed around the apex portions in the successive epitaxial deposition process.

The most influential factors which affect the epitaxial deposition condition are the degree of supersaturation, the temperature and the pAg. Higher degree of supersaturation and higher temperature are advantageous to the epitaxial deposition condition to form uniform epitaxial junctions. However the optimization are required because too high degree of supersaturation may increase the number of epitaxial junction made on the place other than apex portions of the tabular host grains and too high temperature may cause the mix crystal formation by undesirable recrystalization with the tabular host grains.

According to the present invention, the pAg of the epitaxial deposition process is preferably in a range from 4.8 to 9.5, and more preferably 6.1 to 7.8.

According to the present invention, an intentional conversion process is preferably executed during the epitaxial deposition process. The conversion process used herein means a process to convert the halogen composition of epitaxial parts by adding a less soluble halide to the formed epitaxial deposits. For example, after the formation of the epitaxial deposits having a high silver chloride content, by adding a solution containing potassium bromide, the epitaxial parts having a high silver bromide content can be formed therefrom.

In the case of forming silver chlorobromide grains as the epitaxial junction parts, the above conversion process may be applicable. However, the adjustment of the solution concentration and the addition amount is required to prevent the excess potassium bromide state in the conversion process in order to form the grains having a desired silver chloride content, which attain the effect of the present invention.

When silver halide of the epitaxial junction parts contain silver chlorobromide, the dislocation line may or may not exist in the epitaxial junction parts.

According to the present invention, as a preferred site director used for the epitaxial junction, a spectral sensitizer or an adsorptive compound which substantially have no absorption in the visible light region can be used. These compounds may be used alone, but may be used preferably in combination of two or more thereof. By selecting the addition amount or the kind, the epitaxial deposition sites can be controlled. Generally, the addition amount is preferably in a range from 40% to 90% of the amount of saturated coverage, and also the adsorbable compound may be added further after completion of the epitaxial deposition.

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The epitaxial emulsion of the present invention is preferably spectrally sensitized to have a spectral sensitive peak in a range of 600 nm to 900 nm, or in a range of 300 nm to 500 nm, and particularly preferably from 300 nm to 450 nm. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or, two or more kinds of them may be used in combination.

In the epitaxial emulsion of the present invention, super sensitizers can be used in order to improve spectral sensitizing effect. The super sensitizers usable in the invention can include those compounds described in EP-A No. 587338, U.S. Pat. Nos. 3877943 and 4873184, JP-A Nos. 5-341432, 11-109547 and 10-111543, and the like.

In the invention, the epitaxial parts may be formed by a method of simultaneously adding a solution containing halide ion and a silver nitrate solution, a method of separately adding these solutions, or a method of appropriately combining this addition with the addition of silver chloride fine grain, silver bromide fine grain, or silver iodide grain having a grain size smaller than the host grain or with the addition of mixed crystal grains thereof. Preferred method is the addition of a solution containing halide ion and a solution containing silver nitrate simultaneously.

When adding an aqueous silver nitrate solution is the time period for adding is preferably in the range from 15 seconds to 40 minutes, and more preferably from 30 seconds to 20 minutes. For the formation of an epitaxial emulsion of the present invention, the concentration of the aqueous silver nitrate solution added is preferably 1.5 mol/L or less, and particularly preferably 0.5 mol/L or less. At this time, stirring of the system must be efficiently performed and it is preferred that the viscosity of the system is lower.

Generally in the epitaxial emulsion, the epitaxial parts may easily suffer a shape change by recrystalization, so some shape stabilization is preferably needed. As the means to stabilize the shape of the epitaxial parts according to the present invention, the shape of the epitaxial parts can be stabilized by the addition of adsorbable compounds such as water-soluble mercapto compounds to adsorb on the epitaxial parts soon after the epitaxial deposition. The addition amount can preferably be selected depending on the grain size and shape used, as far as the application of the chemical sensitization mentioned below can be performed without any hindrance.

7) Heavy Metal

Concerning the silver halide grain of the invention, it is preferred that a heterometal other than a silver atom is doped into the grain. As the heterometal other than a silver atom, metals or complexes of metals belonging to groups 3 to 11 in the periodic table (showing groups 1 to 18) are preferable. The metal or the center metal of the metal complex from groups 3 to 11 in the periodic table is preferably rhodium, ruthenium or iridium.

The metal complex may be used alone, or two or more kinds of complexes comprising identical or different species of metals may be used together. A preferred content is in the range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No.11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during water washing step, during dispersion step and before chemical sensitization step. In order not to grow the fine silver halide grain, the hexacyano metal complex is rapidly added preferably after the grain is formed, and it is preferably added before completion of the emulsion formation step.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

8) Chemical Sensitization

The photosensitive silver halide in the invention can be used without chemical sensitization, but is preferably chemically sensitized by at least one of chalcogen sensitizing method, gold sensitizing method and reduction sensitizing method. The chalcogen sensitizing method includes sulfur sensitizing method, selenium sensitizing method and tellurium sensitizing method.

In sulfur sensitization, unstable sulfur compounds can be used. Such unstable sulfur compounds are described in Chimie et Pysique Photographique, written by P. Grafkides, (Paul Momtel, 5th ed., 1987) and Research Disclosure (vol. 307, Item 307105), and the like.

As typical examples of sulfur sensitizer, known sulfur compounds such as thiosulfates (e.g., hypo), thioureas (e.g., diphenylthiourea, triethylthiourea, N-ethyl-N'-(4-methyl-2-thiazolyl)thiourea and carboxymethyltrimethylthiourea), thioamides (e.g., thioacetamide), rhodanines (e.g., diethylrhodanine, 5-benzylydene-N-ethylrhodanine), phosphinesulfides (e.g., trimethylphosphinesulfide), thiohydantoins, 4-oxo-oxazolidin-2-thione derivatives, disulfides or polysulfides (e.g., dimorphorinedisulfide, cystine, hexathiocanthione), polythionates, sulfur element and active gelatin can be used. Specifically, thiosulfates, thioureas and rhodanines are preferred.

In selenium sensitization, unstable selenium compounds can be used. These unstable selenium compounds are described in JP-B Nos. 43-13489 and 44-15748, JP-A Nos. 4-25832, 4-109340, 4-271341, 5-40324, 5-11385, 6-51415, 6-175258, 6-180478, 6-208186, 6-208184, 6-317867, 7-92599, 7-98483, and 7-140579, and the like.

As typical examples of selenium sensitizer, colloidal metal selenide, selenoureas (e.g., N,N-dimethylselenourea, trifluoromethylcarbonyl-trimethylselenourea and acetyltrimethylselemourea), selenamides (e.g., selenamide and N,N-diethylphenylselenamide), phosphineselenides (e.g., triphenylphosphineselenide and pentafluorophenyltriphenylphosphineselenide), selenophosphates (e.g., tri-p-tolylselenophosphate and tri-n-butylselenophosphate), selenoketones (e.g., selenobenzophenone), isoselenocyanates, selenocarbonic acids, selenoesters, diacylselenides can be used. Furthermore, non-unstable selenium compounds such as selenius acid, selenocyanic acid, selenazoles and selenides described in JP-B Nos. 46-4553 and 52-34492 can also be used. Specifically, phosphineselenides, selenoureas and salts of selenocyanic acids are preferred.

Specific examples of sulfur sensitizer and selenium sensitizer of the invention are shown below, however the invention is not limited in these.

1

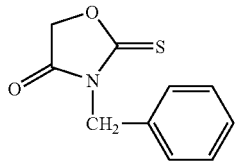

2

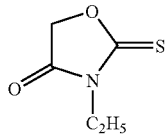

3

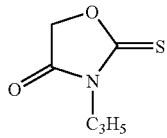

4

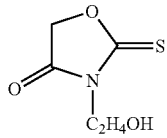

5

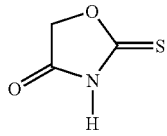

6

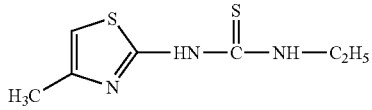

7

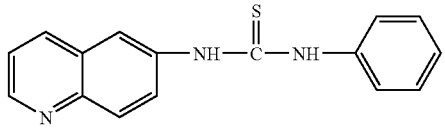

8

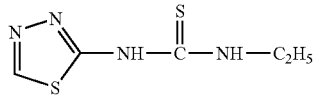

9

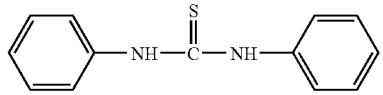

10

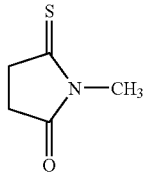

11

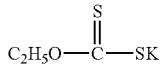

-continued

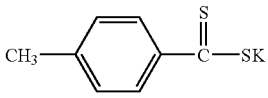

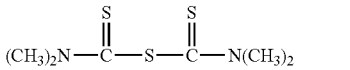

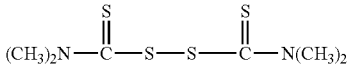

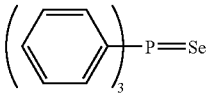

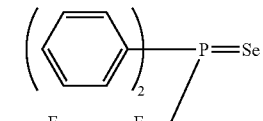

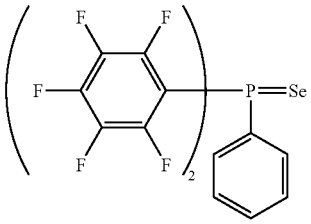

$(Bu)_3P{=}Se$

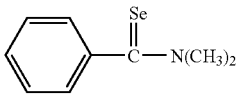

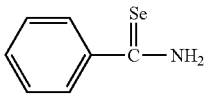

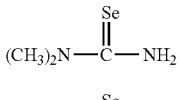

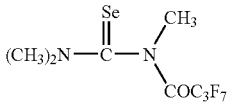

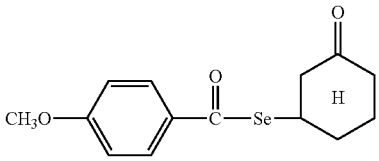

In the tellurium sensitization, unstable tellurium compounds are used. Unstable tellurium compounds described in JP-A Nos.4-224595, 4-271341, 4-333043, 5-303157, 6-27573, 6-175258, 6-180478, 6-208186, 6-208184, 6-317867, 7-140579, 7-301879, 7-301880 and the like, can be used as tellurium sensitizer.

As typical examples of tellurium sensitizer, phosphinetellurides (e.g., butyl-diisopropylphosphinetelluride, tributylphosphinetelluride, tributoxyphosphinetelluride and ethoxy-diphenylphosphinetellride), diacyl(di)tellurides (e.g., bis(diphenylcarbamoyl)ditelluride, bis(N-phenyl-N-methylcarbamoyl)ditelluride, bis(N-phenyl-N-methylcarbamoyl)ditelluride, bis(N-phenyl-N-benzylcarbamoyl)telluride and bis(ethoxycarmonyl)telluride),telluroureas (e.g., N,N'-dimethylethylenetellurourea and N,N'-diphenylethylenetellurourea), telluramides, telluroesters are used. Specifically, diacyl(di)tellurides and phosphinetellurides are preferred. Especially, the compounds described in paragraph No. 0030 of JP-A No.11-65021 and compounds represented by formulae (II), (III) and (IV) in JP-A No.5-313284 are more preferred.

Specifically, as for the chalcogen sensitization of the invention, selenium sensitization and tellurium sensitization are preferred, and tellurium sensitization is particularly preferred.

In gold sensitization, gold sensitizer described in Chimie et Physique Photographique, written by P. Grafkides, (Paul Momtel, 5th ed., 1987) and Research Disclosure (vol. 307, Item 307105) can be used. To speak concretely, chloroauric acid, potassium chloroaurate, potassium aurithiocyanate, gold sulfide, gold selenide and the like can be used. In addition to these, the gold compounds described in U.S. Pat. Nos. 2,642,361, 5,049,484, 5,049,485, 5,169,751, and 5,252,455, Belg. Patent No. 691857, and the like can also be used. And another novel metal salts except gold such as platinum, palladium, iridium and so on described in Chimie et Pysique Photographique, written by P. Grafkides, (Paul Momtel, 5th ed., 1987) and Research Disclosure (vol. 307, Item 307105) can be used.

The gold sensitization can be used independently, but it is preferably used in combination with the above chalcogen sensitization. Specifically, these sensitizations are gold-sulfur sensitization (gold-plus-sulfur sensitization), gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the invention, chemical sensitization can be applied at any time so long as it is after grain formation and before coating, and it can be applied, after desalting, (1) before spectral sensitization, (2) simultaneously with spectral sensitization, (3) after spectral sensitization and (4) just before coating.

The addition amount of chalcogen sensitizer used in the invention may vary depending on the silver halide grain used, the chemical ripening condition and the like, and it is about $10^{-8}$ mol to $10^{-1}$ mol, and preferably, about $10^{-7}$ mol to $10^{-2}$ mol, per 1 mol of silver halide.

Similarly, the addition amount of the gold sensitizer used in the invention may vary depending on various conditions and it is generally about $10^{-7}$ mol to $10^{-2}$ mol and, more preferably, $10^{-6}$ mol to $5\times10^{-3}$ mol per 1 mol of silver halide. There is no particular restriction on the condition for the chemical sensitization in the invention and, appropriately, the pAg is 8 or lower, preferably, 7.0 or lower, more preferably, 6.5 or lower and, particularly preferably, 6.0 or lower, and the pAg is 1.5 or higher, preferably, 2.0 or higher and, particularly preferably, 2.5 or higher; the pH is 3 to 10, preferably, 4 to 9; and the temperature is at 20° C. to 95° C., preferably, 25° C. to 80° C.

In the invention, reduction sensitization can also be used in combination with the chalcogen sensitization or the gold sensitization. It is specifically preferred to use in combination with the chalcogen sensitization.

As the specific compound for the reduction sensitization, ascorbic acid, thiourea dioxide or dimethylamine borane is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping the pH to 8 or higher and the pAg to 4 or lower for the emulsion, and it is also preferred to apply reduction sensitization by introducing a single addition portion of silver ions during grain formation.

The addition amount of the reduction sensitizer may also vary depending on various conditions and it is generally about $10^{-7}$ mol to $10^{-1}$ mol and, more preferably, $10^{-6}$ mol to $5\times10^{-2}$ mol per 1 mol of silver halide.

In the silver halide emulsion used in the invention, a thiosulfonate compound may be added by the method shown in EP-A No. 293917.

The photosensitive silver halide grain in the invention can be chemically unsensitized, but is preferably chemically sensitized by at least one method of gold sensitizing method and chalcogen sensitizing method for the purpose of designing a high-sensitivity photothermographic material.

9) Compound that can be One-electron-oxidized to Provide a One-electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV1 to 36); JP-W No. 2001-500996 (Compound 1 to 74, 80 to 87, and 92 to 122); U.S. Pat. Nos. 5,747,235 and 5,747,236; EP-A No. 786692A1 (Compound INV 1 to 35); EP-A No. 893732A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

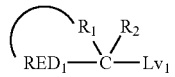

Formula (2)

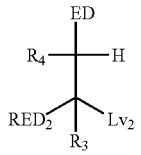

In formulae (1) and (2), $RED_1$ and $RED_2$ each independently represent a reducible group. $R_1$ represents a nonmetallic atomic group forming a cyclic structure equivalent to a tetrahydro derivative or an octahydro derivative of a 5 or 6 membered aromatic ring (including a hetero aromatic ring) with a carbon atom (C) and $RED_1$. $R_2$, $R_3$, and $R_4$ each independently represent one of a hydrogen atom and a substituent. $Lv_1$ and $Lv_2$ each independently represent a leaving group. ED represents an electron-donating group.

Formula (3)

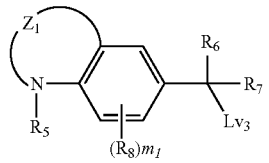

Formula (4)

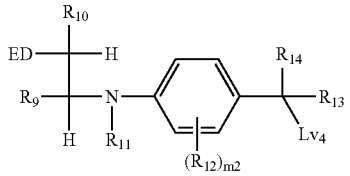

-continued

Formula (5)

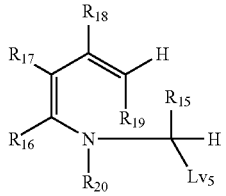

In formulae (3), (4) and (5), $Z_1$ represents an atomic group capable to form a 6 membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent one of a hydrogen atom and a substituent. $R_{20}$ represents one of a hydrogen atom and a substituent, however, in the case where $R_{20}$ represents a group other than an aryl group, $R_{16}$ and $R_{17}$ bind each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

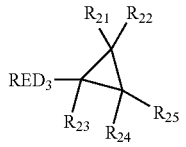

Formula (7)

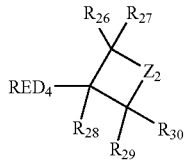

In formulae (6) and (7), $RED_3$ and $RED_4$ each independently represent a reducible group. $R_{21}$ to $R_{31}$ each independently represent one of a hydrogen atom and a substituent. $Z_2$ represents one selected from —$CR_{111}R_{112}$—, —$NR_{113}$—, and —O—. $R_{111}$ and $R_{112}$ each independently represent one of a hydrogen atom and a substituent. $R_{113}$ represents one selected from a hydrogen atom, an alkyl group, an aryl group, and a heterocyclic group.

Formula (8)

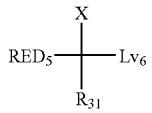

In formula (8), $RED_5$ is a reducible group and represents one of an arylamino group and heterocyclic amino group. $R_{31}$ represents one of a hydrogen atom and a substituent. X represents one selected from an alkoxy group, an aryloxy group, a heterocyclic oxy group, an alkylthio group, an arylthio group, a heterocyclic thio group, an alkylamino group, an arylamino group, and a heterocyclic amino group. $Lv_6$ is a leaving group and represents one selected from a carboxy group, a salt thereof, and a hydrogen atom.

Reaction formula (1)

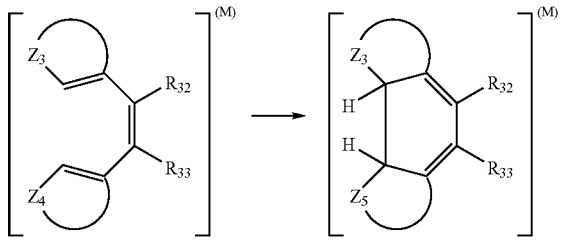

Formula (9)

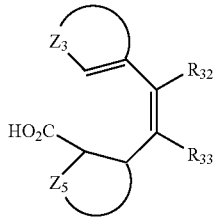

The compound represented by formula (9) is a compound that undergoes a bonding reaction represented by reaction fomula (1) after undergoing two-electrons oxidation accompanied by decarbonization and further oxidized. In reaction formula (1), $R_{32}$ and $R_{33}$ represent one of a hydrogen atom and a substituent. $Z_3$ represents a group to form a 5 or 6 membered heterocycle with C═C. $Z_4$ represents a group to form a 5 or 6 membered aryl group or heterocyclic group with C═C. M represents one selected from a radical, a radical cation, and a cation. In formula (9), $R_{32}$, $R_{33}$ and $Z_3$ are the same as those in reaction formula (1). $Z_5$ represents a group to form a 5 or 6 membered cyclic aliphatic hrdrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No.2003-140287), and the compound represented by formula (11) which can undergo the chemical reaction represented by reaction formula (1). The preferable range of these compounds is the same as the preferable range described in the quoted specification.

$RED_6$-Q-Y Formula (10)

In formula (10), $RED_6$ represents a reducible group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of $RED_6$ to form a new bond. Q represents a linking group to link $RED_6$ and Y.

Reaction formula (1)

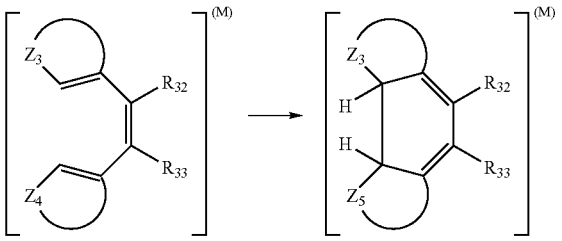

Formula (11)

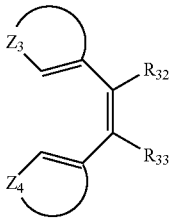

The compound represented by formula (11) is a compound that undergoes a bonding reaction represented by reaction formula (1) by being oxidized. In reaction formula (1), $R_{32}$ and $R_{33}$ each independently represent one of a hydrogen atom and a substituent. $Z_3$ represents a group to form a 5 or 6 membered heterocycle with C═C. $Z_4$ represents a group to form a 5 or 6 membered aryl group or heterocyclic group with C═C. $Z_5$ represents a group to form a 5 or 6 membered cyclic aliphatic hrdrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different with each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group and the like) or a nitrogen containing heterocyclic group having —NH— group as a partial structure of heterocycle capable to form a silver imidate (>NAg) (e.g., a benzotriazole group, a benzimidazole group, an indazole group and the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. As preferred examples of adsorptive group having two or more mercapto groups as a partial structure (dimercapto-substituted nitrogen containing heterocyclic group and the like), a 2,4-dimercaptopyrimidine group, a 2,4-dimercaptotriazine group and a 3,5-dimercaptol,2,4-triazole group are described.

Further, a quaternary salt structure of nitrogen or phosphor is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group including quaternary nitrogen atom are described. As a quaternary salt structure of phosphor, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used and a 5 or 6 membered aromatic heterocyclic group containing a quaternary nitrogen atom is further preferably used. Particularly preferably, a pyrydinio group, a quinolinio group and an isoquinolinio group are used. These nitrogen containing heterocyclic groups including a quaternary nitrogen atom may have any substituent.

As examples of counter anion of quaternary salt, halogen ion, carboxylate ion, sulfonate ion, sulfate ion, perchlorate ion, carbonate ion, nitrate ion, $BF_4^-$, $PF_6^-$, $Ph_4B^-$ and the like are described. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Group 1 and 2 compound having a quaternary salt of nitrogen or phosphor as an adsorptive group is represented by formula (X).

$$(P\text{-}Q_1\text{-})_i\text{-}R\ (\text{-}Q_2\text{-}S)_j \qquad \text{Formula (X)}$$

In formula (X), P and R each independently represent a quaternary salt structure of nitrogen or phosphor, which is not a partial structure of a spectral sensitizing dye. $Q_1$ and $Q_2$ each independently represent a connecting group, and typically represent one selected from a single bond, an alkylene group, an arylene group, a heterocyclic group, —O—, —S—, —NRN, —C(═O)—, —$SO_2$—, —SO—, —P(═O)—, and the group which consists of combinations thereof. Herein, $R_N$ represents one selected from a hydrogen atom, an alkyl group, an aryl group, and a heterocyclic group. S represents a residue which is obtained by removing one atom from the compound represented by Group 1 or 2. i and j are an integral number of one or more, and are selected in a range of i+j=2 to 6. It is preferred that i is 1, 2, or 3 and j is 1 or 2. It is more preferred that i is 1 or 2 and j is 1. And, it is particularly preferred that i is 1 and j is 1. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

Specific examples of the compounds of Groups 1 and 2 according to the invention are shown below without intention of restricting the scope of the invention.

1
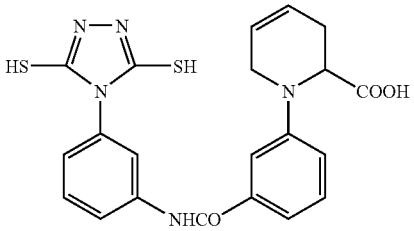
2
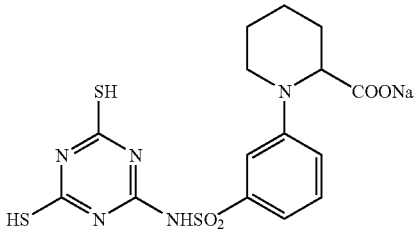
3
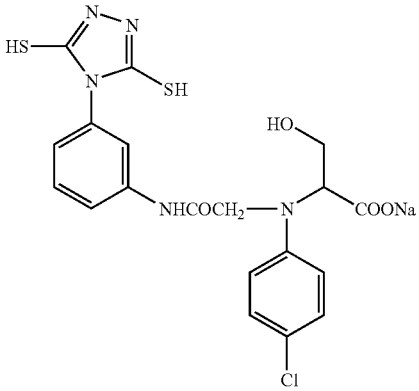
4
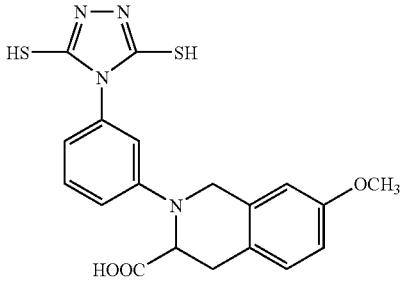
5
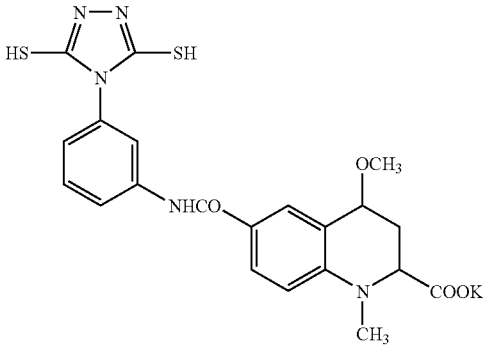
6
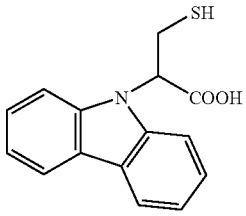
7
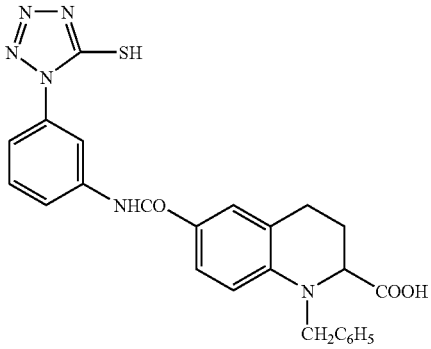
8
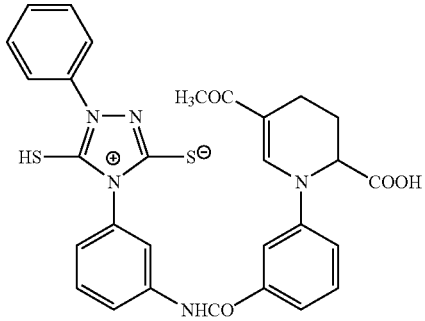

-continued
9
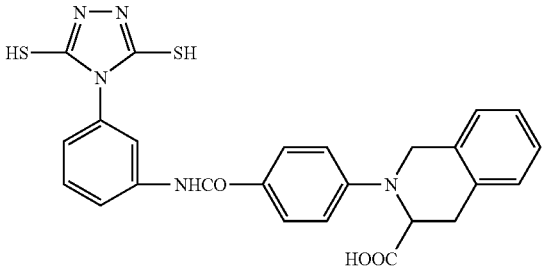
10
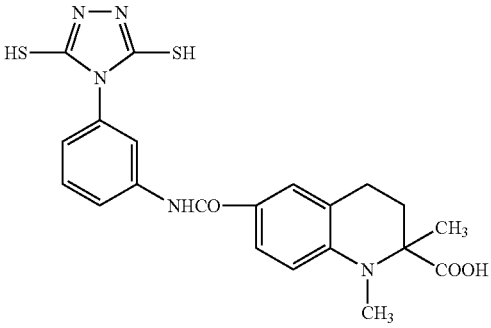
11
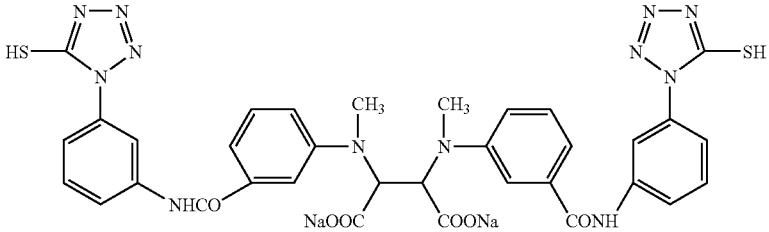
12
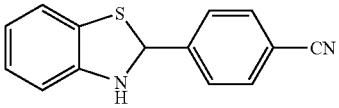
13
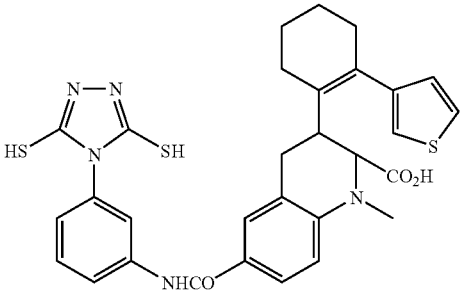
14
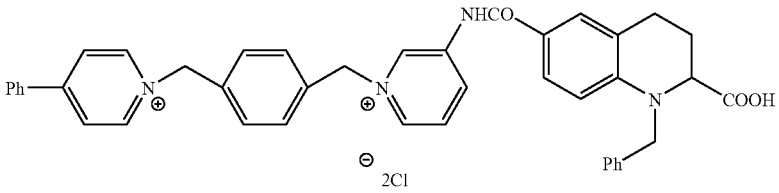
15
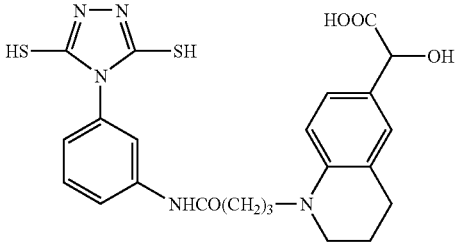
16
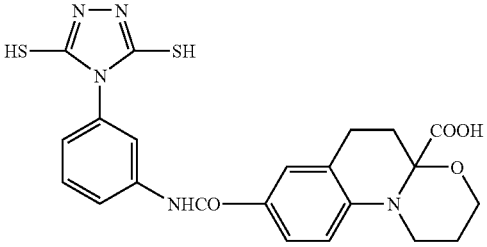

-continued
17
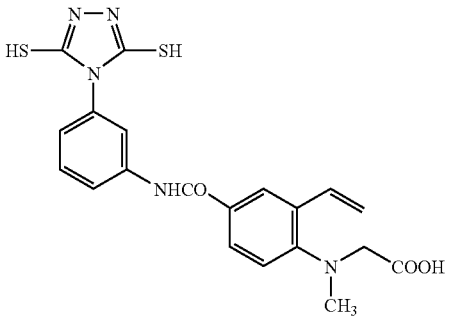
18
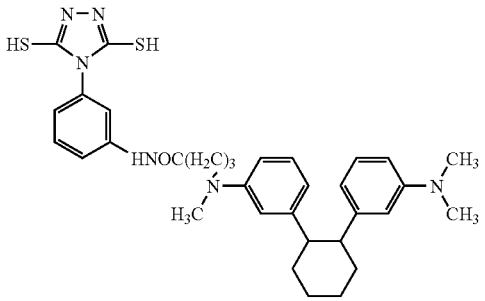
19
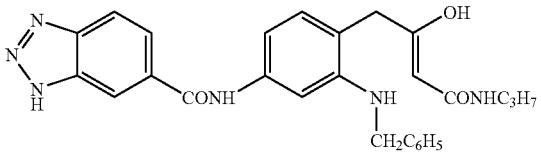
20
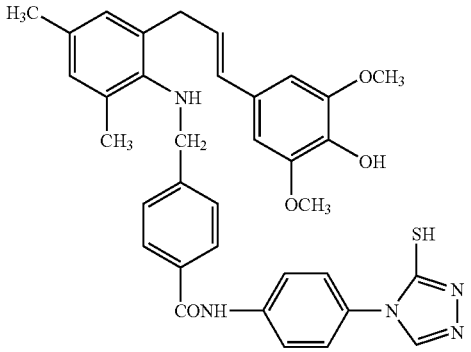
21
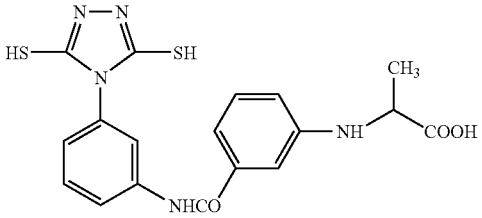
22
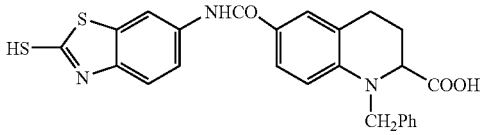
23
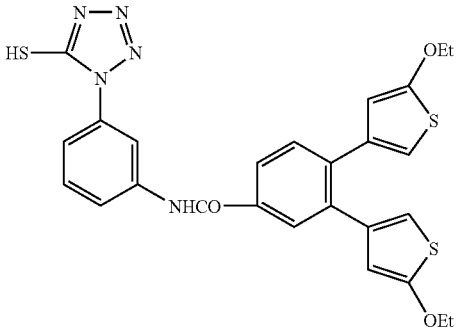

-continued
24
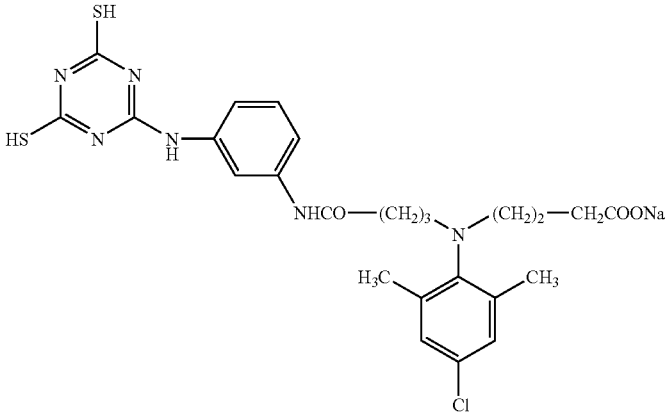
25
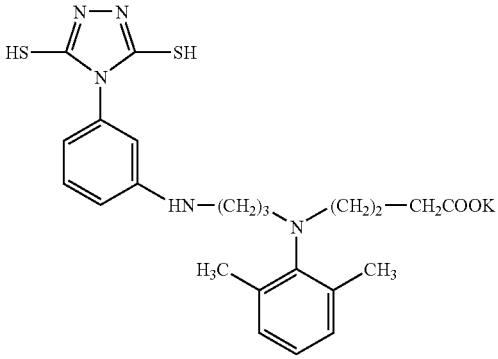
26
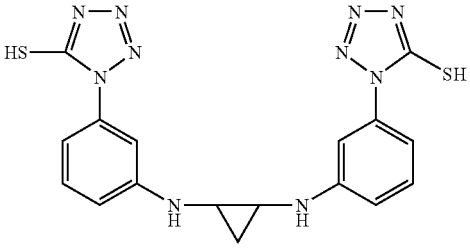
27
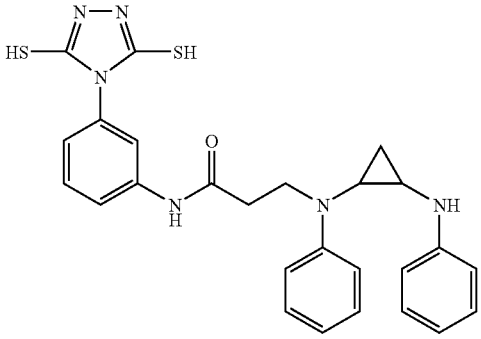
28
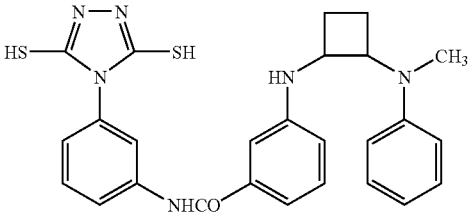
29
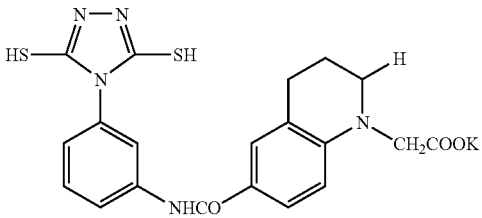
30
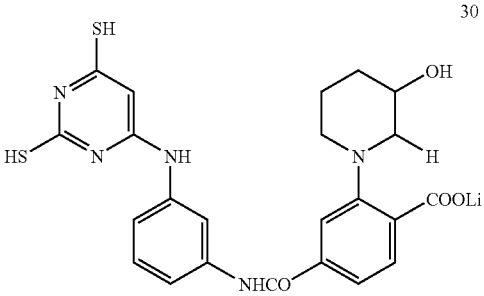

-continued
31
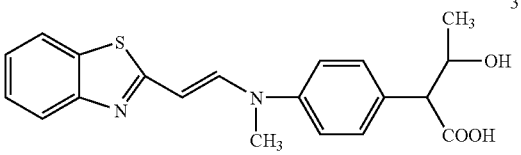
32
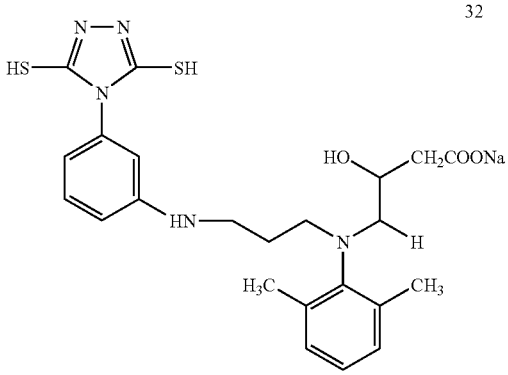
33
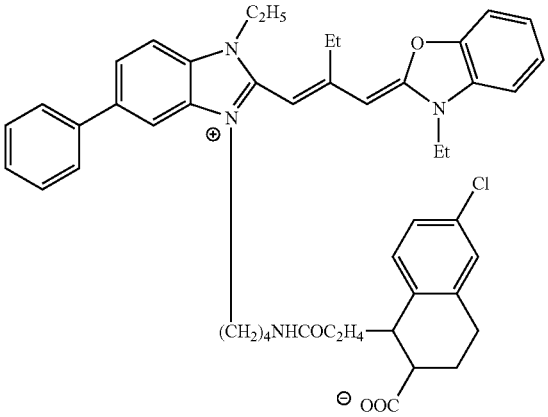
34
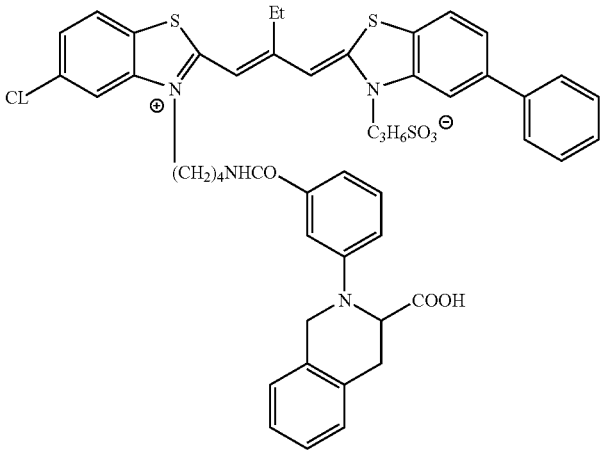
35
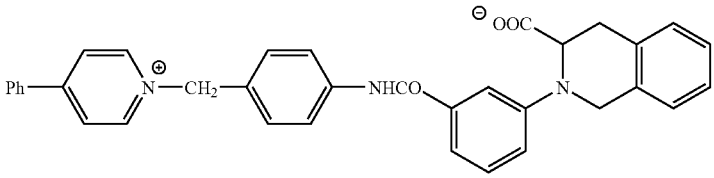

-continued
36
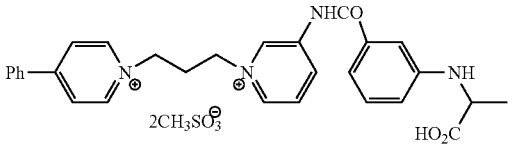
37
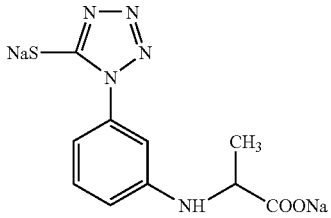
38
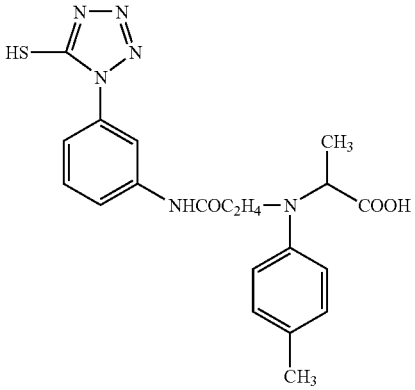
39
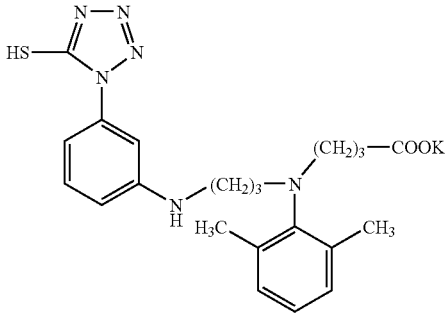
40
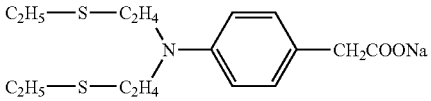
41
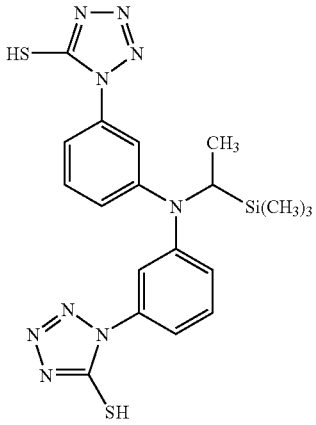
42
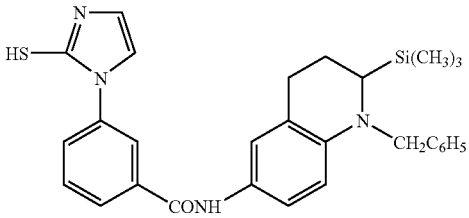
43
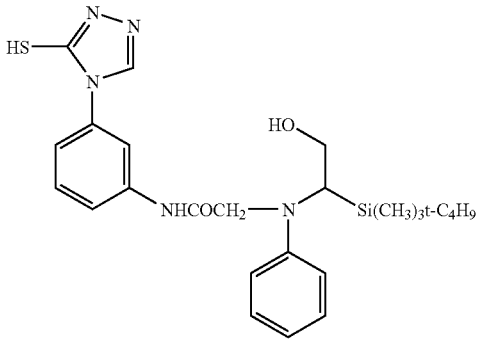

-continued

44

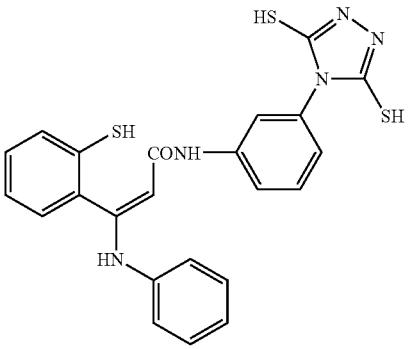

45

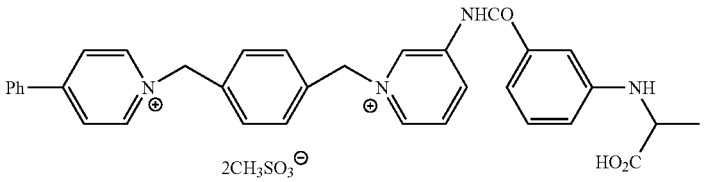

46

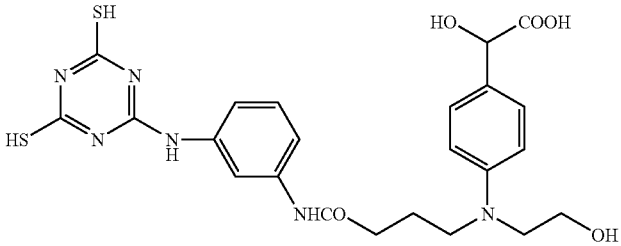

47

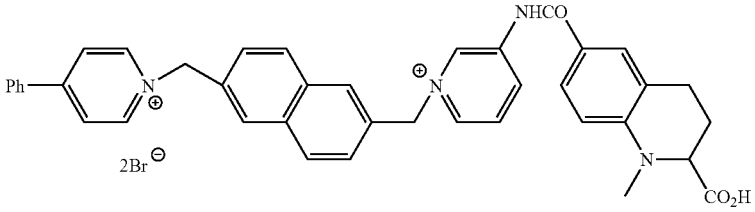

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating.

It is preferred that the compound of Groups 1 and 2 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably added to the image forming layer. The compound may be added to a surface protective layer, or an intermediate layer to be diffused to the image forming layer in the coating step. These compounds may be added before or after addition of a sensitizing dye. Each compound is contained in the image forming layer preferably in an amount of $1\times10^{-9}$ mol to $5\times10^{-2}$ mol, more preferably $1\times10^{-9}$ mol to $2\times10^{-3}$ mol, per 1 mol of silver halide.

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

$$A\text{-}(W)n\text{-}B \qquad \text{Formula (I)}$$

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof) a thione group (—C(=S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^-$, $Na^+$, $K^+$, $Mg^{2+}$, $Ag^+$, $Zn^{2+}$ and the like), an ammonium ion, a heterocyclic group comprising a quaternary nitrogen atom, a phosphonium ion and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamic acid ester group.

The heterocyclic group containing at least one atom selected from a nitrogen atom, a sulfur atom, a selenium atom and a tellurium atom represents a nitrogen atom containing heterocyclic group having —NH— group, as a partial structure of heterocycle, capable to form a silver iminate (>NAg) or a heterocyclic group, having —S— group, —Se— group, —Te— group or =N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, a purine group and the like are described. As the latter examples, a thiophene group, a thiazole group, a benzoxazole group, a thiadiazole group, an oxadiazole group, a triazine group, a selenoazole group, a benzoselenazole group, a tellurazole group, a benzotellurazole group and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen containing heterocyclic group including a quaternary nitrogen atom. As examples of the heterocyclic group containing a quaternary nitrogen atom, a pyridinio group, a quinolinio group, an isoquinolinio group, an imidazolio group and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No.11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group and the like) or a nitrogen atom containing heterocyclic group having a —NH— group capable to form an imino-silver (>NAg) as a partial structure of heterocycle (e.g., a benzotriazole group, a benzimidazole group, an indazole group and the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward photographic properties. For example, a divalent linking group, which includes a carbon atom, a hydrogen atom, an oxygen atom a nitrogen atom and a sulfur atom, can be used. As typical examples, an alkylene group having 1 to 20 carbon atoms (e.g., a methylene group, an ethylene group, a trimethylene group, a tetramethylene group, a hexamethylene group and the like), an alkenylene group having 2 to 20 carbon atoms, an alkynylene group having 2 to 20 carbon atoms, an arylene group having 6 to 20 carbon atoms (e.g., a phenylene group, a nephthylene group and the like), $—CONR_1—$, $—SO_2NR_2—$, —O—, —S—, $—NR_3—$, $—NR_4CO—$, $—NR_5SO_2—$, $—NR_6CONR_7—$, —COO—, —OCO— and the combination of these linking groups are described. Herein, $R_1$ represents a hydrogen atom, an alkyl group, a heterocyclic group, or an aryl group.

The linking group represented by W may have any substituent.

In formula (I), a reducible group represented by B represents the group capable to reduce a silver ion. As the examples, a formyl group, an amino group, a triple bond group such as an acetylene group, a propargyl group and the like, a mercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), aclhydrazines, carbamoylhydrazides and a residue which is obtained by removing one hydrogen atom from 3-pyrazolidones and the like can be described. They may have any substituent.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

In formula (I), a reducible group represented by B preferably is hydroxylamines, hydroxamic acids, hydroxyureas, hydroxysemicarbazides, reductones, phenols, acylhydrazines, carbamoylhydrazides, or a residue which is obtained by removing one hydrogen atom from 3-pyrazolidones and the like.

The compound of formula (I) in the present invention may have the ballasted group or polymer chain in it generally used in the non-moving photographic additives as a coupler. And as a polymer, for example, the polymer described in JP-A No. 1-100530 can be described.

The compound of formula (I) in the present invention may be bis or tris type of compound. The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)

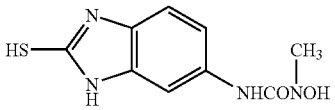

(2)

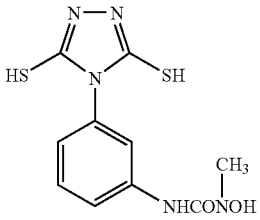

(3)

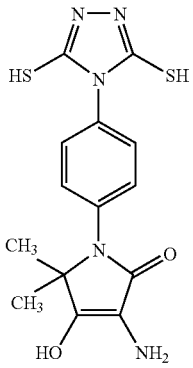

-continued (4)

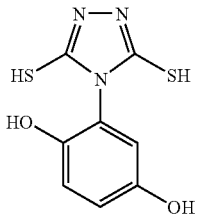

(5)

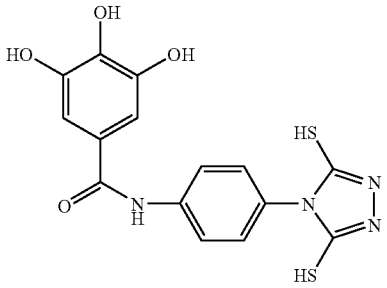

(6)

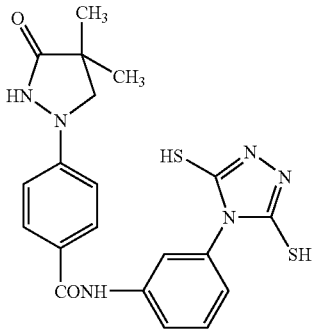

(7)

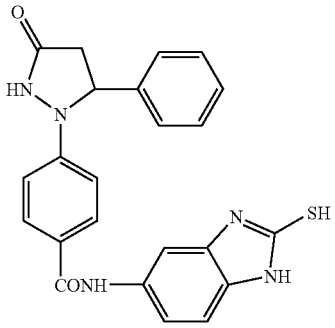

(8)

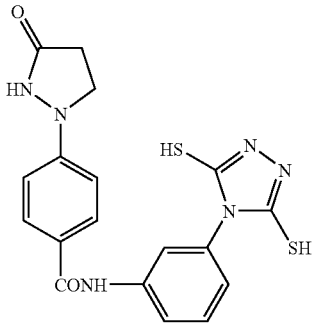

-continued (9)

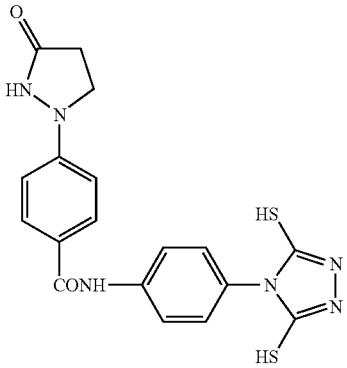

(10)

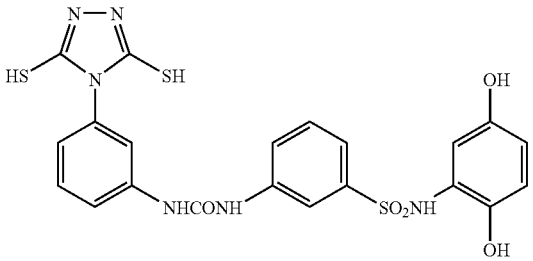

(11)

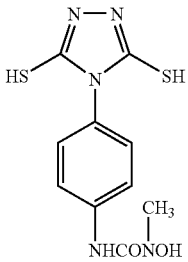

(12)

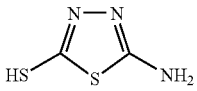

(13)

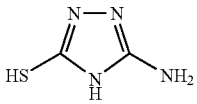

Further, example compounds 1 to 30 and 1"-1 to 1"-77 shown in EP-A No. 1308776A2, pages 73 to 87 are also described as preferable examples of the compound having an adsorptive group and a reducible group according to the invention.

These compounds can be easily synthesized by the known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to a image forming layer and more preferably is to be added at an emulsion preparing process. In the case, wherein these compounds are added at an emulsion preparing process, these compounds may be added at any step in the process. For example, the silver halide grain forming step, the step before starting of desalting step, the desalting step, the step before starting of chemical ripening, the chemical ripening step, the step before preparing a final emulsion and the like are described. Also, the addition can be performed in plural times during the process. It is preferred to be added in an image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving them in an organic solvent having a high boiling point and also may be added as a solid dispersion.

11) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously.

Particularly, the photothermographic material of the invention is preferably spectral sensitized to have a spectral sensitive peak in a range of 600 nm to 900 nm, or in a range of 300 nm to 500 nm. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or, two or more kinds of them may be used in combination.

In the invention, the sensitizing dye may be added at any amount according to the properties of sensitivity and fog, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect.

The super sensitizers usable in the invention can include those compounds described in EP-A No. 587338, U.S. Pat. Nos. 3,877,943 and 4,873,184, JP-A Nos. 5-341432, 11-109547 and 10-111543, and the like.

12) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

13) Mixing Silver Halide and Organic Silver Salt

The photosensitive silver halide in the invention is particularly preferably formed under the absence of the non-photosensitive organic silver salt and chemically sensitized. This is because a sufficient sensitivity can not sometimes be attained by the method of forming the silver halide by adding a halogenating agent to the organic silver salt.

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

2. Black and White Photothermographic Material

The black and white photothermographic material of the invention has an image forming layer comprising at least a photosensitive silver halide, a non-photosensitive organic silver salt, a reducing agent and a binder on at least one surface of a support. Further preferably, the image forming layer may have disposed thereon a surface protective layer, or a back layer, a back protective layer may be disposed on the opposite surface of the image forming layer toward the support.

The constitutions and preferable components of these layers will be explained in detail below.

(The Compound which Practically Reduces the Visible Light Absorption by Photosensitive Silver Halide)

In the present invention, it is preferred that the photothermographic material contains the compound which practically reduces the visible light absorption derived from photosensitive silver halide after thermal development against before thermal development.

In the present invention, it is particularly preferred that silver iodide complex-forming agent is used as the compound which practically reduces visible light absorption derived from photosensitive silver halide after thermal development.

<Silver Iodide Complex-forming Agent>

In the present invention, it is preferred to use a compound which practically reduces the visible light absorption derived from photosensitive silver halide by thermal development, and it is particularly preferred to use a silver iodide complex-forming agent.

As for the silver iodide complex-forming agent according to the present invention, at least one of nitrogen atom or sulfur atom in the compound is possible to contribute to a Lewis acid-base reaction which gives an electron to a silver ion, as a ligand atom (electron donor: Lewis base). The stability of the complex is defined by successive stability constant or total stability constant, but it depends on the combination of silver ion, iodo ion and the silver complex forming agent. As a general guide, it is possible to obtain a big stability constant by chelate effect from intramolecular chelate ring formation, by means of increasing the acid-bace dissociation constant and the like.

In the present invention, ultra violet-visible light absorption spectrum of photosensitive silver halide can be measured by the method of transmission or the method of reflection. When the absorption derived from other compounds added to the photothermographic material overlaps with the absorption of photosensitive silver halide, ultra violet-visible light absorption spectrum of photosensitive silver halide can be observed by using, independently or in combination, the means of difference spectrum and removal of other compounds by solvent and the like.

As a silver iodide complex-forming agent according to the present invention, a 5 to 7 membered heterocyclic compound containing at least one nitrogen atom is preferable. In the case where the compound does not have a mercapto group, a sulfide group, or a thione group as a substituent, the said nitrogen containing 5 to 7 membered heterocycle may be saturated or unsaturated, and may have other substituent. The substituent on a heterocycle may bind each other to form a ring.

As preferable examples of 5 to 7 membered heterocyclic compounds, pyrrole, pyridine, oxazole, isoxazole, thiazole, isothiazole, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, naphthylizine, purine, pterizine, carbazole, acridine, phenanthoridine, phenanthroline, phenazine, phenoxazine, phenothiazine, benzothiazole, benzoxazole, benzimidazole, 1,2,4-triazine, 1,3,5-triazine, pyrrolidine, imidazolidine, pyrazolidine, piperidine, piperazine, morpholine, indoline, isoindoline and the like can be described. More preferably, pyridine, imidazole, pyrazole, pyrazine, pyrimidine, pyridazine, indole, isoindole, indolizine, quinoline, isoquinoline, benzimidazole, 1H-imidazole, quinoxaline, quinazoline, cinnoline, phthalazine, 1,8-naphthylizine, 1,10-phenanthroline, benzimidazole, benzotriazole, 1,2,4-triazine, 1,3,5-triazine and the like can be described. Particularly preferably, pyridine, imidazole, pyrazine, pyrimidine, pyridazine, phtharazine, triazine, 1,8-naphthylizine and 1,10-phenanthroline and the like can be described.

These rings may have a substituent and any substituent can be used as far as it does not show a bad influence to photographic property. As preferable examples, a halogen atom (fluorine atom, chlorine atom, bromine atom or iodine atom), an alkyl group (a straight, a branched, a cyclic alkyl group containing a bicycloalkyl group or an active methylene group), an alkenyl group, an alkynyl group, an aryl group, a heterocyclic group (substituted position is not asked), an acyl group, an alkoxycarbonyl group, an aryloxycarbonyl group, a heterocyclic oxycarbonyl group, a carbamoyl group, a N-acylcarbamoyl group, a N-sulfonylcarbamoyl group, a N-carbamoylcarbamoyl group, a N-sulfamoylcarbamoyl group, a carbazoyl group, a carboxy group and a salt thereof, an oxalyl group, an oxamoyl group, a cyano group, a carboimidoyl group, a formyl group, a hydroxy group, an alkoxy group (the group repeating ethylene oxy group units or propylene oxy group units is included), an aryloxy group, a heterocyclic oxy group, an acyloxy group, an alkoxycarbonyloxy group, an aryloxycarbonyloxy group, a carbamoyloxy group, a sulfonyloxy group, an amino group, an alkylamino group, an arylamino group, a heterocyclic amino group, an acylamino group, a sulfonamido group, an ureido group, a thioureido group, an imido group, an alkoxycarbonylamino group, an aryloxycarbonylamino group, a sulfamoylamino group, a semicarbazide group, an ammonio group, an oxamoylamino group, a N-alkylsulfonylureido group, a N-arylsulfonylureido group, a N-acylureido group, N-acylsulfamoylamino group, a nitro group, a heterocyclic group containing a quaternary nitrogen atom (e.g., a pyridinio group, an imidazolio group, a quinolinio group, an isoquinolinio group), an isocyano group, an imino group, an alkylsulfonyl group, an arylsulfonyl group, an alkylsulfinyl group, an arylsulfinyl group, a sulfo group and a salt thereof, a sulfamoyl group, a N-acylsulfamoyl group, a N-sulfonylsulfamoyl group and a salt thereof, a phosphino group, a phosphinyl group, a phosphinyloxy group, a phosphinylamino group, a silyl group and the like are described. Here, an active methylene group means the methine group substituted by two electron-attracting groups, wherein the electron-attracting group means an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group, a carbonimidoyl group. Herein, two electron-attracting groups may bind each other to form a cyclic structure. And, the salt means a salt formed with positive ion such as an alkaline metal, an alkaline earth metal, a heavy metal or the like, or organic positive ion such as an ammonium ion, a phosphonium ion or the like. These substituents may be further substituted by these substituents.

These heterocycles may be further condensed by another ring. In the case where the substituent is an anion group (e.g., $—CO_2^-$, $-SO_3^-$, —S— and the like), the heterocycle containing nitrogen atom of the invention may become a positive ion (e.g., pyridinium, 1,2,4-triazolium and the like) and may form an intramolecular salt.

In the case where a heterocyclic compound is pyridine, pyrazine, pyrimidine, pyridazine, phthalazine, triazine, naththilizine or phenanthroline derivative, the acid dissociation constant (pKa) of a conjugated acid of nitrogen containing heterocyclic part in acid dissociation equilibrium of the said compound preferably is 3 to 8 in the mixture solution of tetrahydrofuran/water (3/2) at 25° C., and more preferably, the pKa is 4 to 7.

As the heterocyclic compound, pyridine, pyridazine or phtharazine derivative is preferable, and particularly preferable is pyridine or phthalazine derivative.

In the case where these heterocyclic compounds have a mercapto group, a sulfide group or a thione group as the substituent, pyridene, thiazole, isothiazole, oxazole, isoxazole, imidazole, pyrazole, pyrazine, pyrimidine, pyridazine, triazine, triazole, thiadiazole or oxadiazole derivatives are preferable, and thiazole, imidazole, pyrazole, pyrazine, pyrimidine, pyridazine, triazine, triazole derivatives are particularly preferable.

For example, as the said silver iodide complex-forming agent, the compound represented by the following formulae (1) or (2) can be used.

Formula (1)

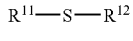

Formula (2)

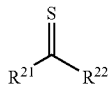

In formula (1), $R^{11}$ and $R^{12}$ each independently represent one of a hydrogen atom and a substituent. In formula (2), $R^{21}$ and $R^{22}$ each independently represent one of a hydrogen atom and a substituent. However, both of $R^{11}$ and $R^{12}$ are not hydrogen atoms together and both of $R^{21}$ and $R^{22}$ are not hydrogen atoms together. As the substituent herein, the substituent explained as the substituent of a 5 to 7 membered nitrogen containing heterocyclic type silver iodide complex-forming agent mentioned above can be described.

Further, the compound represented by formula (3) described below can also be used preferably.

Formula (3)

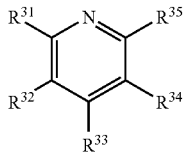

In formula (3), $R^{31}$ to $R^{35}$ each independently represent one of a hydrogen atom and a substituent. As the substituent represented by $R^{31}$ to $R^{35}$, the substituent of a 5 to 7 membered nitrogen containing heterocyclic type silver iodide complex-forming agent mentioned above can be described. In the case where the compound represented by formula (3) has a substituent, preferred substituting position is $R^{32}$ to $R^{34}$. $R^{31}$ to $R^{35}$ may bind each other to form a saturated or an unsaturated ring. Preferred substituent is a halogen atom, an alkyl group, an aryl group, a carbamoyl group, a hydroxy group, an alkoxy group, an aryloxy group, a carbamoyloxy group, an amino group, an acylamino group, an ureido group, an alkoxycarbonylamino group, an aryloxycarbonylamino group and the like.

In the compound represented by formula (3), the acid dissociation constant (pKa) of conjugated acid of pyridine ring part preferably is 3 to 8 in the mixed solution of tetrahydrofuran/water (3/2) at 25° C., and particularly preferably 4 to 7.

Furthermore, the compound represented by formula (4) is also preferable.

Formula (4)

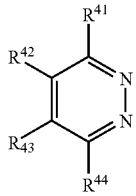

In formula (4), $R^{41}$ to $R^{44}$ each independently represent one of a hydrogen atom and a substituent. $R^{41}$ to $R^{44}$ may bind each other to form a saturated or an unsaturated ring. As the substituent represented by $R^{41}$ to $R^{44}$, the substituent of a 5 to 7 membered nitrogen containing heterocyclic type silver iodide complex-forming agent mentioned above can be described. As preferred group, an alkyl group, an alkenyl group, an alkynyl group, an aryl group, a hydroxy group, an alkoxy group, an aryloxy group a hetecyclic oxy group and a group which forms a phthalazine ring by benzo-condensation are described. In the case where a hydroxy group exists at the carbon atom adjacent to nitrogen atom of the compound represented by formula (4), there exists equilibrium between pyridazinone.

The compound represented by formula (4) more preferably forms a phthalazine ring represented by the following formula (5), and furthermore, this phthalazine ring particularly preferably has at least one subsutituent. As examples of $R^{51}$ to $R^{56}$ in formula (5), the substituent of a 5 to 7 membered nitrogen containing heterocyclic type silver iodide complex-forming agent mentioned above can be described. And as more preferable examplesof the substituent, an alkyl group, an alkenyl group, an alkynyl group, an aryl group, a hydroxy group, an alkoxy group, an aryloxy group and the like are described. An alkyl group, an alkenyl group, an aryl group, an alkoxy group and an aryloxy group are preferable and an alkyl group, an alkoxy group and an aryloxy group are more preferable.

Formula (5)

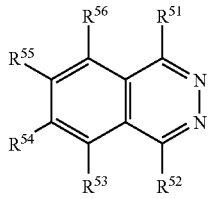

Further, the compound represented by formula (6) described below is also a preferable embodiment.

Formula (6)

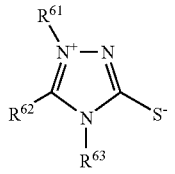

In formula (6), $R^{61}$ to $R^{63}$ each independently represent one of a hydrogen atom and a substituent. As examples of the substituent represented by $R^{62}$, the substituent of a 5 to 7 membered nitrogen containing heterocyclic type silver iodide complex-forming agent mentioned above can be described.

As the compound preferably used, the compound represented by the following formula (7) is described.

$R^{71}$—S-$(L)_n$S—$R^{72}$ Formula (7)

In formula (7), $R^{71}$ and $R^{72}$ each independently represent one of a hydrogen atom and a substituent. L represents a divalent linking group. n represents 0 or 1. As the substituent represented by $R^{71}$ and $R^{72}$, an alkyl group (containing a cycloalkyl group), an alkenyl group (containing a cycloalkenyl group), an alkynyl group, an aryl group, a heterocyclic group, an acyl group, an aryloxycarbonyl group, an alkoxycarbonyl group, a carbamoyl group, an imido group and a complex substituent containing these groups are described as examples. A divalent linking group represented by L preferably has the length of 1 to 6 atoms and more preferably has the length of 1 to 3 atoms, and furthermore, may have a substituent.

One more of the compounds preferably used is a compound represented by formula (8).

Formula (8)

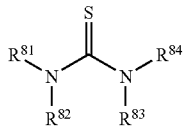

In formula (8), $R^{81}$ to $R^{84}$ each independently represent one of a hydrogen atom and a substituent. As the substituent represented by $R^{81}$ to $R^{84}$, an alkyl group (including a cycloalkyl group), an alkenyl group (including a cycloalkenyl group), an alkynyl group, an aryl group, a heterocyclic group, an acyl group, an aryloxycarbonyl group, an alkoxycarbonyl group, a carbamoyl group, an imido group and the like are described as examples.

Among the silver iodide complex-forming agents described above, the compounds represented by formulae (3), (4), (5), (6) and (7) are preferable and, the compounds represented by formulae (3) and (5) are particularly preferable.

Preferable examples of silver iodide complex-forming agent are described below, however the present invention is not limited in these.

(1)

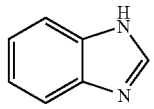

(2)

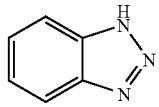

(3)

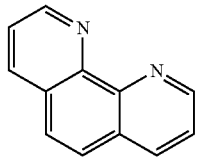

(4)

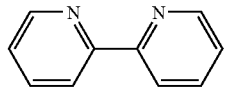

(5)

$C_5H_{11}SC_5H_{11}$ (6)

$C_4H_9SCH_2CH_2SC_4H_9$ (7)

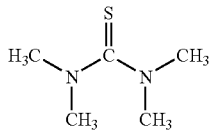

-continued
(8)
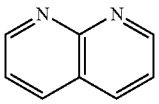
(9)
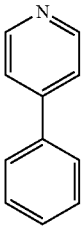
(10)
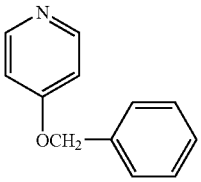
(11)
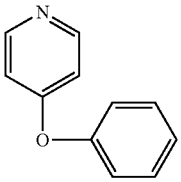
(12)
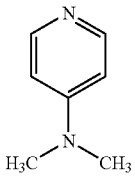
(13)
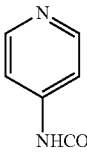
(14)
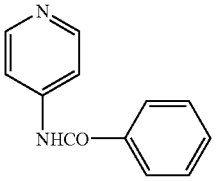
(15)
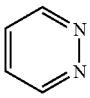
(16)
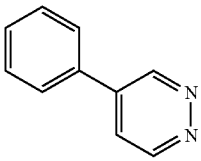
-continued
(17)
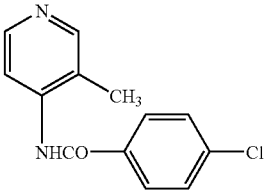
(18)
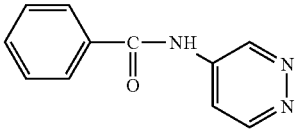
(19)
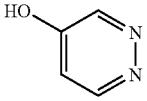
(20)
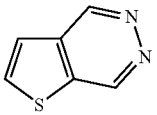
(21)
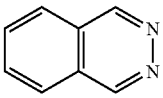
(22)
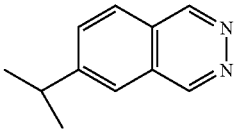
(23)
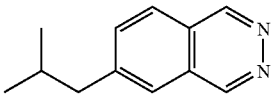
(24)
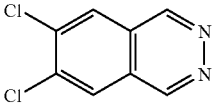
(25)
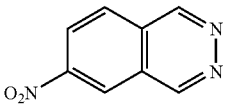
(26)
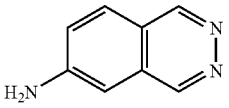
(27)
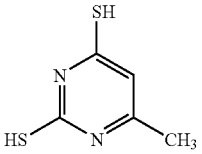
(28)
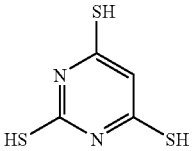

-continued (29)

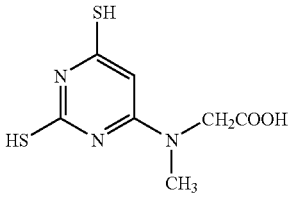

(30)

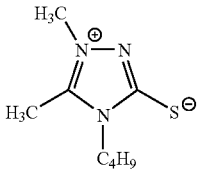

(31)

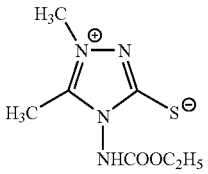

(32)

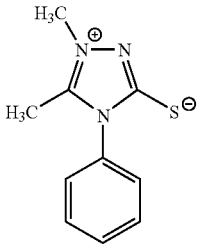

(33)

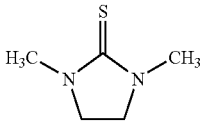

(34)

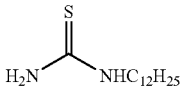

(35)

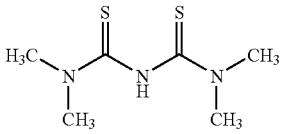

(36)

$HO(CH_2)_3S(CH_2)_2S(CH_2)_3OH$ (37)

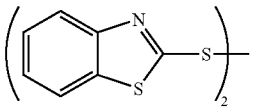

(38)

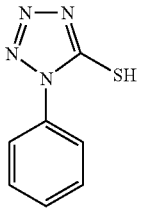

-continued (39)

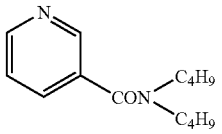

(40)

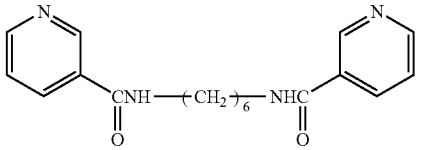

(41)

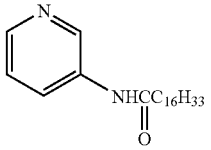

(42)

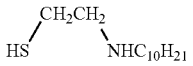

The silver iodide complex-forming agent according to the present invention can also be a compound common to a toner, in the case where the agent achieves the function of conventionally known toner. The silver iodide complex-forming agent according to the present invention can be used in combination with a toner. And, two or more kinds of the silver iodide complex-forming agents may be used in combination.

The silver iodide complex-forming agent according to the present invention preferably exists in a film under the state separated from a photosensitive silver halide, such as a solid state. It is also preferably added to the layer adjacent to the image forming layer. Concerning the silver iodide complex-forming agent according to the present invention, a melting point of the compound is preferably adjusted to a suitable range so that it can be dissolved when heated at thermal developing temperature.

In the present invention, an absorption intensity of ultra violet-visible light absorption spectrum of photosensitive silver halide after thermal development preferably becomes 80% or less as compared with before thermal development, more preferably 40% or less and, particularly preferably 10% or less.

The silver iodide complex-forming agent according to the invention may be incorporated into photothermographic material by being added into the coating solution, such as in the form of a solution, an emulsion dispersion, a solid fine particle dispersion, and the like.

As a well known emulsion dispersing method, there can be mentioned a method comprising dissolving the reducing agent in an auxiliary solvent such as oil, for instance, dibutyl phthalate, tricresyl phosphate, glyceryl triacetate, diethyl phthalate, and the like, as well as ethyl acetate, cyclohexanone, and the like; from which an emulsion dispersion is mechanically produced.

As solid fine particle dispersing method, there can be mentioned a method comprising dispersing the powder of the silver iodide complex-forming agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in the photothermographic material in an amount of 0.5 mg or less per 1 g of silver.

Preferably, an antiseptic (for instance, sodium benzoisothiazolinone salt) is added in the water dispersion.

The silver iodide complex-forming agent according to the invention is preferably used in the form of a solid dispersion.

The silver iodide complex-forming agent according to the invention is preferably used in the range from 1 mol % to 5000 mol %, more preferably, from 10 mol % to 1000 mol % and, further preferably, from 50 mol % to 300 mol %, with respect to the photosensitive silver halide in each case.

(Organic Silver Salt)

The organic silver salt according to the invention is relatively stable to light but serves as to supply silver ions and forms silver images when heated to 80° C. or higher under the presence of an exposed photosensitive silver halide and a reducing agent. The organic silver salt may be any organic material containing a source capable of reducing silver ions. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the organic silver salt can include, for example, silver behenate, silver arachidinate, silver stearate, silver oleate, silver laurate, silver capronate, silver myristate, silver palmitate and mixtures thereof. In the present invention, among the organic silver salts, it is preferred to use an organic silver salt with the silver behenate content of 50 mol % or more, and particularly preferably, 75 mol % to 98 mol %.

There is no particular restriction on the shape of the organic silver salt usable in the invention and it may needle-like, bar-like, tabular or flaky shape.

In the invention, a flaky shaped organic silver salt is preferred. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average) ≧1.5 and, more preferably, 15≧x (average) ≧1.5. By the way, needle-like is expressed as 1≦x (average)≦1.5.

In the flaky shaped particle, a can be regarded as a thickness of a tabular particle having a main plate with b and c being as the sides. a in average is preferably 0.01 μm to 0.3 μm and, more preferably, 0.1 μm to 0.23 μm. c/b in average preferably 1 to 6, more preferably 1 to 4, further preferably 1 to 3 and, particularly preferably 1 to 2.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The mono-dispersion can be determined from particle size (volume weighted mean diameter) obtained, for example, by a measuring method of irradiating a laser beam to an organic silver salt dispersed in a liquid, and determining a self correlation function of the fluctuation of scattered light to the change of time.

Methods known in the art may be applied to the method for producing the organic silver salt used in the invention and to the dispersing method thereof. For example, reference can be made to JP-A No. 10-62899, EP-A Nos. 0803763A1 and 0962812A1, JP-A Nos. 11-349591, 2000-7683, 2000-72711, 2001-163827, 2001-163889, 2001-163890, 11-203413, 2001-188313, 2001-83652, 2002-6442, 2002-31870, and the like.

In the invention, the photothermographic material can be prepared by mixing an aqueous dispersion of an organic silver salt and an aqueous dispersion of a photosensitive silver salt. A method of mixing two or more kinds of aqueous dispersions of organic silver salts and two or more kinds of aqueous dispersions of photosensitive silver salts upon mixing are used preferably for controlling the photographic properties.

While an organic silver salt in the invention can be used in a desired amount, an amount of an organic silver salt is preferably in the range from 0.1 $g/m^2$ to 5 $g/m^2$, more preferably 1 $g/m^2$ to 3 $g/m^2$, and particularly preferably 1.2 $g/m^2$ to 2.5 $g/m^2$, with respect to the amount of silver.

(Reducing Agent)

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A No. 0803764A1 (page 7, line 34 to page 18, line 12).

In the invention, a so-called hindered phenolic reducing agent or a bisphenol reducing agent having a substituent at the ortho-position to the phenolic hydroxy group is preferred. Particularly, the compound represented by the following formula (R) is preferred.

Formula (R)

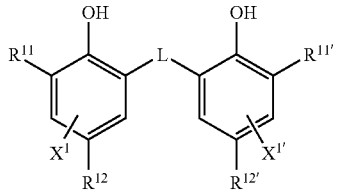

In formula (R), $R^{11}$ and $R^{11'}$ each independently represent an alkyl group having 1 to 20 carbon atoms. $R^{12}$ and $R^{12'}$ each independently represent one of a hydrogen atom and a substituent capable of substituting for a hydrogen atom on a benzene ring. L represents one of a —S— group and a —$CHR^{13}$— group. $R^{13}$ represents one of a hydrogen atom and an alkyl group having 1 to 20 carbon atoms. $X^1$ and $X^{1'}$ each independently represent one of a hydrogen atom and a group capable of substituting for a hydrogen atom on a benzene ring.

Each of the substituents is to be described specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, $X^1$ and $X^{1'}$ $R^{12}$ and $R^{12'}$ each independently represent one of a hydrogen atom and a group capable of substituting for a hydorgen atom on a benzene ring.

$X^1$ and $X^{1'}$ each independently represent one of a hydrogen atom and a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents one of a —S— group and a —$CHR^{13}$— group. $R^{13}$ represents one of a hydrogen atom and an alkyl group having 1 to 20 carbon atoms in which the alkyl group may have a substituent.

Specific examples of the unsubstituted alkyl group for $R^{13}$ can include, for example, methyl group, ethyl group, propyl group, butyl group, heptyl group, undecyl group, isopropyl group, 1-ethylpentyl group, 2,4,4-trimethylpentyl group and the like.

Examples of the substituent for the alkyl group can include, similar to substituent of $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, sulfamoyl group and the like.

4) Preferred Substituents $R^{11}$ and $R^{11'}$ are, preferably, a secondary or tertiary alkyl group having 3 to 15 carbon atoms and can include, specifically, isopropyl group, isobutyl group, t-butyl group, t-amyl group, t-octyl group, cyclohexyl group, cyclopentyl group, 1-methylcyclohexyl group, 1-methylcyclopropyl group and the like. $R^{11}$ and $R^{11'}$ each represent, more preferably, an alkyl group having 4 to 12 carbon atoms and, among them, t-butyl group, t-amyl group, 1-methylcyclohexyl group are further preferred and, t-butyl group being most preferred.

$R^{12}$ and $R^{11'}$ are, preferably, an alkyl group having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group, methoxyethyl group and the like. More preferred are methyl group, ethyl group, propyl group, isopropyl group, and t-butyl group.

$X^1$ and $X^{1'}$ are, preferably, one selected from a hydrogen atom, a halogen atom, and an alkyl group, and more preferably, a hydrogen atom.

L is preferably a —$CHR^{13}$— group.

$R^{13}$ is, preferably, a hydrogen atom or an alkyl group having 1 to 15 carbon atoms. Preferable examples of the alkyl group can include methyl group, ethyl group, propyl group, isopropyl group, 2,4,4-trimethylpentyl group. Particularly preferable $R^{13}$ is a hydrogen atom, methyl group, propyl group, or isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably an ethyl group.

When $R^{13}$ is a primary or secondary alkyl group having 1 to 8 carbon atoms, $R^{12}$ and $R^{12'}$ are preferably a methyl group. The alkyl group as $R^{13}$ having 1 to 8 carbon atoms is preferably a methyl group, an ethyl group, a propyl group or an isopropyl group, and more preferably a methyl group, an ethyl group or a propyl group.

When all of $R^{11}$, $R^{11'}$, $R^{12}$ and $R^{12'}$ are a methyl group, $R^{13}$ is preferably a secondary alkyl group. The secondary alkyl group as $R^{13}$ is preferably an isopropyl group, an isobutyl group or a 1-ethylpentyl group, and more preferably an isopropyl group.

The reducing agent has different thermal development properties depending on the combination of $R^{11}$, $R^{11'}$, $R^{12}$, $R^{12'}$ and $R^{13}$. Since these properties can be controlled by using two or more kinds of the reducing agents in combination in various mixing ratios, it is preferable to use two or more kinds of the reducing agents depending on the purpose.

While examples of the compound as the reducing agent of the invention represented by formula (R) are listed below, the invention is not restricted to these compounds.

R-1

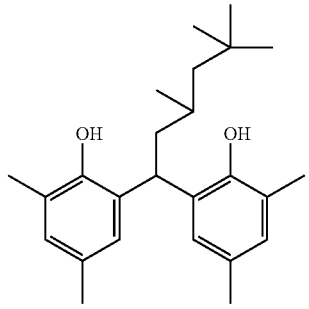

-continued
R-2
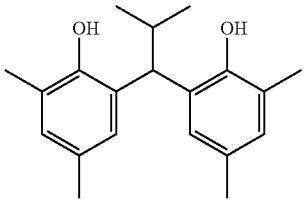
R-3
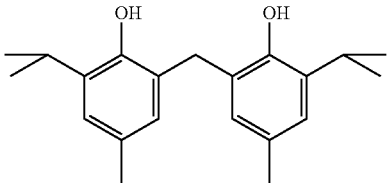
R-4
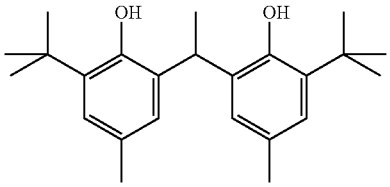
R-5
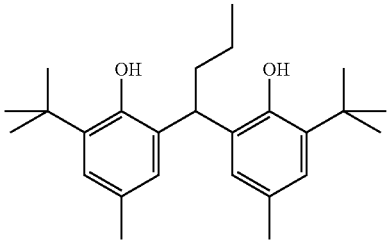
R-6
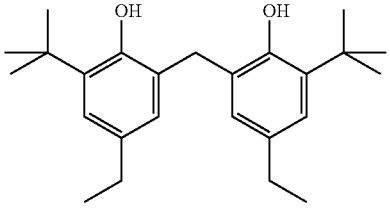
R-7
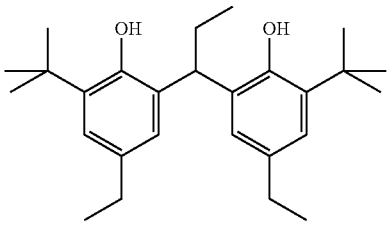
R-8
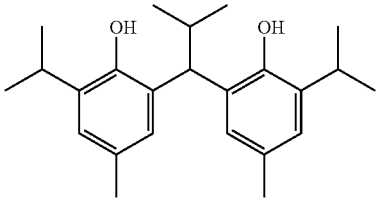
-continued
R-9
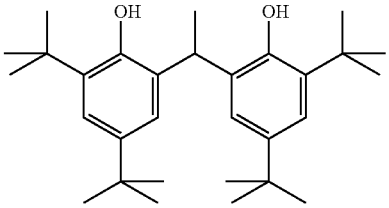
R-10
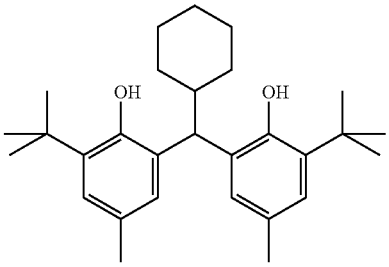
R-11
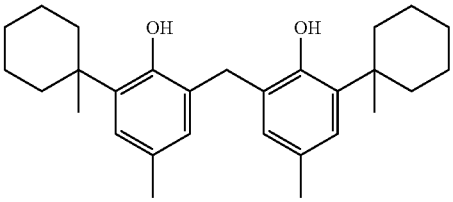
R-12
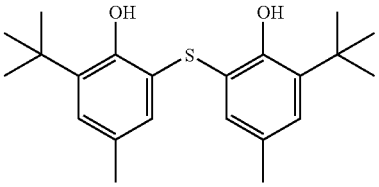
R-13
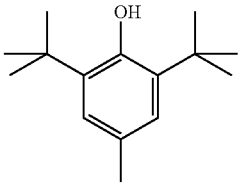
R-14
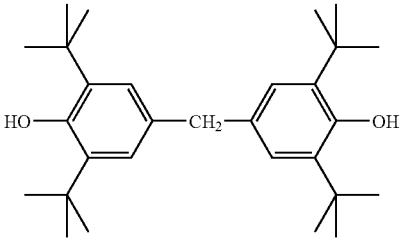
R-15
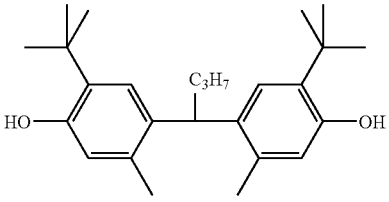

-continued

R-16

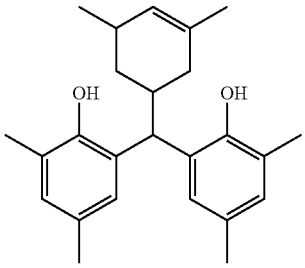

R-17

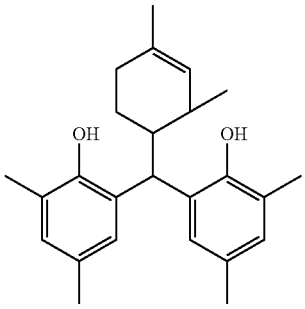

R-18

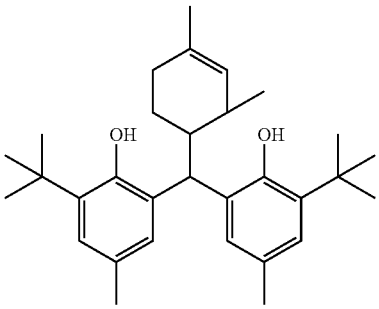

The addition amount of the reducing agent in the invention is preferably 0.01 g/m$^2$ to 5.0 g/m$^2$, more preferably 0.1 g/m$^2$ to 3.0 g/m$^2$. The reducing agent is contained in a proportion of preferably 5 mol % to 50 mol %, more preferably 10 mol % to 40 mol %, per 1 mol of silver contained in the surface comprising the image forming layer.

The reducing agent of the invention can be added to the image forming layer which comprises an organic silver salt and a photosensitive silver halide and to the layer adjacent to the image forming layer, but is preferably contained in the image forming layer.

In the invention, the reducing agent may be incorporated into photothermographic material by being added into the coating solution in any form, such as in the form of solution, emulsion dispersion, solid fine particle dispersion, and the like.

As well known emulsion dispersing method, there can be mentioned a method comprising dissolving the reducing agent in an oil such as dibutyl phthalate, tricresyl phosphate, glyceryl triacetate, diethyl phthalate or the like, and an auxiliary solvent such as ethyl acetate, cyclohexanone or the like, followed by mechanically forming the emulsified dispersion.

As solid fine particle dispersing method, there can be mentioned a method comprising dispersing the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). Preferably, an antiseptic (for instance, sodium benzoisothiazolinone salt) is added in the water dispersion.

Particularly, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 1 μm. In the invention, other solid dispersions are preferably used with this particle size range.

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include, the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

$$Q_1\text{-NHNH-}Q_2 \qquad \text{Formula (A-1)}$$

(wherein, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably having 1 to 50 carbon atoms and, more preferably 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Then, preferred range for the compounds represented by formula (A-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (A-2)

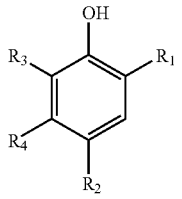

In formula (A-2), $R_1$ represents one selected from an alkyl group, an acyl group, an acylamino group, a sulfoneamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is, preferably, one selected from the following groups having 1 to 20 carbon atoms, those are an alkyl group (for example, methyl group, ethyl group, isopropyl group, butyl group, tert-octyl group, cyclohexyl group, or the like), an acylamino group (for example, acetylamino group, benzoylamino group, methylureido group, 4-cyanophenylureido group, or the like), and a carbamoyl group (for example, n-butylcarbamoyl group, N,N-diethylcarbamoyl group, phenylcarbamoyl group, 2-chlorophenylcarbamoyl group, 2,4-dichlorophenylcarbamoyl group, or the like). Among them, an acylamino group (including ureido group or urethane group) is more preferred. $R_2$ is, preferably, one selected from a halogen atom (more preferably, chlorine atom, bromine atom), an alkoxy group (for example, methoxy group, butoxy group, n-hexyloxy group, n-decyloxy group, cyclohexyloxy group, benzyloxy group, or the like), and an aryloxy group (for example, phenoxy group, naphthoxy group, or the like).

$R_3$ is preferably one selected from a hydrogen atom, a halogen atom, and an alkyl group having 1 to 20 carbon atoms, and most preferably a halogen atom. $R_4$ is preferably one selected from a hydrogen atom, alkyl group, and an acylamino group, and more preferably one of an alkyl group and an acylamino group. Examples of the preferred substituent thereof are identical with those for $R_1$. In a case where $R_4$ is an acylamino group, $R_4$ may preferably link with $R_3$ to form a carbostyryl ring.

In a case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In a case where formula (A-2) is a naphtholic compound, $R_1$, is, preferably, a carbamoyl group. Among them, benzoyl group is particularly preferred. $R_2$ is, preferably, one of an alkoxy group and an aryloxy group and, particularly preferably an alkoxy group.

Preferred specific examples for the development accelerator of the invention are to be described below. The invention is not restricted to them.

A-1

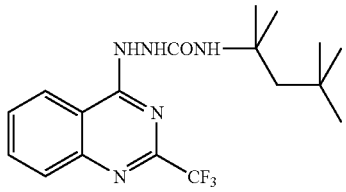

A-2

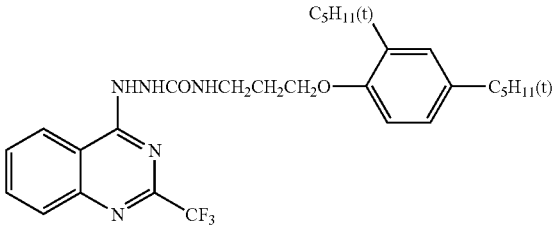

A-3

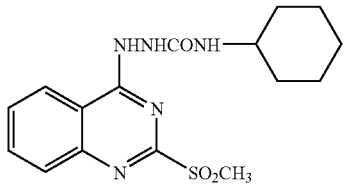

A-4

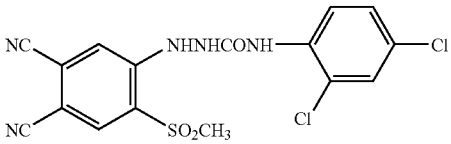

A-5

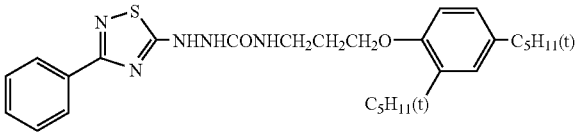

A-6

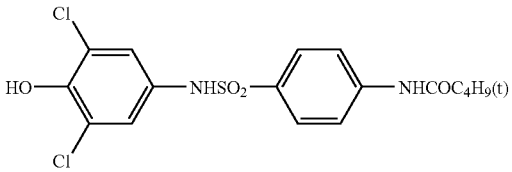

-continued

A-7

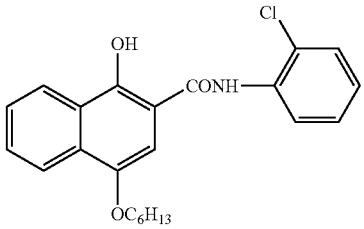

A-8

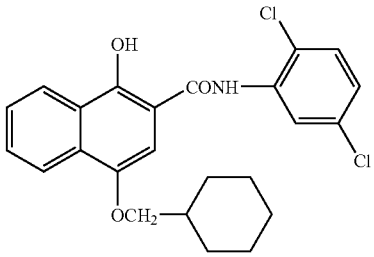

A-9

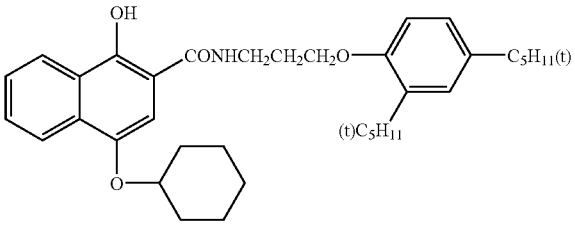

A-10

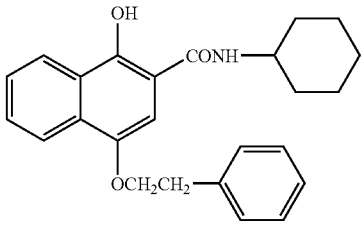

A-11

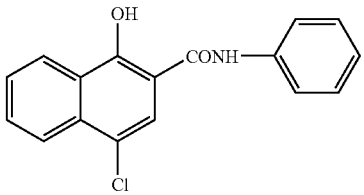

A-12

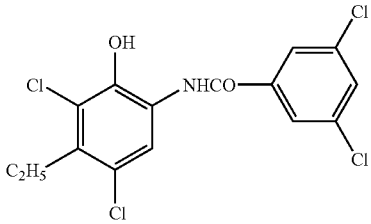

(Hydrogen Bonding Compound)

In the invention, in the case where the reducing agent has an aromatic hydroxy group (—OH) or an amino group, it is preferred to use in combination, a non-reducing compound having a group capable of reacting with these groups of the reducing agent, and that is also capable of forming a hydrogen bond therewith.

As a group forming a hydrogen bond, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H)), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

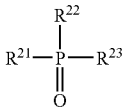

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As an aryl group, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As an alkoxyl group, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As an aryloxy group, there can be mentioned phenoxy group, cresyloxy group, isopropylphenoxy group, 4-t-butylphenoxy group, naphthoxy group, biphenyloxy group, and the like.

As an amino group, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{22}$ are of the same group.

Specific examples of hydrogen bonding compounds represented by formula (D) of the invention and others are shown below, but it should be understood that the invention is not limited thereto.

D-1

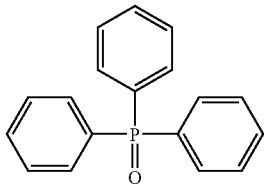

D-2

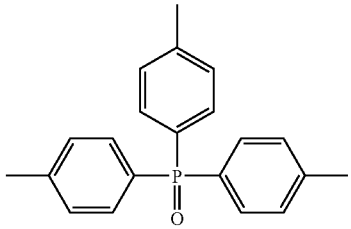

D-3

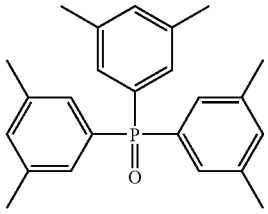

D-4

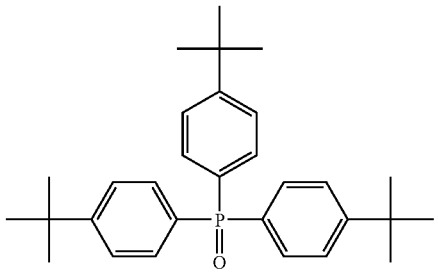

D-5

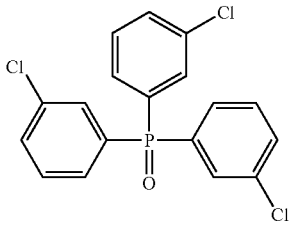

D-6

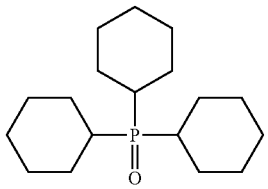

-continued

D-7

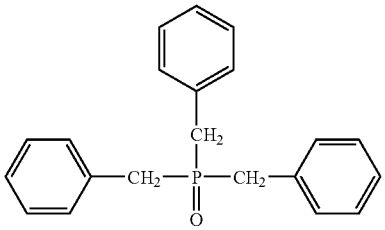

D-8

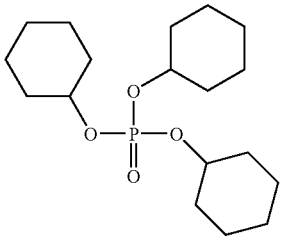

D-9

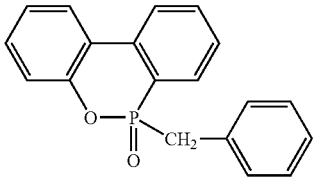

D-10

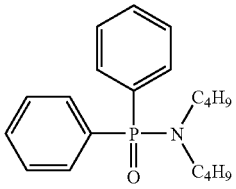

D-11

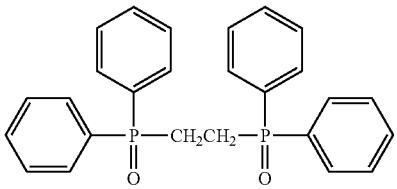

D-12

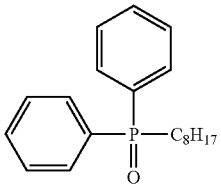

D-13

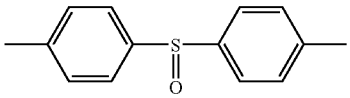

D-14

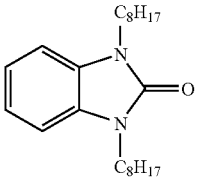

-continued

D-15

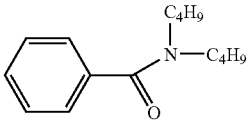

Specific examples of hydrogen bonding compounds other than those enumerated above can be found in those described in JP-A Nos. 2001-281793 and 2002-14438.

The hydrogen bonding compound of the invention can be used in the photothermographic material by being incorporated into the coating solution in the form of solution, emulsion dispersion, or solid fine particle dispersion similar to the case of the reducing agent. In the solution, the hydrogen bonding compound of the invention forms a hydrogen-bonded complex with a compound having a phenolic hydroxy group, and can be isolated as a complex in crystalline state depending on the combination of the reducing agent and the compound expressed by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the hydrogen bonding compound of the invention in the form of powders and dispersing them with a proper dispersing agent using a sand grinder mill and the like.

The hydrogen bonding compound of the invention is preferably used in the range from 1 mol % to 200 mol %, more preferably from 10 mol % to 150 mol %, and further preferably, from 30 mol % to 100 mol %, with respect to the reducing agent.

(Binder)

Any kind of polymer may be used as the binder for the image forming layer in the photothermographic material of the invention as far as the glass transition temperature of the binder is in the range from 0° C. to 80° C. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), polyester, polyurethane, phenoxy resin, poly(vinylidene chloride), polyepoxide, polycarbonate, poly(vinyl acetate), polyolefin, cellulose esters, and polyamide. A binder may be used with water, an organic solvent or emulsion to form a coating solution.

The glass transition temperature (Tg) of the binder is in the range from 0° C. to 80° C., preferably from 10° C. to 70° C. and, more preferably from 15° C. to 60° C.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, it is preferred that the image forming layer is formed by first applying a coating solution containing 30% by weight or more of water in the solvent and by then drying.

In the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be ameliorated. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under 25° C. and 60\% RH} = [(W1 - W0)/W0] \times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in the range from 1 nm to 50,000 nm, and preferably from 5 nm to 1,000 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, a polymer latex having crosslinking property is particularly preferably used.

<Specific Examples of Latexes>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)—(molecular weight 37000, Tg 61° C.)

P-2; Latex of -MMA(70)-2EHA(20)-St(5)-AA(5)—(molecular weight 40000, Tg 59° C.)

P-3; Latex of -St(50)-Bu(47)-MAA(3)—(crosslinking, Tg 17° C.)

P-4; Latex of -St(68)-Bu(29)-AA(3)—(crosslinking, Tg 17° C.)

P-5; Latex of -St(71)-Bu(26)-AA(3)—(crosslinking, Tg 24° C.)

P-6; Latex of -St(70)-Bu(27)-IA(3)—(crosslinking)

P-7; Latex of -St(75)-Bu(24)-AA(1)—(crosslinking, Tg 29° C.)

P-8; Latex of -St(60)-Bu(35)-DVB(3)-MAA(2)—(crosslinking)

P-9; Latex of -St(70)-Bu(25)-DVB(2)-AA(3)—(crosslinking)

P-10; Latex of -VC(50)-MMA(20)-EA(20)-AN(5)-AA(5)—(molecular weight 80000)

P-11; Latex of -VDC(85)-MMA(5)-EA(5)-MAA(5)—(molecular weight 67000)

P-12; Latex of -Et(90)-MAA(10)—(molecular weight 12000)

P-13; Latex of -St(70)-2EHA(27)-AA(3)—(molecular weight 130000, Tg 43° C.)

P-14; Latex of -MMA(63)-EA(35)-AA(2)—(molecular weight 33000, Tg 47° C.)

P-15; Latex of -St(70.5)-Bu(26.5)-AA(3)—(crosslinking, Tg 23° C.)

P-16; Latex of -St(69.5)-Bu(27.5)-AA(3)—(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above.

As the latex of styrene-butadiene copolymer preferably used in the invention, there can be mentioned P-3 to P-8 and P-15, or commercially available LACSTAR-3307B, 7132C, Nipol Lx416, and the like.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, and the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is in a range of from 1/10 to 10/1, preferably from 1/3 to 5/1, and more preferably from 1/1 to 3/1.

The image forming layer is, in general, a photosensitive layer containing a photosensitive silver halide, i.e., the photosensitive silver salt; in such a case, the weight ratio for total binder to silver halide (total binder/silver halide) is in the range of from 400 to 5, more preferably, from 200 to 10.

The total amount of binder in the image forming layer of the invention is preferably in the range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, or a surfactant and the like to improve coating properties.

<Preferable Solvent of Coating Solution>

In the invention, a solvent of a coating solution for the image forming layer (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281,637 and 9-329,864, U.S. Pat. No. 6,083,681, and EP No. 1048975.

1) Organic Polyhalogen Compound

Preferable organic polyhalogen compound that can be used in the invention is explained specifically below. In the invention, preferred polyhalogen compounds are the compounds expressed by formula (H) below:

$$Q\text{-}(Y)n\text{-}C(Z_1)(Z_2)X \qquad \text{Formula (H)}$$

In formula (H), Q represents one selected from an alkyl group, an aryl group, and a heterocyclic group; Y represents a divalent linking group; n represents 0 or 1; $Z_1$ and $Z_2$ each represent a halogen atom; and X represents one of a hydrogen atom and an electron-attracting group.

In formula (H), Q is preferably one selected from an alkyl group having 1 to 6 carbon atoms, an aryl group having 6 to 12 carbon atoms, and a heterocyclic group comprising at least one nitrogen atom (pyridine, quinoline or the like).

In the case where Q is an aryl group in formula (H), Q preferably is a phenyl group substituted by an electron-attracting group whose Hammett substituent constant up yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkyl sulfonyl group, an aryl sulfonyl group, an acyl group, an alkoxycarbonyl group, a carbamoyl group, sulfamoyl group and the like. Preferable as the electron-attracting groups are a halogen atom, a carbamoyl group and an arylsulfonyl group, and particularly preferred among them is a carbamoyl group.

X preferably is an electron-attracting group. As the electron-attracting group, preferable are a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably one of a bromine atom and an iodine atom, and more preferably, a bromine atom.

Y preferably represents one selected from —C(=O)—, —SO—, —$SO_2$—, —C(=O)N(R)—, and —$SO_2$N(R)—; more preferably, one selected from —C(=O)—, —$SO_2$—, and —C(=O)N(R)—; and particularly preferably, one of —$SO_2$— and —C(=O)N(R)—. Herein, R represents one selected from a hydrogen atom, an aryl group, and an alkyl group, preferably one of a hydrogen atom and an alkyl group, and particularly preferably a hydrogen atom.

n represents 0 or 1, and preferably represents 1.

In formula (H), in the case where Q is an alkyl group, Y is preferably —C(=O)N(R)—. And, in the case where Q is an aryl group or a heterocyclic group, Y is preferably —$SO_2$—.

In formula (H), the form where the residues, that are obtained by removing a hydrogen atom from the compound, bind each other (generally called as bis type, tris type, or tetrakis type) is also preferably used.

In formula (H), the form having a substituent of a dissociative group (for example, a COOH group or a salt thereof, a $SO_3H$ group or a salt thereof, a $PO_3H$ group or a salt thereof, and the like), a group containing a quaternary nitrogen atom (for example, an ammonium group, a pyridinium group, and the like), a polyethyleneoxy group, a hydroxy group, or the like is also preferable.

Specific examples of the compound expressed by formula (H) of the invention are shown below.

H-1

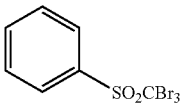

H-2

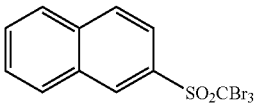

H-3

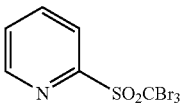

-continued

H-4

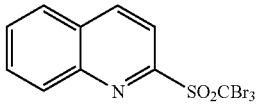

H-5

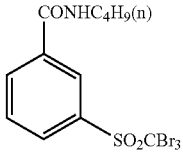

H-6

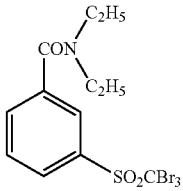

H-7

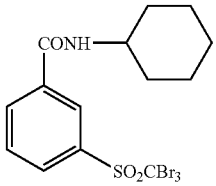

H-8

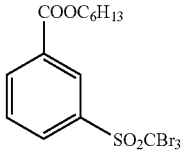

H-9

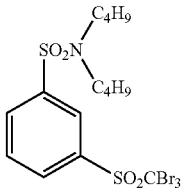

H-10

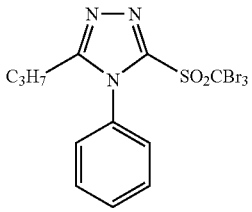

H-11

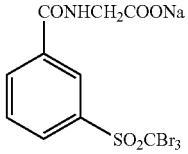

H-12

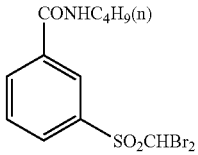

-continued

H-13

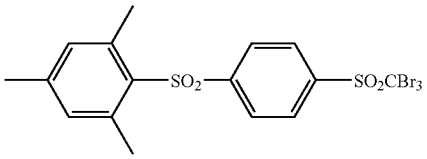

H-14

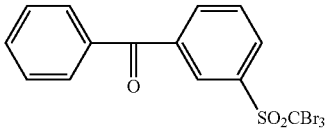

H-15

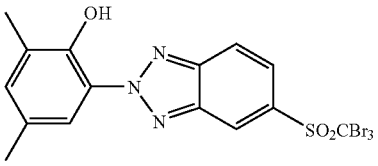

H-16

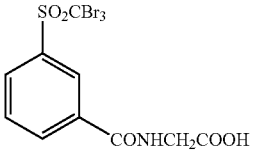

H-17

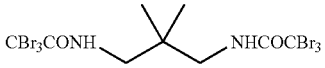

H-18

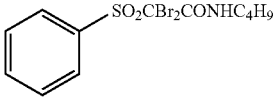

H-19

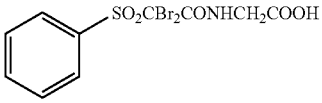

As preferred organic polyhalogen compounds of the invention other than those above, there can be mentioned compounds disclosed in U.S. Pat. Nos. 3,874,946, 4,756,999, 5,340,712, 5,369,000, 5,464,737, 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compounds expressed by formula (H) of the invention are preferably used in an amount from $10^{-4}$ mol to 1 mol, more preferably, $10^{-3}$ mol to 0.5 mol, and further preferably, $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and similarly, for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to Claim 9 of JP-A No. 11-352624, a compound expressed by general formula (III), 4-hydroxy-6-methyl-1,3,3a,7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photothermographic material, but as the addition layer, preferred is to select a layer on the side having thereon the image forming layer, and more preferred is to select the image forming layer. The azolium salt may be added at any time of the process of preparing the coating solution; in the case where the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like. In the invention, the azolium salt may be added at any amount, but preferably, it is added in a range from $1\times10^{-6}$ mol to 2 mol, and more preferably, from $1\times10^{-3}$ mol to 0.5 mol per one mol of silver.

(Nucleator)

In the invention, it is preferred to use a nucleator. By using a nucleator, it is possible to reduce the amount of silver necessary to obtain a certain density in silver image. The mechanism of this function of reduction can be thought variously, but the compound that has a function of increasing the covering power of developed silver is preferable. Herein, covering power of developed silver means a optical density per unit amount of silver.

As the nucleator, hydrazine derivative compounds represented by the following formula (SH), vinyl compounds represented by the following formula (G), and quaternary onium compounds represented by the following formula (P), cyclic olefine compounds represented by formulae (A), (B) and (C) can be described as preferable examples.

Formula (SH)

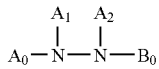

Formula (G)

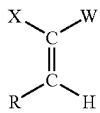

Formula (P)

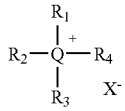

-continued

Formula (A)

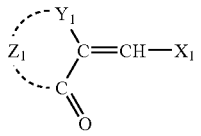

Formula (B)

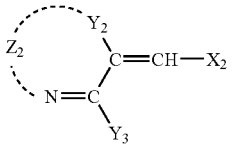

Formula (C)

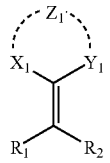

In formula (SH), $A_0$ represents one selected from an aliphatic group, an aromatic group, a heterocyclic group, and a $-G_0-D_0$ group. $B_0$ represents a blocking group. $A_1$ and $A_2$ both represent a hydrogen atom, or one represents a hydrogen atom and the other represents one of an acyl group, a sulfonyl group, and an oxalyl group. Herein, $G_0$ represents one selected from a —CO— group, a —COCO— group, a —CS— group, a $—C(=NG_1D_1)$ group, a —SO— group, a $—SO_2—$ group, and a $—P(O)(G_1D_1)-$ group. $G_1$ represents one selected from a mere bonding hand, a —O— group, a —S— group, and a $—N(D_1)-$ group, and $D_1$ represents one selected from an aliphatic group, an aromatic group, a heterocyclic group, and a hydrogen atom. In the case where plural $D_1$s exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described.

In formula (SH), the aliphatic group represented by $A_0$ preferably has 1 to 30 carbon atoms, and particularly preferably is a normal, blanched or cyclic alkyl group having 1 to 20 carbon atoms. For example, a methyl group, an ethyl group, a t-butyl group, an octyl group, a cyclohexyl group, a benzyl group are described. These may be further substituted by a suitable substituent (e.g., an aryl group, an alkoxy group, an aryloxy group, an alkylthio group, an arylthio group, a sulfoxy group, a sulfonamido group, a sulfamoyl group, an acylamino group, an ureido group and the like).

In formula (SH), the aromatic group represented by $A_0$ preferably is an aryl group of a single or condensed ring. For example, a benzene ring or a naphthalene ring is described. As a heterocyclic ring represented by $A_0$, the heterocyclic ring of a single or condensed ring containing at least one heteroatom selected from a nitrogen atom, a sulfur atom and an oxygen atom is preferable. For example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring and a furan ring are described. The aryl group, heterocyclic group or $-G_0-D_0$ group, as $A_0$, may have a substituent. As $A_0$, an aryl group or a $-G_0-D_0$ group is particularly preferable.

And, in formula (SH), $A_0$ preferably contains at least one of a diffusion-resistant group or an adsorptive group to silver halide. As a diffusion-resistance group, a ballast group usually used as non-moving photographic additive is preferable. As a ballast group, a photochemically inactive alkyl group, alkenyl group, alkynyl group, alkoxy group, phenyl group, phenoxy group, alkylphenoxy group and the like are described and it is preferred that the substituent part has 8 or more carbon atoms in total.

In formula (SH), as an adsorption promoting group to silver halide, thiourea, a thiourethane group, a mercapto group, a thioether group, a thione group, a heterocyclic group, a thioamido heterocyclic group, a mercapto heterocyclic group or an adsorptive group described in JP-A No. 64-90439 and the like are described.

In formula (SH), $B_0$ represents a blocking group and preferably a $-G_0-D_0$ group. $G_0$ represents one selected from a —CO— group, a —COCO— group, a —CS— group, a $—C(=NG_1D_1)$ group, a —SO— group, a $—SO_2—$ group, and a $—P(O)(G_1D_1)-$ group. As preferable Got a —CO— group and a —COCO— group are described. $G_1$ represents one selected from a mere bonding hand, a —O— group, a —S— group, and a $—N(D_1)-$ group, and $D_1$ represents one selected from an aliphatic group, an aromatic group, a heterocyclic group, and a hydrogen atom. In the case where plural $D_1$ exist in a molecule, they may be the same or different. $D_0$ represents one selected from a hydrogen atom, an aliphatic group, an aromatic group, a heterocyclic group, an amino group, an alkoxy group, an aryloxy group, an alkylthio group, and an arylthio group. As preferable $D_0$, a hydrogen atom, an alkyl group, an alkoxy group, an amino group and the like are described. $A_1$ and $A_2$ both represent a hydrogen atom, or one of $A_1$ and $A_2$ represents a hydrogen atom and the other represents one selected from an acyl group (an acetyl group, a trifluoroacetyl group, a benzoyl group or the like), a sulfonyl group (a methanesulfonyl group, a toluenesulfonyl group or the like), and an oxalyl group (an ethoxalyl group or the like).

As specific examples of the compound represented by formula (SH), the compound H-1 to H-35 of chemical formula Nos. 12 to 18 and the compound H-1-1 to H-4-5 of chemical formula Nos. 20 to 26 in JP-A No. 2002-131864 are described, however specific examples are not limited in these.

These compounds represented by formula (SH) can be easily synthesized by known methods. For example, these can be synthesized by referring to U.S. Pat. Nos. 5,464,738 and 5,496,695.

In addition, hydrazine derivatives preferably used are the compound H-1 to H-29 described in U.S. Pat. No. 5,545,505, columns 11 to 20 and the compounds 1 to 12 described in U.S. Pat. No. 5,464,738, columns 9 to 11. These hydrazine derivatives can be synthesized by known methods.

Next, formula (G) is explained. In formula (G), although X and R are displayed in a cis form, a trans form for X and R is also included in formula (G). This is also similar to the structure display of specific compounds.

In formula (G), X represents an electron-attracting group, and W represents one selected from a hydrogen atom, an alkyl group, an alkenyl group, an alkynyl group, an aryl group, a heterocyclic group, a halogen atom, an acyl group, a thioacyl group, an oxalyl group, an oxyoxalyl group, a thiooxalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfinamoyl group, a phosphoryl group, a nitro group, an imino group, a N-carbonylimino group, a N-sulfonylimino group, a dicyanoethylene group, an ammonium group, a sulfonium group, a phosphonium group, a pyrylium group, and an immonium group.

R represents one selected from a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, an organic or inorganic salt of hydroxy group or mercapto group (e.g., a sodium salt, a potassium salt, a silver salt and the like), an amino group, an alkylamino group, a cyclic amino group (e.g., a pyrrolidino group and the like), an acylamino group, an oxycarbonylamino group, a heterocyclic group (a 5 or 6 membered nitrogen containing heterocycle, e.g., a benzotriazolyl group, an imidazolyl group, a triazolyl group, a tetrazolyl group and the like), an ureido group, and a sulfonamido group. X and W, and X and R may bind each other to form a cyclic structure. As the ring formed by X and W, for example, pyrazolone, pyrazolidinone, cyclopentanedione, β-ketolactone, β-ketolactam and the like are described.

Explaining formula (G) further, the electron-attracting group represented by X is a substituent which can have a positive value of substituent constant σp. Specifically, a substituted alkyl group (halogen substituted alkyl and the like), a substituted alkenyl group (cyanovinyl and the like), a substituted or unsubstituted alkynyl group (trifluoromethylacetylenyl, cyanoacetylenyl and the like), a substituted aryl group (cyanophenyl and the like), a substituted or unsubstituted heterocyclic group (pyridyl, triazinyl, benzoxazolyl and the like), a halogen atom, a cyano group, an acyl group (acetyl, trifluoroacetyl, formyl and the like), a thioacetyl group (thioacetyl, thioformyl and the like), an oxalyl group (methyloxalyl and the like), an oxyoxalyl group (ethoxalyl and the like), a thiooxalyl group (ethylthiooxalyl and the like), an oxamoyl group (methyloxamoyl and the like), an oxycarbonyl group (ethoxycarbonyl and the like), a carboxyl group, a thiocarbonyl group (ethylthiocarbonyl and the like), a carbamoyl group, a thiocarbamoyl group, a sulfonyl group, a sulfinyl group, an oxysulfonyl group (ethoxysulfonyl and the like), a thiosulfonyl group (ethylthiosulfonyl and the like), a sulfamoyl group, an oxysulfinyl group (methoxysulfinyl and the like), a thiosulfinyl group (methylthiosulfinyl and the like), a sulfinamoyl group, a phosphoryl group, a nitro group, an imino group, a N-carbonylimino group (N-acetylimino and the like), a N-sulfonylimino group (N-methanesulfonylimino and the like), a dicyanoethylene group, an ammonium group, a sulfonium group, a phosphonium group, a pyrylium group, an immonium group and the like are described, and a heterocyclic one formed by an ammonium group, a sulfonium group, a phosphonium group, an immonium group or the like is also included. The substituent having σp value of 0.30 or more is particularly preferable.

As an alkyl group represented by W, methyl, ethyl, trifluoromethyl and the like are described. As an alkenyl group as W, vinyl, halogen substituted vinyl, cyanovinyl and the like are described. As an aryl group as W, nitrophenyl, cyanophenyl, pentafluorophenyl and the like are described, and as a heterocyclic group as W, pyridyl, pyrimidyl, triazinyl, succinimido, tetrazolyl, triazolyl, imidazolyl, benzimidazolyl and the like are described. As W, the electron-attracting group having a positive σp value is preferable and that value preferably is 0.30 or more.

Among the substituents of R described above, a hydroxy group, a mercapto group, an alkoxy group, an alkylthio group, a halogen atom, an organic or inorganic salt of hydroxy group or mercapto group, and a heterocyclic group are preferably described. More preferably a hydroxy group, an alkoxy group, an organic or inorganic salt of hydroxyl group or mercapto group and a heterocyclic group are described, and particularly preferably a hydroxy group and an organic or inorganic salt of hydroxy group or mercapto group are described.

And among the substituents of X and W described above, the group having a thioether bond in the substituent is preferable.

As specific examples of the compound represented by formula (G), compound 1-1 to 92-7 of chemical formula Nos. 27 to 50 described in JP-A No. 2002-131864 are described, however specific examples are not limited in these.

In formula (P), Q represents one of a nitrogen atom and a phosphor atom. $R_1$, $R_2$, $R_3$ and $R_4$ each independently represent one of a hydrogen atom and a substituent, and $X^-$ represents an anion. And $R_1$ to $R_4$ may link each other to form a ring.

As the substituent represented by $R_1$ to $R_4$, an alkyl group (a methyl group, an ethyl group, a propyl group, a butyl group, a hexyl group, a cyclohexyl group and the like), an alkenyl group (an allyl group, a butenyl group and the like), an alkynyl group (a propargyl group, a butynyl group and the like), an aryl group (a phenyl group, a naphthyl group and the like), a heterocyclic group (a piperidinyl group, a piperazinyl group, a morpholinyl group, a pyridyl group, a furyl group, a thienyl group, a tetrahydrofuryl group, a tetrahydrothienyl group, a sulforanyl group and the like), an amino group and the like are described.

As the ring formed by linking $R_1$ to $R_4$ each other, a piperidine ring, a morpholine ring, a piperazine ring, a quinuclidine ring, a pyridine ring, a pyrrole ring, an imidazole ring, a triazole ring, a tetrazole ring and the like are described.

The group represented by $R_1$ to $R_4$ may have a substituent such as a hydroxy group, an alkoxy group, an aryloxy group, a carboxyl group, a sulfo group, an alkyl group, an aryl group and the like. $R_1$, $R_2$, $R_3$ and $R_4$ are preferably one of a hydrogen atom and an alkyl group.

As the anion represented by $X^-$, an organic or inorganic anion such as a halogen ion, a sulfate ion, a nitrate ion, an acetate ion, a p-toluenesulfonate ion and the like are described.

As a structure of formula (P), the structure described in paragraph Nos. 0153 to 0163 in JP-A No. 2002-131864 is still more preferable.

As the specific compounds of formula (P), P-1 to P-52 and T-1 to T-18 of chemical formula Nos. 53 to 62 in JP-A No. 2002-131864 can be described, however the specific compound is not limited in these.

The quaternary onium compound described above can be synthesized by referring to known methods. For example, the tetrazolium compound described above can be synthesized by referring to the method described in Chemical Reviews, vol. 55, pages 335 to 483.

Next, the compounds represented by formulae (A) and (B) are explained in detail. In formula (A), $Z_1$ represents a nonmetallic atomic group capable to form a 5 to 7 membered ring structure with —Y—C(═CH—$X_1$)—C(═O)—.

$Z_1$ preferably is an atomic group selected from a carbon atom, an oxygen atom, a sulfur atom, a nitrogen atom and a hydrogen atom, and several atoms selected from these are bound each other by single bond or double bond to form a 5 to 7 membered ring structure with —$Y_1$—C(═CH—$X_1$)—C(═O)—. $Z_1$ may have a substituent, and $Z_1$ itself may be an aromatic or a non-aromatic carbon ring, or $Z_1$ may be a part of an aromatic or a non-aromatic heterocycle, and in this case, a 5 to 7 membered ring structure formed by $Z_1$ with —$Y_1$—C(═CH—$X_1$)—C(═O)— forms a condensed ring structure.

In formula (B), $Z_2$ represents a nonmetallic atomic group capable to form a 5 to 7 membered ring structure with —$Y_2$—C(═CH—$X_2$)—C($Y_3$)═N—. $Z_2$ preferably is an atomic group selected from a carbon atom, an oxygen atom, a sulfur atom, a nitrogen atom and a hydrogen atom, and several atoms selected from these are linked each other by single bond or double bond to form a 5 to 7 membered ring structure with —$Y_2$—C(═CH—$X_2$)—C($Y_3$)═N—. $Z_2$ may have a substituent, and $Z_2$ itself may be an aromatic or a non-aromatic carbon ring, or $Z_2$ may be a part of an aromatic or a non-aromatic heterocycle and in this case, a 5 to 7 membered ring structure formed by $Z_2$ with —$Y_2$—C(═CH—$X_2$)—C($Y_3$)═N— forms a condensed ring structure.

In the case where $Z_1$ and $Z_2$ have a substituent, examples of substituent are selected from the compounds described below. Namely, as typical substituent, for example, a halogen atom (fluorine atom, chlorine atom, bromine atom or iodine atom), an alkyl group (includes an aralkyl group, a cycloalkyl group and an active methylene group), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group, an alkoxy group (includes the group in which an ethylene oxy group or a propylene oxy group unit are repeated), an aryloxy group, a heterocyclic oxy group, an acyloxy group, an alkoxy carbonyloxy group, an aryloxy carbonyloxy group, a carbamoyloxy group, a sulfonyloxy group, an amino group, an alkylamino group, an arylamino group, a heterocyclic amino group, a N-substituted nitrogen containing heterocyclic group, an acylamino group, a sulfonamido group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group, an alkylthio group, an arylthio group, a heterocyclic thio group, an alkylsulfonyl group, an arylsulfonyl group, a sulfo group or a salt thereof, a sulfamoyl group, an acylsulfamoyl group, a sulfonylsulfamoyl group or a salt thereof, a group containing phosphoric amido or phosphoric ester structure, a silyl group, a stannyl group and the like are described. These substituents may be further substituted by these substituents.

Next, $Y_3$ is explained. In formula (B), $Y_3$ represents one of a hydrogen atom and a substituent, and when $Y_3$ represents a substituent, following group is specifically described as that substituent. Namely, an alkyl group, an aryl group, a heterocyclic group, a cyano group, an acyl group, an alkoxycarbonyl group, an aryloxycarbonyl group, a carbamoyl group, an amino group, an alkylamino group, an arylamino group, a heterocyclic amino group, an acylamino group, a sulfonamido group, an ureido group, a thioureido group, an imido group, an alkoxy group, an aryloxy group, an alkylthio group, an arylthio group, a heterocyclic thio group and the like are described. These substituents may be substituted by any substituents, and specifically, examples of the substituents which $Z_1$ or $Z_2$ may have, are described.

In formulae (A) and (B), $X_1$ and $X_2$ each independently represent one selected from a hydroxy group (or a salt thereof), an alkoxy group (e.g., a methoxy group, an ethoxy group, a propoxy group, an isopropoxy group, an octyloxy group, a dodecyloxy group, a cetyloxy group, a t-buthoxy group and the like), an aryloxy group (e.g., a phenoxy group, a p-t-pentylphenoxy group, a p-t-octylphenoxy group and the like), a heterocyclic oxy group (e.g., a benzotriazolyl-5-oxy group, a pyridinyl-3-oxy group and the like), a mercapto group (or a salt thereof), an alkylthio group (e.g., methylthio group, an ethlythio group, a butylthio group, a dodecylthio group and the like), an arylthio group (e.g., a phenylthio group, a p-dodecylphenylthio group and the like), a heterocyclic thio group (e.g., a 1-phenyltetrazoyl-5-thio group, a 2-methyl-1-phenyltriazolyl-5-thio group, a mercaptothiadiazolylthio group and the like), an amino group, an alkylamino group (e.g., a methylamino group, a propylamino group, an octylamino group, a dimethylamino group and the like), an arylamino group (e.g., an anilino group, a naphthylamino group, an o-methoxyanilino group and the like), a heterocyclic amino group (e.g., a pyridylamino group, a benzotriazole-5-ylamino group and the like), an acylamino group (e.g., an acetamido group, an octanoylamino group, a benzoylamino group and the like), a sulfonamido group (e.g., a methanesulfonamido group, a benzenesulfonamido group a dodecylsulfonamido group and the like), and a heterocyclic group.

Herein, a heterocyclic group is an aromatic or non-aromatic, a saturated or unsaturated, a single ring or condensed ring, or a substituted or unsubstituted heterocyclic group. For example, a N-methylhydantoyl group, a N-phenylhydantoyl group, a succinimido group, a phthalimido group, a N,N'-dimethylurazolyl group, an imidazolyl group, a benzotriazolyl group, an indazolyl group, a morpholino group, a 4,4-dimethyl-2,5-dioxo-oxazolyl group and the like are described.

And herein, a salt represents a salt of an alkali metal (sodium, potassium and lithium) or a salt of an alkali earth metal (magnesium and calcium), a silver salt or a quaternary ammonium salt (a tetraethylammonium salt, a dimethylcetylbenzylammonium salt and the like), a quaternary phosphonium salt and the like. In formulae (A) and (B), $Y_1$ and $Y_2$ represent —C(═O)— or —$SO_2$—.

The preferable range of the compound represented by formulae (A) and (B) is described in JP-A No. 11-231459, paragraph Nos. 0027 to 0043. As specific examples of the compound represented by formulae (A) and (B), compound 1 to 110 of Table 1 to 8 in JP-A No. 11-231459 are described, however the invention is not limited in these.

Next, the compound represented by formula (C) is explained in detail. In formula (C), $X_1$ represents one selected from an oxygen atom, a sulfur atom, and a nitrogen atom. In the case where $X_1$ is a nitrogen atom, the bond of $X_1$ and $Z_1$ may be either a single bond or a double bond, and in the case of a single bond, a nitrogen atom may have a hydrogen atom or any substituent. As this substituent, for example, an alkyl group (includes an aralkyl group, a cycloalkyl group, an active methylene group and the like), an alkenyl group, an alkynyl group, an aryl group, a heterocyclic group, an acyl group, an alkoxycarbonyl group, an aryloxycarbonyl group, a carbamoyl group, an alkylsulfonyl group, an arylsulfonyl group, a heterocyclic sulfonyl group and the like are described. $Y_1$ represents the group represented by one selected from —C(═O)—, —C(═S)—, —SO—, —$SO_2$, —C(═$NR_3$)—, and —($R_4$)C═N—. $Z_1$ represents a nonmetallic atomic group capable to form a 5 to 7 membered ring containing $X_1$ and $Y_1$. The atomic group to form that ring is an atomic group which consists of 2 to 4 atoms that are other than metal atoms, and these atoms may be combined by single bond or double bond, and these may have a hydrogen atom or any subsituent (e.g., an alkyl group, an aryl group, a heterocyclic group, an alkoxy group, an alkylthio group, an acyl group, an amino group or an alkenyl group). When $Z_1$ forms a 5 to 7 membered ring containing $X_1$ and $Y_1$, the ring is a saturated or unsaturated heterocyclic ring, and may be a single ring or may have a condensed ring. When Y1 is the group represented by C(═$NR_3$), ($R_4$)C═N, the condensed ring of this case may be formed by binding $R_3$ or $R_4$ with the substituent of $Z_1$.

In formula (C), $R_1$, $R_2$, $R_3$ and $R_4$ each independently represent one of a hydrogen atom and a substituent. However, $R_1$ and $R_2$ never bind each other to form a ring structure.

When $R_1$ and $R_2$ represent a monovalent substituent, the following groups are described as a monovalent substituent.

For example, a halogen atom (fluorine atom, chlorine atom, bromine atom or iodine atom), an alkyl group (an aralkyl group, a cycloalkyl group, an active methylene group and the like), an alkenyl group, an alkynyl group, an aryl group, a heterocyclic group, a heterocyclic group containing a quaternary nitrogen (e.g., a pyridinio group), an acyl group, an alkoxycarbonyl group, an aryloxycarbonyl group, a carbamoyl group, a carboxy group and a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group and a salt thereof, an alkoxy group (includes the group in which an ethylene oxy group or a propylene oxy group unit are repeated), an aryloxy group, a heterocyclic oxy group, an acyloxy group, an alkoxy carbonyloxy group, an aryloxycarbonyloxy group, a carbamoyloxy group, a sulfonyloxy group, an amino group, an alkylamino group, an arylamino group, an heterocyclic amino group, a N-substituted nitrogen containing heterocyclic group, an acylamino group, a sulfonamido group, an ureido group, a thioureido group, an imido group, an alkoxycarbonylamino group, an aryloxycarbonylamino group, a sulfamoylamino group, a semicarbazide group, a thiosemicarbazide group, a hydrazino group, a quaternary ammonio group, an oxamoylamino group, an alkylsulfonylureido group, an arylsulfonylureido group, an acylureido group, an acylsulfamoylamino group, a nitro group, a mercapto group and a salt thereof, an alkylthio group, an arylthio group, an heterocyclic thio group, an alkylsulfonyl group, an arylsulfonyl group, an alkylsulfinyl group, an arylsulfinyl group, a sulfo group and a salt thereof, a sulfamoyl group, an acylsulfamoyl group, a sulfonylsulfamoyl group and a salt thereof, a phosphoryl group, a group containing phosphoric amido or phosphoric ester structure, a silyl group, a stannyl group and the like are described. These substituents may be further substituted by these monovalent substituents.

When $R_3$ and $R_4$ represent a substituent, the same substituent as what $R_1$ and $R_2$ may have except the halogen atom can be described as a substituent. Furthermore, $R_3$ and $R_4$ may further link to $Z_1$ to form a condensed ring.

Next, among the compounds represented by formula (C), preferable compounds are described. In formula (C), Z, preferably is an atomic group which forms a 5 to 7 membered ring with $X_1$ and $Y_1$, and consists of the atoms selected from 2 to 4 carbon atoms, a nitrogen atom, a sulfur atom and an oxygen atom. A heterocycle which $Z_1$ forms with $X_1$ and $Y_1$, preferably contains 3 to 40 carbon atoms in total, more preferably 3 to 25 carbon atoms in total, and most preferably 3 to 20 carbon atoms in total. $Z_1$ preferably comprises at least one carbon atom.

In formula (C), $Y_1$ is preferably one selected from —C(═O)—, —C(═S)—, —$SO_2$—, and —($R_4$)C═N—, particularly preferably one selected from —C(═O)—, —C(═S)—, and —$SO_2$—, and most preferably —C(═O)—.

In formula (C), in the case where $R_1$ and $R_2$ represent a monovalent substituent, the monovalent substituent represented by $R_1$ and $R_2$ preferably is one of the following groups having 0 to 25 carbon atoms in total, namely, those are an alkyl group, an aryl group, a heterocyclic group, an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an imido group, an acylamino group, a hydroxy group, a salt thereof, a mercapto group, a salt thereof, and an electron-attracting group. Herein, an electron-attracting group means the substituent capable to have a positive value of Hammett substituent constant up, and specifically a cyano group, a sulfamoyl group, an alkylsulfonyl group, an arylsulfonyl group, a sulfonamido group, an imino group, a nitro group, a halogen atom, an acyl group, a formyl group, a phosphoryl group, a carboxy group (or a salt thereof), a sulfo group (or a salt thereof), a saturated or unsaturated heterocyclic group, an alkenyl group, an alkynyl group, an acyloxy group, an acylthio group, a sulfonyloxy group or an aryl group substituted by these electron-attracting group are described. These substituents may have any substituents.

In formula (C), when $R_1$ and $R_2$ represent a monovalent substituent, more preferable are one selected from an alkoxy group, an aryloxy group, a heterocyclic oxy group, an alkylthio group, an arylthio group, a heterocyclic thio group, an amino group, an alkylamino group, an arylamino group, a heterocyclic amino group, an ureido group, an imido group, an acylamino group, a sulfonamido group, a heterocyclic group, a hydroxy group or a salt thereof, a mercapto group, a salt thereof, and the like. In formula (C), $R_1$ and $R_2$ particularly preferably are one selected from a hydrogen atom, an alkoxy group, an aryloxy group, an alkylthio group, an arylthio group, a heterocyclic group, a hydroxy group, a salt thereof, a mercapto group, a salt thereof, and the like. In formula (C), most preferably, one of $R_1$ and $R_2$ is a hydrogen atom and another is one selected from an alkoxy group, an aryloxy group, an alkylthio group, an arylthio group, a heterocyclic group, a hydroxy group, a salt thereof, a mercapto group, and a salt thereof.

In formula (C), when $R_3$ represents a substituent, $R_3$ is preferably one of the following groups having 1 to 25 carbon atoms in total, namely, those are an alkyl group (includes an aralkyl group, a cycloalkyl group, an active methylene group and the like), an alkenyl group, aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group, an amino group and the like. An alkyl group and an aryl group are particularly preferable.

In formula (C), when $R_4$ represents a substituent, $R_4$ is preferably one of the following groups having 1 to 25 carbon atoms in total, namely, those are alkyl group (includes an aralkyl group, a cycloalkyl group, an active methylene group and the like), an aryl group, a heterocyclic group, a heterocyclic group containing a quaternary nitrogen (e.g., a pyridinio group), an acyl group, an alkoxycarbonyl group, an aryloxycarbonyl group, a carbamoyl group, an alkylsulfonyl group, an arylsulfonyl group, an alkylsulfinyl group, an arylsulfinyl group, a sulfosulfamoyl group, an alkoxy group, an aryloxy group, a heterocyclic oxy group, an alkylthio group, an arylthio group, a heterocyclic thio group and the like. Particularly preferably, an alkyl group, an aryl group, an alkoxy group, an aryloxy group, a heterocyclic oxy group, an alkylthio group, an arylthio group, a heterocyclic thio group and the like are described. When $Y_1$ represents $C(R_4)=N$, the carbon atom in $Y_1$ binds with the carbon atom substituted by $X_1$ or $Y_1$.

Specific compounds represented by formula (C) are represented by A-1 to A-230 of chemical formula Nos. 6 to 18 described in JP-A No. 11-133546, however the invention is not limited in these.

The addition amount of the above nucleator is in the range of $10^{-5}$ mol to 1 mol per 1 mol of organic silver salt, and preferably, in a range of $10^{-4}$ mol to $5\times10^{-1}$ mol.

The nucleator described above may be incorporated into photothermographic material by being added into the coating solution, such as in the form of a solution, an emulsion dispersion, a solid fine particle dispersion, and the like.

As well known emulsion dispersing method, there can be mentioned a method comprising dissolving the nucleator in an oil such as dibutylphthalate, tricresylphosphate, dioctylsebacate, tri(2-ethylhexyl)phosphate and the like and an auxiliary solvent such as ethyl acetate and cyclohexanone, and then adding a surfactant such as sodium dodecylbenzenesulfonate, sodium oleil-N-methyltaurinate, sodium di(2-ethylhexyl)sulfosuccinate and the like; from which an emulsion dispersion is mechanically produced. During the process, for the purpose of controlling viscosity of oil droplet and refractive index, the addition of polymer such as α-methylstyrene oligomer, poly(t-butylacrylamide) or the like is preferable.

As solid particle dispersing method, there can be mentioned a method comprising dispersing the powder of the nucleator in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range of from 1 ppm to 1000 ppm. It is practically acceptable so long as Zr is incorporated in an amount of 0.5 mg or less per 1 g of silver.

Preferably, an antiseptic (for instance, sodium benzoisothiazolinone salt) is added in the water dispersion.

The nucleator is particularly preferably used as solid particle dispersion, and is added in the form of fine particles having average particle size from 0.01 μm to 10 μm, preferably from 0.05 μm to 5 μm and, more preferably from 0.1 μm to 2 μm.

In the photothermographic material which is subjected to a rapid development where time period for development is 20 seconds or less, the compound represented by formulae (SH) and (P) is used preferably, and the compound represented by formula (SH) is used particularly preferably, among the nucleators described above.

In the photothermographic material where low fog is required, the compound represented by formula (G), (A), (B), or (C) is used preferably, and the compound represented by formula (A), or (B) is particularly preferably used. Moreover, in the photothermographic materials having a few change of photographic property against environmental conditions when used on various environmental conditions (temperature and humidity), the compound represented by formula (C) is preferably used.

Although preferred specific compounds among the above-mentioned nucleators are shown below, the invention is not limited in these.

SH-1

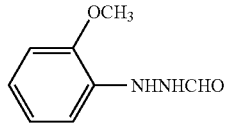

SH-2

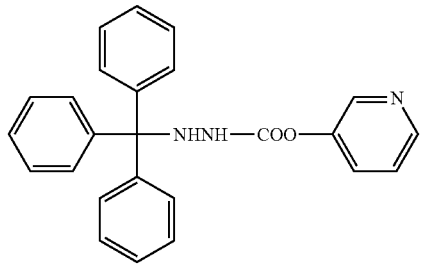

SH-3

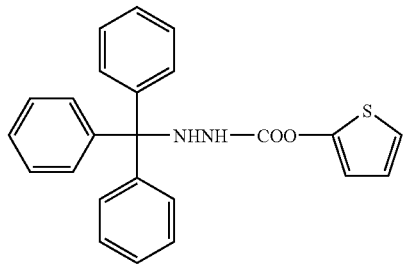

SH-4

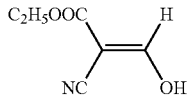

SH-5

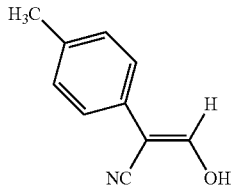

-continued

SH-6

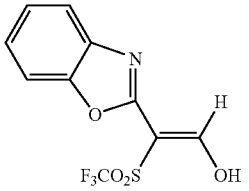

SH-7

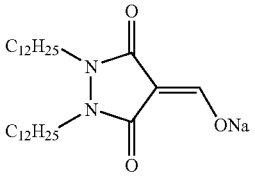

SH-8

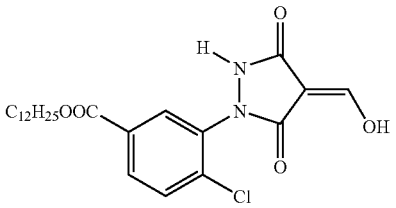

SH-9

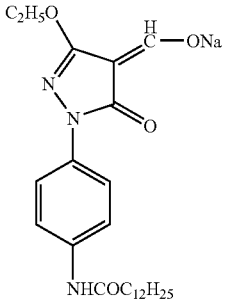

SH-10

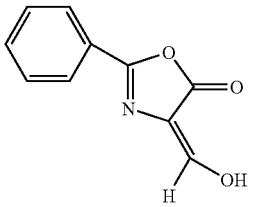

SH-11

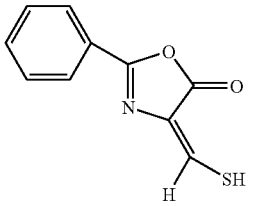

SH-12

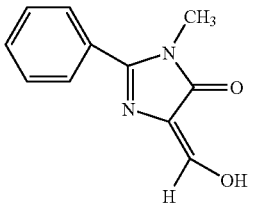

(Other Additives)

1) Mercapto Compounds, Disulfides and Thiones

In the invention, mercapto compounds, disulfide compounds, and thione compounds may be added in order to control the development by suppressing or enhancing development, to improve spectral sensitization efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP-A No. 0803764A1, in JP-A No. 2001-100358 and the like. Among them, mercapto-substituted heterocyclic aromatic compound is preferred.

2) Toner

In the photothermographic material of the present invention, the addition of a toner is preferred. The description of the toner can be found in JP-A No.10-62899 (paragraph Nos. 0054 to 0055), EP-A No.0803764A1 (page 21, lines 23 to 48), JP-A Nos.2000-356317 and 2000-187298. Preferred are phthalazinones (phthalazinone, phthalazinone derivatives and metal salts thereof, e.g., 4-(1-naphthyl)phthalazinone, 6-chlorophthalazinone, 5,7-dimethoxyphthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride); phthalazines (phthalazine, phthalazine derivatives and metal salts thereof, (e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well known plasticizer and lubricant can be used to improve physical properties of film. Particularly, to improve handling facility during manufacturing process or scratch resistance during thermal development, it is preferred to use a lubricant such as a liquid paraffin, a long chain fatty acid, an amide of fatty acid, an ester of fatty acid and the like. Paticularly preferred are a liquid paraffin obtained by removing components having low boiling point and a fatty acid ester having a branch structure and a molecular weight of 1000 or more.

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving image tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) may be used in the image forming layer of the invention. Detailed description can be found in WO No. 98/36322, JP-A Nos. 10-268465 and 11-338098, and the like.

5) Phosphoric Acid Compound

In the case of using a nucleator in the photothermographic material of the invention, it is preferred to use an acid resulting from hydration of diphosphorus pentaoxide, or a salt thereof. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or a salt thereof (i.e., the coating amount per 1 $m^2$ of the photothermographic material) may be set as desired depending on sensitivity and fog, but preferred is in the range of 0.1 $mg/m^2$ to 500 $mg/m^2$, and more preferably, 0.5 $mg/m^2$ to 100 $mg/m^2$.

The reducing agent, the hydrogen bonding compound, the development accelerator, and the organic polyhalogen compounds according to the invention are preferably used as solid dispersions, and the method of preparing the solid dispersion is described in JP-A No. 2002-55405.

In the case of using formic acid or formates as a strong fogging agent, it is preferably incorporated into the side having thereon the image forming layer containing photosensitive silver halide, in an amount of 5 mmol or less, preferably, 1 mmol or less per 1 mol of silver.

6) Preparation of Coating Solution and Coating

The temperature for preparing the coating solution for use in the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Other Constituents)

1) Surface Protective Layer

The photothermographic material of the invention may further comprise a surface protective layer with an object to prevent adhesion of the image forming layer. The surface protective layer may be a single layer, or plural layers. Description on the surface protective layer may be found in paragraph Nos. 0119 to 0120 of JP-A No. 11-65021, and in JP-A No. 2001-348546.

Preferred as the binder for the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like.

Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.).

The coating amount of polyvinyl alcohol (per 1 $m^2$ of support) in the protective layer (per one layer) is preferably in the range from 0.3 $g/m^2$ to 4.0 $g/m^2$, and more preferably, from 0.3 $g/m^2$ to 2.0 $g/m^2$.

The coating amount of the whole binder (including water-soluble polymer and latex polymer) in the surface protective layer (per one layer) is preferably 0.3 $g/m^2$ to 5.0 $g/m^2$, more preferably, 0.3 $g/m^2$ to 2.0 $g/m^2$ per 1 $m^2$ of a support.

2) Antihalation Layer

It is preferred that the photothermographic material of the present invention contains a dye having absorption at the exposure wavelength region in at least one layer of an image forming layer and a non-photosensitive layer to prevent a halation at the exposure. The said non-photosensitive layer is located in nearer side to a support than an image forming layer (may be an antihalation layer or an undercoat layer) or, in opposite side to an image forming layer toward a support.

In the case where the exposure wavelength is in an infrared region, an infrared dye may be used, and in the case where the exposure wavelength is in an ultraviolet region, an ultraviolet absorbing dye may be used, whereby both dyes preferably have no absorption in the visible region or have a little visible light absorption.

In the case where the exposure wavelength is present in the visible region, it is preferred to allow substantially no color of the dye to remain after the image formation and to use the decoloring method by heating at thermal development. In particular, the non-photosensitive layer is preferably rendered to function as a thermal bleaching antihalation layer by adding thereto a thermal bleaching dye and a base precursor. These techniques are described in JP-A No.11-231457 and the like.

In the case where the exposure source is a laser beam, it is enough that the antihalation layer has the absorption in the narrow wavelength region correspondent to the peak of the emission wavelength, therefore it is possible to be a lower coating amount of the dye and to produce photosensitive material with lower cost.

Shorter the emission peak wavelength of laser beam is, more fine definition image recording is possible. Therefore, the emission peak wavelength of laser beam is preferably 350 nm to 430 nm, and more preferably 380 nm to 420 nm from the practical point of view.

In the case where the laser beam as the exposure light source has the emission peak wavelength at 350 nm to 430 nm, it is preferred that the antihalation dye has the absorption maximum at the wavelength between 350 nm to 430 nm. Further, in the case where the emission peak wavelength of laser beam is present between 380 nm to 420 nm, it is preferred that the dye described above has the absorption maximum at the wavelength between 380 nm to 420 nm.

The layer comprising the dye having an absorption maximum at the wavelength between 350 nm to 430 nm preferably may be an image forming layer, a non-photosensitive layer (may be an antihalation layer) in the nearer side to the support than an image forming layer, or a non-photosensitive layer on the back surface which is disposed opposite to the image forming layer toward the support.

The kind of dye described above is not particularly limited as far as it has an absorption maximum between 350 nm to 430 nm. The absorption maximum measured between 350 nm to 430 nm may be either of a main absorption or a sub absorption. As specific examples of the dye having an absorption maximum between 350 nm to 430 nm, an azo dye, an azomethine dye, a quinone dye (e.g., an anthraquinone dye, a naphthoquinone dye and the like), a quinoline dye (e.g., a quinophthalone dye and the like), a methine dye (e.g., a cyanine dye, a merocyanine dye, an oxonol dye, a styryl dye, an arylidene dye, an aminobutadiene dye and the like and a polymethine dye is also contained), a carbonium dye (e.g., a cationic dye such as diphenylmethane dye, a triphenylmethane dye a xanthene dye, an acridine dye and the like), an azine dye (e.g., a cationic dye such as a thiazine dye, an oxazine dye, a phenazine dye and the like), an aza [18]π electron dye (e.g., a porphin dye, a tetrazaporphin dye, a phthalocyanine dye and the like), an indigoid dye (e.g., indigo, a thioindigo dye and the like), a squalenium dye, a croconium dye, a pyrromethene dye, a nitro-nitroso dye, a benzotriazole dye, a triazine dye and the like can be described. An azo dye, an azomethine dye, a quinone dye, a quinoline dye, a methine dye, an aza [18]π electron dye, an indigoid dye and a pyrromethene dye are preferable and an azo dye, an azomethine dye and a methine dye are more preferable and a methine dye are particularly preferable. These dyes may be present in a solid fine particle dispersing state or in an aggregating state (a liquid crystal state also contained), and two or more kinds of the dyes may be used in combination.

A dye having larger absorption at the exposure wavelength is preferably used as the antihalation dye because the coating amount of the dye can be reduced. Therefore, an antihalation dye preferably has a narrow half value width and a sharp absorption peak on an absorption spectrum. In another way, it is also preferred to use a dye under the condition wherein the dye shows such absorption. In order to the dye to have larger absorption and sharper absorption spectrum, it is preferred to be used under the dispersing state of solid fine particle or the aggregating state. A dye having an ionic hydrophilic group preferably is used for formation of an aggregating state. The half band width of the dye preferably is 100 nm or less, more preferably 75 nm or less and further preferably 50 nm or less.

The antihalation dye either may be decolored after the image forming or may not be decolored. In the case where the dye is not decolored (from now on, this is called non-bleaching dye), the dye preferably is not remarkable in visual and the ratio of the absorption at the exposure wavelength to the absorption at 425 nm, preferably is larger. For example, in the case, where the photographic material is exposed by a laser diode having a radiation at 405 nm, the ratio of an absorption at 405 nm to the absorption at 425 nm is preferably 5 or more, more preferably 10 or more and particularly preferably 15 or more.

As examples of these dyes, an aminobutadiene dye, the merocyanine dye in which an acidic nucleus and an alkaline nucleus directory connect with each other or a polymethine dye may be described. And in the case of non-bleaching dye, it can be added as aqueous solution if it might be water-soluble.

In another case, an antihalation dye preferably is decolored in thermal development process. As the decoloring method, following methods are known and any method thereof can be used.

- The decoloring method by the reaction of a coloring matter (dye), which contains an electron-donating color-forming organic compound and an acidic developer, and a specific decoloring agent at thermal development, described in such as JP-A Nos. 9-34077 and 2001-51371.
- The decoloring method by a combination of the the radical generating compound by light irradiation or heating and the bleaching dye, described in such as JP-A Nos. 9-133984,2000-29168, 2000-284403 and 2000-347341.
- The decoloring method by a combination of the said bleaching dye and a compound which can release an alkali or a nucleophile by heating, described in U.S. Pat. Nos. 5,135,842, 5,258,724, 5,314,795, 5,324,627, 5,384,237, JP-A Nos. 3-26765, 6-222504, 6-222505 and 7-36145.
- The decoloring method of dye through an intra-molecular ring closure reaction by thermal self-decomposition of the dye, described in U.S. Pat. No. 4,894,358, JP-A Nos. 2-289856 and 59-182436.
- The decoloring method of the dye by the combination of the intra-molecular ring closure bleaching dye having an excellent decoloring property and a base or a base precursor, described in JP-A Nos.6-82948, 11-231457 and 2000-112058, 2000-281923, 2000-169248.

Among them, the combination of the decoloring agent (a radical generator, a base precursor, a nucleophile generator) and the bleaching dye is preferable, because it is easy to be consistent with the decoloring property at thermal development and the stock stability at non-development. Particularly, the combination of the intra-molecular ring closure bleaching dye and a base precursor is more preferably, because it can be consistent with the decoloring property and the stability.

The intra-molecular ring closure bleaching dye is preferably a dye having a polymethine chromophore, and more preferably a polymethine dye having a group which can generate a nucleophilic group at the position where a 5 to 7 ring can be formed by the reaction at the polymethine part by the reaction of base.

The polymethine dye having a group which can become the nucleophilic group by dissociation at the position capable of a 5 to 7 ring formation is most preferable, such as represented by the following formulae (1) and (2).

Particularly, the dye represented by the following formulae (1) or (2) is preferably used.

Formula (1)

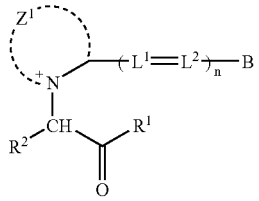

Formula (2)

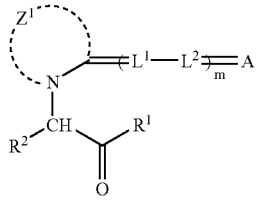

In formulae (1) and (2), $R^1$ represents one selected from a hydrogen atom, an aliphatic group, an aromatic group, $—NR^{21}R^{26}$, $—OR^{21}$ and $—SR^{21}$. $R^{21}$ and $R^{26}$ each independently represent one selected from a hydrogen atom, an aliphatic group, and an aromatic group, or $R^{21}$ and $R^{26}$ may bind each other to form a nitrogen-containing heterocycle. $R^2$ represents one selected from a hydrogen atom, an aliphatic group, and an aromatic group, or $R^1$ and $R^2$ may bind each other to form a 5 or 6 membered ring. $L^1$ and $L^2$ each independently represent a substituted or unsubstituted methine group, wherein the substituents of methine group may bind each other to form an unsaturated alicycle, or an unsaturated heterocycle. $Z^1$ represents the atomic group necessary to form a 5 or 6 membered nitrogen-containing heterocycle, wherein the nitrogen-containing heterocycle may condense with an aromatic ring, and the nitrogen-containing heterocycle and the condensed ring may have a substituent. A represents an acidic nucleus and B represents one selected from an aromatic group, an unsubstituted heterocyclic group, and a group represented by the following formula (3). n and m each represent an integer of 1 to 3. When n and m each represents 2 or more, $L^1$ and $L^2$ of 2 or more may be the same or different.

Formula (3)

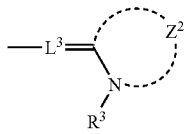

In formula (3), $L^3$ represents a substituted or unsubstituted methine group and may bind with $L^2$ to form an unsaturated alicycle or an unsaturated heterocycle. $R^3$ represents one of an aliphatic group and an aromatic group. $Z^2$ represents an atomic group necessary to form a 5 or 6 membered nitrogen-containing heterocycle, wherein the nitrogen-containing heterocycle may condense with an aromatic ring, and the nitrogen-containing heterocycle and the condensed ring may have a substituent.

In the formula described above, $R^1$ represents one selected from a hydrogen atom, an aliphatic group, an aromatic group, —$NR^{21}R^{26}$, —$OR^{21}$ and —$SR^{21}$. $R^{21}$ and $R^{26}$ each independently represent one selected from a hydrogen atom, an aliphatic group, and an aromatic group, or $R^{21}$ and $R^{26}$ may bind each other to form a nitrogen-containing heterocycle.

$R^1$ preferably represents one of —$NR^{21}R^{26}$, —$OR^{21}$, and —$SR^{21}$. $R^{21}$ preferably represents one of an aliphatic group and an aromatic group, and more preferably one selected from an unsubstituted alkyl group, a substituted alkyl group, an unsubstituted aralkyl group, a substituted aralkyl group, an unsubstituted aryl group, and a substituted aryl group. $R^{26}$ preferably represents one of a hydrogen atom and an aliphatic group, and more preferably one selected from a hydrogen atom, an unsubstituted alkyl group, and a substituted alkyl group. The nitrogen-containing heterocycle formed by binding with $R^{21}$ and $R^{26}$ preferably is a 5 or 6 membered ring. The nitrogen-containing heterocycle may have a heteroatom other than nitrogen atom (e.g., an oxygen atom, a sulfur atom).

In the specification of the present invention, "an aliphatic group" means an unsubstituted alkyl group, a substituted alkyl group, an unsubstituted alkenyl group, a substituted alkenyl group, an unsubstituted alkynyl group, a substituted alkynyl group, an unsubstituted aralkyl group, and a substituted aralkyl group. In the present invention, an unsubstituted alkyl group, a substituted alkyl group, an unsubstituted alkenyl group, a substituted alkenyl group, an unsubstituted aralkyl group and a substituted aralkyl group are preferable, and an unsubstituted alkyl group, a substituted alkyl group, an unsubstituted aralkyl group and a substituted aralkyl group are more preferable. Further, a chain aliphatic group is more preferable than an alicyclic group. A chain aliphatic group may be branched. An unsubstituted alkyl group has preferably 1 to 30 carbon atoms, more preferably 1 to 15 carbon atoms, still more preferably 1 to 10 carbon atoms, and most preferably 1 to 8 carbon atoms. An alkyl part of a substituted alkyl group is similar to that in the preferred range of an unsubstituted alkyl group.

An unsubstituted and a substituted alkenyl group have preferably 2 to 30 carbon atoms, more preferably 2 to 15 carbon atoms, still more preferably 2 to 12 carbon atoms, and most preferably 2 to 8 carbon atoms. An alkenyl part of a substituted alkenyl group and an alkynyl part of a substituted alkynyl group are similar to that in the each preferred range of an unsubstituted alkenyl group and an unsubstituted alkynyl group respectively. An unsubstituted aralkyl group has preferably 7 to 35 carbon atoms, more preferably 7 to 20 carbon atoms, still more preferably 7 to 15 carbon atoms and most preferably 7 to 10 carbon atoms. The aralkyl part of a substituted aralkyl group is similar to that in the preferred range of an unsubstituted aralkyl group.

Examples of a substituent of an aliphatic group (a substituted alkyl group, a substituted alkenyl group, a substituted alkynyl group and a substituted aralkyl group) include a halogen atom (fluorine atom, chlorine atom and bromine atom), a hydroxy group, an alkoxy group, an aryloxy group, a silyloxy group, an oxy group substituted at a hetero ring, an acyloxy group, a carbamoyloxy group, an alkoxycarbonyloxy group, an aryloxycarbonyloxy group, a nitro group, a sulfo group, a carboxyl group, an acyl group, an alkoxycarbonyl group, an aryloxycarbonyl group, a carbamoyl group, an alkylthiocarbonyl group, a hetero ring group, a cyano group, an amino group (an anilino group is included), an acylamino group, an aminocarbonylamino group, an alkoxycarbonylamino group, an aryloxycarbonylamino group, a sulfamoylamino group, an alkyl and arylsulfonylamino group, a mercapto group, an alkylthio group, an arylthio group, a mercapto group attached to a hetero ring, a sulfamoyl group, an alkyl and arylsulfinyl group, an alkyl and arylsulfonyl group an alkoxycarbonyl group, an imido group, a phosphino group, a phosphinyl group, a phosphinyloxy group a phosphinylamino group, a phosphono group and a silyl group. A carboxyl group, a sulfo group and a phosphono group may be the corresponding salt states. The cation, which forms a salt with a carboxyl group, a phosphono group and a sulfo group, preferably is an ammonium ion and an alkali metal ion (e.g., lithium ion, sodium ion and potassium ion).

In the specification of the present invention, "an aromatic group" means an unsubstituted aryl group or a substituted aryl group. An unsubstituted aryl group preferably has 6 to 30 carbon atoms, more preferably 6 to 20 carbon atoms, still more preferably 6 to 15 carbon atoms, and most preferably 6 to 12 carbon atoms. The aryl part of a substituted aryl group is similar to that in the preferred range of an unsubstituted aryl group. As examples of a substituent of an aromatic group (a substituted aryl group), the examples in an aliphatic group and the examples in the substituent of an aliphatic group can be described.

In formulae (1) and (2) described above, $R^2$ represents one selected from a hydrogen atom, an aliphatic group, and an aromatic group, wherein $R^1$ and $R^2$ may bind each other to form a 5 or 6 membered ring. The definition of an aliphatic group and an aromatic group is the same as that described above. $R^2$ preferably represents one selected from a hydrogen atom and an aliphatic group, and more preferably one of a hydrogen atom and an alkyl group, and still more preferably one of a hydrogen atom and an alkyl group having 1 to 15 carbon atoms, and most preferably a hydrogen atom.

In formulae (1), (2) and (3) described above, $L^1$, $L^2$ and $L^3$ each independently represent a methine group which may be substituted. The substituents of methine group may bind each other to form an unsubstituted aliphatic ring or an unsubstituted heterocycle. Examples of a methine group include a halogen atom, an aliphatic group, and an aromatic group. The definition of an aliphatic group and an aromatic group is the same as that described above. The substituents of methine group may bind each other to form an unsaturated aliphatic ring or an unsaturated heterocycle. An unsaturated aliphatic ring is more preferable than an unsaturated heterocycle. The formed ring is preferably a 5 or 6 membered ring, more preferably a cyclopentene ring or a cyclohexene ring. It is particularly preferred that the methine group is unsubstituted or substituted by an alkyl group or an aryl group at the meso position.

In formula (1) described above, n represents an integer from 1 to 3, and preferably 1 or 2. When n is 2 or more, the repeated methine group may be the same or different. In formula (2) described above, m represents an integer from 1 to 3 and preferably 1 or 2. When m is 2 or more, the repeated methine group may be the same or different.

In formulae (1) and (2) described above, $Z^1$ represents the atomic group necessary to form a 5 or 6 membered nitrogen-containing heterocycle and may condense with an aromatic ring, wherein the nitrogen-containing heterocycle and the condensed ring may have a substituent. As the examples of the nitrogen-containing heterocycle, an oxazole ring, a thiazole ring, a selenazole ring, a pyrrole ring, a pyrroline ring, an imidazole ring and a pyridine ring are included. A 5 membered ring is more preferable than a 6 membered ring. The nitrogen-containing heterocycle may condense with an aromatic ring (benzene ring and naphthalene ring). The nitrogen-containing heterocycle and the condensed ring may have a substituent. As the examples of the substituent, the substituent of the aromatic group described above can be described and a halogen atom (fluorine atom, chlorine atom and bromine atom), a hydroxy group, a nitro group, a carboxyl group, a sulfo group, an alkoxy group, an aryl group and an alkyl group are preferable. A carboxyl group and a sulfo group may be a salt state. As the cation which forms a salt with a carboxyl group and a sulfo group, an ammonium ion and an alkali metal ion (e.g., sodium ion and potassium ion) are preferable.

In formula (1), B represents one selected from an aromatic group, an unsaturated heterocyclic group, and formula (3) described above. The definition of an aromatic group is the same as that described above. As the aromatic group represented by B, a substituted or an unsubstituted phenyl group is preferable. As the substituent, a halogen atom, an amino group, an acylamino group, an alkoxy group, an aryloxy group, an alkyl group, an alkylthio group and an aryl group are preferable, and an amino group, an acylamino group, an alkoxy group and an alkyl group at the 4 position are particularly preferable. As the unsaturated heterocyclic group represented by B, a 5 or 6 membered heterocyclic group composed of carbon atom, oxygen atom, nitrogen atom and sulfer atom is preferable. Among them, a 5 membered ring is particularly preferable. As the preferred examples, a substituted or unsabstituted pyrrole, indole, thiophene and furan can be described.

In formula (3) described above, $Z^2$ represents the atomic group necessary to form a 5 or 6 membered nitrogen-containing heterocycle and may be the same as $Z^1$ or different. The examples of the nitrogen-containing heterocycle described above can be demonstrated similar examples described in the case of $Z^1$. In formula (3) described above, $R^3$ represents an aliphatic group or an aromatic group, and an aliphatic group is preferable, and $—CHR^2(COR^1)$ that is the substituent on a nitrogen atom of formula (1) described above is most preferable.

In formula (2) described above, A represents an acidic nucleus. The acidic nucleus preferably is a group in which one or more (usually two) hydrogen atoms are removed from a cyclic ketomethylene compound or a compound having a methylene group put between two electron-attracting groups. As the examples of cyclic ketomethylene compound, a 2-pyrazoline-5-one, a rhodanine, a hydantoin, a thiohydantoin, an 2,4-oxazolidinedione, an isoxazolone, a barbituric acid, a thiobarbituric acid, an indanedione, a dioxopyrazolopyridine, a Meldrum's acid, a hydroxypyridine, a pyrazolidinedione, a 2,6-dihydrofuran-2-one and a pyrroline-2-one can be described. These may have a substituent.

The compounds having a methylene group put between the electron-attracting groups described above can be represented as $Z^aCH_2Z^b$. $Z^a$ and $Z^b$ each independently represents one selected from —CN, $—SO_2R^{a1}$, $COR^{a1}$, $—COOR^{a2}$, $—CONHR^{a2}$, $—SO_2NHR^{a2}$, $—C[=C(CN)_2]R^{a1}$, and $—C[=C(CN)_2]NHR^{a1}$. $R^{a1}$ represents one selected from an alkyl group, an aryl group, and a heterocyclic group. $R^{a2}$ represents one selected from a hydrogen atom, an alkyl group, an aryl group, and a heterocyclic group. $R^{a1}$ and $R^{a2}$ each may have a substituent. Among these acidic nuclei, a 2-pyrazoline-5-one, an isoxazolone, a barbituric acid, an indanedione, a hydroxypyridine, a pyrazolidinedione and a dioxopyrazolopyridine are more preferable.

The dye represented by formula (1) preferably forms a salt with an anion. In the case, wherein the dye represented by formula (1) described above has an anionic group such as a carboxyl group and a sulfo group as a substituent, the dye can form an intra-moleculer salt. In the other case besides this, the dye preferably forms a salt with an anion outside of a molecule. An anion is preferably monovalent or divalent, and more preferably monovalent. As the examples of anion, a halogen ion ($Cl^-$, $Br^-$, $I^-$), a p-toluene sulfonate ion, an ethyl sulfonate ion, a 1,5-disulfonaphthalene dianion, $PF_6^-$, $BF_4^-$, and $ClO_4^-$ can be included.

The dye represented by formulae (1) and (2) described above may be used under a molecular dispersing state, but preferably under a solid fine particle dispersing state or an aggregating state. In order to form the aggregating state of the dye described above, the dye preferably has an ionic hydrophilic group. The ionic hydrophilic group contains a sulfo group, a carboxyl group, a phosphono group a quaternary ammonium group and the like, and preferably a carboxyl group, a phosphono group and a sulfo group, and more preferably a carboxyl group and a sulfo group. A carboxyl group, a phosphono group and a sulfo group may be a salt state and as the examples of counter ion to form a salt, an ammonium ion, an alkali metal ion (e.g., lithium ion, sodium ion and potassium ion) and an organic cation (e.g., tetramethylammonium ion, tetramethylguanidium ion and tetramethylphosphonium ion) are included.

Next, the formula of an amino butadiene dye and a merocyanine dye as a non-bleaching dye for antihalation can be shown below.

Formula (4)

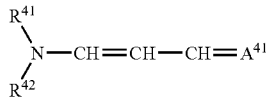

In the formula, $R^{43}$ and $R^{42}$ each independently represent one selected from a hydrogen atom, an aliphatic group, an aromatic group, and a non-metal atomic group necessary to form a 5 or 6 membered ring. And either one of $R^{41}$ and $R^{42}$ may bind with a methine group adjacent to a nitrogen atom to form a 5 or 6 membered ring. $A^{41}$ represents an acidic nucleus.

Formula (5)

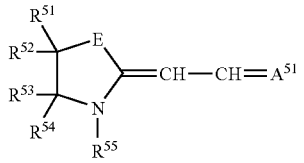

In the formula, $R^{51}$ to $R^{55}$ each independently represent one selected from a hydrogen atom, an aliphatic group, and an aromatic group, and $R^{51}$ and $R^{54}$ may join together to form a double bond. When $R^{51}$ and $R^{54}$ join together to form a double bond, $R^{52}$ and $R^{53}$ may link together to form a benzene ring or a naphthalene ring. $R^{55}$ represents one of an aliphatic group and an aromatic group, and E represents one selected from an oxygen atom, a sulfur atom, an ethylene group, >N—$R^{56}$, and >C($R^{57}$)($R^{58}$). $R^{56}$ represents one of an aliphatic group and an aromatic group, and $R^{57}$ and $R^{58}$ each independently represent one of a hydrogen atom and an aliphatic group. $A^{51}$ represents an acidic nucleus.

Formula (6)

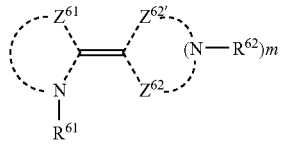

In the formula, $R^{61}$ represents one selected from a hydrogen atom, an aliphatic group, and an aromatic group. $R^{62}$ represents one selected from a hydrogen atom, an aliphatic group, and an aromatic group. $Z^{61}$ represents an atomic group necessary to form a nitrogen-containing heterocycle. $Z^{62}$ and $Z^{62'}$ represent an atomic group necessary to form a heterocycle or a noncyclic terminal acidic group by joining with (N—$R^{62}$)m. However, $Z^{61}$, $Z^{62}$ and $Z^{62'}$ each may condense to form a ring. m represents 0 or 1.

Following, dyes represented by formulae (4), (5), and (6) are described in detail.

For an aliphatic group and an aromatic group of $R^{41}$, $R^{42}$, $R^{51}$ to $R^{58}$, $R^{61}$ and $R^{62}$ in formulae (4), (5) and (6), similar aliphatic group and aromatic group to those described in $R^1$ can be applied. The examples of subsutituent also are similar to those ones.

For an acidic nucleus represented by $A^{41}$ and $A^{51}$, similar one as those described in A of formula (2) can be applied, and preferably applied a group in which one or more (usually two) hydrogen atoms are removed from a ketomethylene compound or a compound having a methylene group put between two electron-attracting groups. As more preferable examples of methylene compound, $Z^aCH_2Z^b$ (the same definition described in A of formula (2)), a 2-pyrazoline-5-one, an isoxazolone, a barbituric acid, an indanedione, a Meldrum's acid, a hydroxypyridine, a pyrazolidinedione, a dioxopyrazolopyridine and the like can be described. These may have a substituent.

As a 5 or 6 membered ring formed by linking with $R^{41}$ and $R^{42}$, a pyrrolidine ring, a pyperidine ring a morphorine ring and the like can be described as preferred examples.

In formula (6) described above, $Z^{61}$ is an atomic group necessary to form a 5 or 6 membered nitrogen-containing heterocycle, wherein the nitrogen-containing heterocycle may condense with an aromatic ring. The nitrogen-containing heterocycle and the condensed ring may have a substituent. As the examples of the nitrogen-containing heterocycle described above, a thiazoline nucleus, a thiazole nucleus, a benzothiazole nucleus, an oxazoline nucleus, an oxazolole nucleus, a benzoxazole nucleus, a selenazoline nucleus, a selenazole nucleus, a benzoselenazole nucleus, a tellurazoline nucleus, a tellurazole nucleus, a benzotellurazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, a pyrimidine nucleus and the like can be described. Among them, a thiazoline nucleus, a thiazole nucleus, a benzothiazole nucleus, an oxazoline nucleus, an oxazole nucleus, a benzoxazole nucleus, 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus and a 3-isoquinoline nucleus are preferable. A thiazoline nucleus, a thiazole nucleus, a benzothiazole nucleus, an oxazoline nucleus, an oxazole nucleus, a benzoxazole nucleus, 3,3-dialkylindolenine nucleus (e.g., 3,3-dimethylindolenine), an imidazoline nucleus, an imidazole nucleus and a benzimidazole nucleus are more preferable. A thiazoline nucleus, a thiazole nucleus, a benzothiazole nucleus, an oxazoline nucleus, an oxazole nucleus and a benzoxazole nucleus are particularly preferable. And a thiazoline nucleus, an oxazoline nucleus and a benzoxazole nucleus are most preferable. The nitrogen-containing heterocycle may condense with an aromatic ring (benzene ring and naphthalene ring). The nitrogen-containing heterocycle and the condensed ring may have a substituent. As the examples of the substituent, a substituent of the aromatic group described above can be described, and preferably described are a halogen atom (fluorine atom, chlorine atom and bromine atom), a hydroxy group, a nitro group, a carboxyl group, a sulfo group, an alkoxy group, an aryl group and an alkyl group. A carboxyl group and a sulfo group may be a salt state. As the cation which forms a salt with a carboxyl group and a sulfo group, an ammonium ion and an alkali metal ion (e.g., sodium ion and potassium ion) are preferable.

$Z^{62}$ and $Z^{62'}$ and (N—$R^{62}$)m represent an atomic group necessary to form a heterocycle and a noncyclic acidic terminal group by joining each other. As a heterocycle (preferably a 5 or 6 membered heterocycle), any heterocycle can be applied, and preferably, an acidic nucleus can be applied.

Next, an acidic nucleus and a noncyclic acidic terminal group are explained. As an acidic nucleus and a noncyclic acidic terminal group, any acidic nucleus in merocyanine dye and any noncyclic acidic terminal group can be applied. In the preferable form, $Z^{62}$ is a thiocarbonyl group, a carbonyl group, an ester group, an acyl group, a carbamoyl group, a cyano group, or a sulfonyl group, and $Z^{62}$ is more preferably a thiocarbonyl group or a carbonyl group. $Z^{62}$ represents a residual atomic group necessary to form an acidic nucleus and a noncyclic acidic terminal group. In the case where a noncyclic acidic terminal group is formed, a thiocarbonyl group, a carbonyl group, an ester group, an acyl group, a carbamoyl group, a cyano group, a sulfonyl group and the like are preferable.

m represents 0 or 1 and preferably 1.

The acidic nucleus and the noncyclic acidic terminal group herein are described in, for example, T. H. James, "THE THEORY OF THE PHOTOGRAPHIC PROCESS, FOURTH EDITION" (Macmillan Publishing Co., Inc., pages 197 to 200, 1977). Herein, the noncyclic acidic terminal group means a group not to form a ring among an acidic terminal group that is to say an electron accepting terminal group.

Typical examples of an acidic nucleus and a noncyclic acidic terminal group are described in U.S. Pat. Nos. 3,567,719, 3,575,869, 3,804,634, 3,837,862, 4,002,480, and 4,925,777, JP-A No. 3-167546, U.S. Pat. Nos. 5,994,051 and 5747236 and the like.

The acidic nucleus preferably is a heterocycle (preferably, a 5 or 6 membered nitrogen-containing heterocycle) comprising a carbon atom, a nitrogen atom and/or chalcogen atom (typically, an oxygen atom, a sulfur atom, a selenium atom and a tellurium atom), and more preferably a 5 or 6 membered nitrogen-containing heterocycle comprising a carbon atom, a nitrogen atom and/or chalcogen atom (typically, an oxygen atom, a sulfur atom, a selenium atom and a tellurium atom). As typical examples, the nucleus of 2-pyrazoline-5-one, pyrazolidine-3,5-dione, imidazoline-5-one, hydantoin, 2- or 4-thiohydantoin, 2-iminoxazolidine-4-one, 2-oxazoline-5-one, 2-thioxazolidine-2,5-dione, 2-thioxazoline-2,4-dione, isoxazolidine-5-one, 2-thiazoline-4-one, thiazolidine-4-one, thiazolidine-2,4,-dione, rhodanine, thiazolidine-2,4-dithione, isorhodanine, indane-1,3-dione, thiophene-3-one, thiophene-3-one-1,1-dioxide, indoline-2-one, indoline-3-one, 2-oxoindazolinium, 3-oxoindazolinium, 5,7-dioxo-6,7-dihydrothiazolo[3,2-a]-pyrimidine, cyclohexane-1,3-dione, 3,4-dihydroisoquinoline-4-one, 1,3-dioxane-4,6-dione, barbituric acid, 2-thiobarbituric acid, chromane-2,4-dione, indazoline-2-one, pyrido[1,2-a]pyrimidine-1,2-dione, pyrazolo[1,5-b]quinazolone, pyrazolo[1,5-a]benzimidazole, pyrazolopyrydone, 1,2,3,4-tetrahydroquinoline-2,4-dione, 3-oxo-2,3-dihydrobenzo[d]thiophene-1,1-dioxide, 3-dicyanomethine-2,3-dihydrobenzo[d]thiophene-1,1-dioxide, a nucleus having an exo-methylene structure formed by substitution of the carbonyl group or a thiocarbonyl group in the nuclei above described at an active methylene position of acidic nucleus, a nucleus having an exo-methylene structure formed by substitution at an active methylene position of active methylene compound having a ketomethylene or a cyanomethylene structure which can be a starting material of noncyclic acidic terminal group and a nucleus having a repeating structure of these nuclei can be described.

An acidic nucleus and a noncyclic acidic terminal group described above may be substituted by a substutuent described above as an example of the substituent in an aromatic group and the ring may be condensed.

As $Z^{62}$, $Z^{62'}$ and $(N—R^{62})m$, hydantoin, 2- or 4-thiohydantoin, 2-oxazoline-5-one, 2-thioxazoline-2,4-dione, thiazolidine-2,4,-dione, rhodanine, thiazolidine-2,4-dithione, barbituric acid and 2-thiobarbituric acid are preferable, and hydantoin, 2- or 4-thiohydantoin, 2-oxazoline-5-one, rhodanine, barbituric acid and 2-thiobarbituric acid are more preferable. Among them, 2- or 4-thiohydantoin, 2-oxazoline-5-one and rhodanine are especially preferable.

In the case where a dye represented by formulae (4) to (6) described above is water-soluble, it is preferred that the dye has an ionic hydrophilic group. The examples and the preferred examples of ionic hydrophilic group are similar to those described in formulae (1) and (2).

As typical examples of antihalation dye for preferred use, those described in JP-A No. 2003-215751 as well as the examples shown below can be described, but the antihalation dyes are not limited to the following typical examples.

1

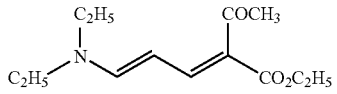

2

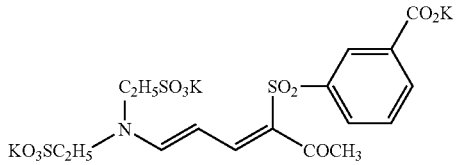

3

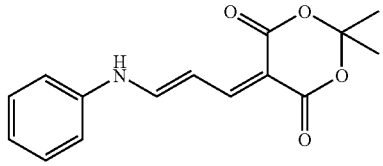

4

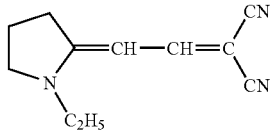

5

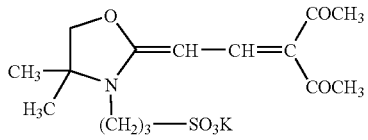

6

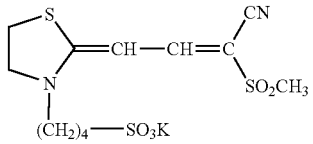

7

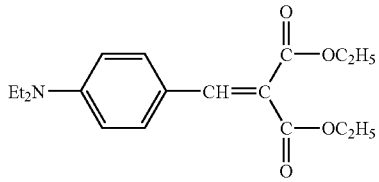

8

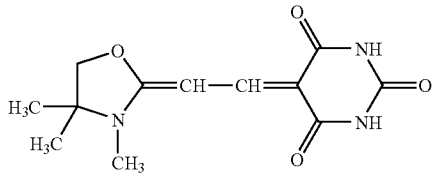

9

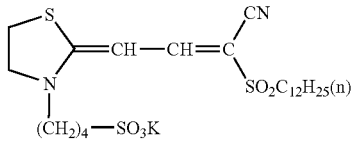

10

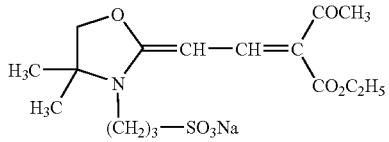

-continued
11
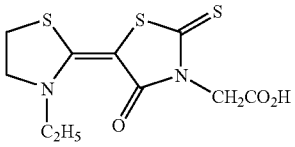
12
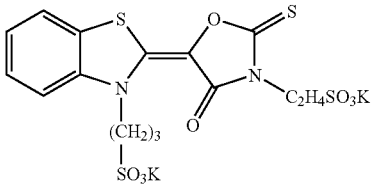
13
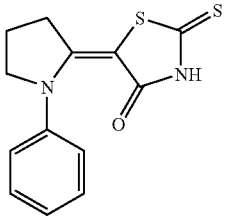
14
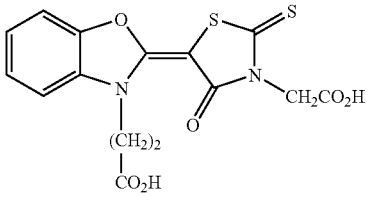
15
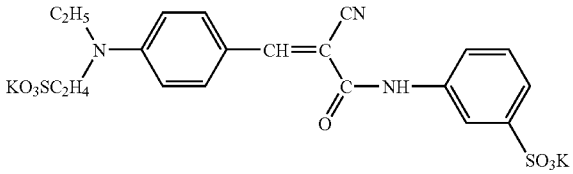
16
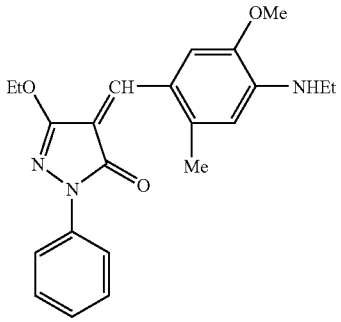
17
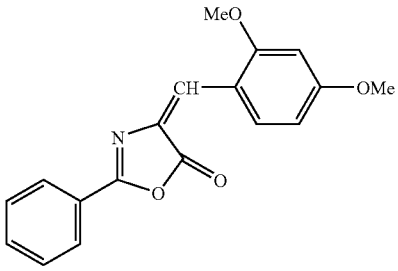
-continued
18
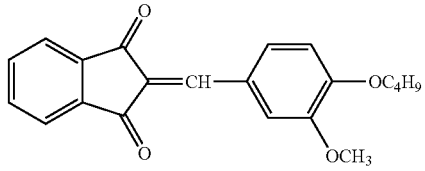
19
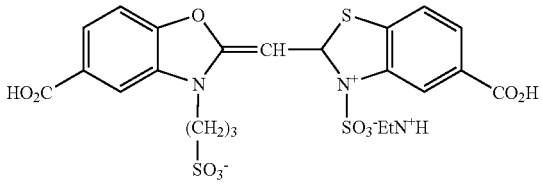
20
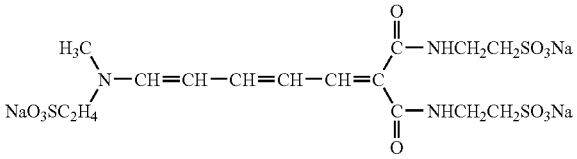
21
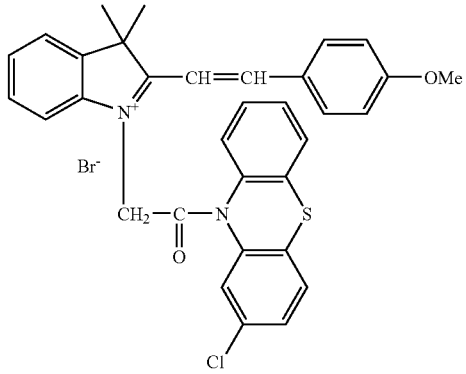
22
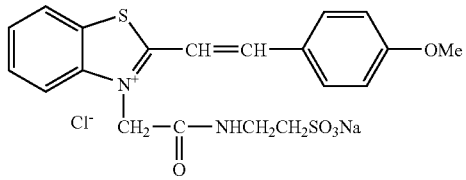
23
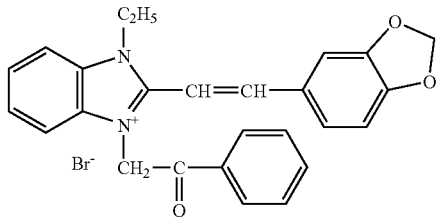
24
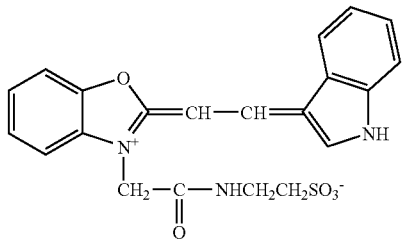

-continued

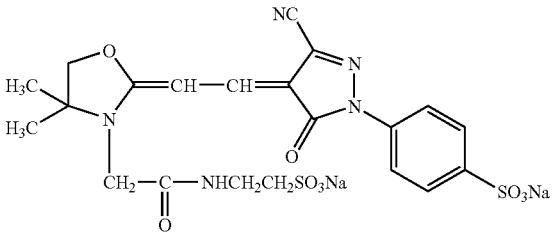

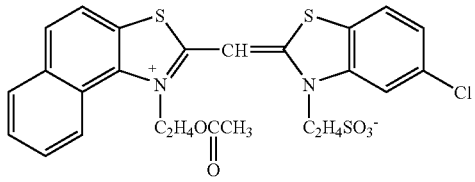

As the synthesis of antihalation dye, the general synthesis is described in Frances Harmer, "The Cyanine Dyes and Related Compounds", Interscience Publishers, 1964. Specifically, the synthesis can be performed by the method based on the method described in JP-A Nos. 11-231457, 2000-112058, 2000-86927 and 2000-86928.

In the case to decolorize an antihalation dye at the thermal developing process, decoloring can be made by an action of a decoloring agent under the heating condition. Particularly, the dye represented by formulae (1) and (2) described above is decolored by an action of a base, wherein the base causes a deprotonation from an active methylene group and the resulting nucleophile attacks to the methylene chain in a molecule and then the intra-molecular ring closure is occurred and finally the dye is decolorized. Therefore, as the base usable for this reaction, any base can be used as far as it can cause the deprotonation of active methylene group in the dye. Though the ring number newly formed by an intra-molecular ring closure reaction is not especially limited, a 5 to 7 membered ring is preferable, and a 5 or 7 membered ring is more preferable. The actually colorless compound formed in this way is stable compound and does not return to the original dye. And there is no coloring problem caused by returning of the decolored dye back to the original dye.

A heating temperature in the decoloring reaction of above described dye is preferably 40° C. to 200° C., more preferably 80° C. to 150° C., further more preferably 100° C. to 130° C., and most preferably 115° C. to 125° C. The time period for heating is preferably 5 seconds to 120 seconds, more preferably 10 seconds to 60 seconds, further more preferably 12 seconds to 30 seconds, and most preferably is 14 seconds to 25 seconds. In the photothermographic material, the heating for thermal development can be used for decolorizing of dye.

A heat response type base precursor, which generates a base by heating (described after in detail), is preferably used. In this case, the actual temperature and time period for heating are determined under the consideration of the temperature or the time necessary for thermal development and the temperature and the time necessary for the thermal decomposition.

The decoloring agent necessary for decoloring reaction is preferably a radical, a nucleophile, a base or a precursor thereof. In the case where a dye represented by formulae (1) or (2) described above is used, it is preferred to decolor the dye by using a base or a base precursor. A base necessary for decoloring reaction means a base in a wide sense and contains a nucleophile (Lewis base) in addition to a base in a narrow sense. When a base and a dye coexist, there is a fear of the decoloring reaction progressing a little, even if under the room temperature. Therefore, a base is preferably isolated from a dye physically or chemically, and the isolation is released at the time to be decolorized, for example by heating, resulting in contact (reaction) of the dye and the base. There are three physical isolation method of both compounds: namely to make at least one of the base and the dye described above enclose in a microcapsule; to make at least one of the base and the dye described above enclose in a fine particle of a thermal melting compound; or to make the dye described and the base described above contain in a different layer each other. One type of the microcapule described above is exploded by pressure and another is exploded by heating. It is convenient to use the thermal explosion type (heat response type) of microcapsule, as the decoloring reaction described above progresses easily under the heating condition. At least one of a base and a dye is enclosed in a microcapsule to isolate each other. It is also preferred to enclose both of them in different capsules each other. In the case wherein an outer shell of a microcapsule is opaque, it is preferred that a dye is contained in the outside of microcapsule and a base is contained in the microcapsule. As the heat response microcapsule, it is described in Hiroyuki Moriga, NYUMON TOKUSYUSI NO KAGAKU, 1975, and JP-A No. 1-150575.

As the thermal melting compound described above to isolate a dye and a base described above, a wax and the like can be used. The isolation can be done by the addition of at least one of a dye and a base (preferably a base) in a fine particle of the thermal melting compound. A melting point of the thermal melting compound described above is preferably between a room temperature and a heating temperature at which a decoloring reaction occurs. In the case, wherein a dye and a base are isolated by incorporating to different layers each other, it is preferred that a barrier layer containing a thermal melting compound is arranged between those layers.

A chemical isolation of a dye and a base is practically convenient and preferred. As the chemical isolating method of both, it is preferred to use a base precursor capable to generate (releasing of base is also contained) a base by heating. As the base precursor described above, a thermal decomposition type base precursor is typically and a thermal decomposition type base precursor composed of a carboxylic acid and a base (decarbonation type) is particularly typically. When the decarbonation type base precursor is heated, the carboxyl group of carboxylic acid is decarbonated and an organic base is released. As the carboxylic acid composing of the thermal decomposition type base precursor, sulfonyldiacetic acid and propiolic acid which can decarbonate easily can be used. A sulfonyldiacetic acid and propiolic acid having a substituent group having an aromaticity to promote a decarbonation (an aryl group and an unsaturated heterocyclic group) is preferred. A base precursor with a sulfonyldiacetic acid is described in JP-A No. 59-168441 and a base precursor with a propiolic acid salt is described in JP-A No. 59-180537. As a base component of a decarbonation type base precursor, an organic base is preferable and amidines, guanidines and these derivatives are more preferable. The organic base is preferably a diacidic base, a triacidic base or a tetraacidic base, more preferably diacidic base, and most preferably an amidine derivative or a guanidine derivative.

As the precursor of a diacidic base, a triacidic base and a tetreaacidic base of amidine derivative, it is described in JP-B No. 7-59545. As the precursor of a diacidic base, a triacidic base and a tetreaacidic base of guanidine derivative, it is described in JP-B No. 8-10321. The diacidic base of amidine derivative or guanine derivative comprises (A) two amidine parts or guanine parts, (B) the substituent of amidine part or guanine part and (C) divalent linking group to bind two amidine parts or guanine parts. As the examples of substituent of (B), an alkyl group (a cycloalkyl group is contained), an alkenyl group, an alkynyl group, an aralkyl group and a heterocyclic residual group are included. Two or more substituents may bind together to form a nitrogen-containing heterocycle. The linking group of (C) is preferably an alkylene group or a phenylene group. As the example of diacidic base precursor of amidine derivative or guanidine derivative, the base precursor described in compound 55 to compound 95 in JP-A No.11-231457 can be preferably used in the present invention.

When the dye described above is decolored, the optical density after thermal development can be decreased to 0.1 or less. Two or more kinds of bleaching dyes may be used together in a photothermographic material. Similarly, two or more kinds of base precursors may be used in combination. In a thermal bleaching process, wherein a base and a dye described above are used, it is preferable to use a compound which can decrease a melting point at 3° C. or more by mixing with a base precursor described in JP-A No. 11-352626 (for example, diphenylsulfone, 4-chlorophenyl (phenyl)sulfone), 2-naphthylbenzoate and the like in combination.

A layer containing an antihalation dye preferably contains a binder with the dye. As a binder, a hydrophilic polymer (e.g., a polyvinyl alcohol, a gelatin) is preferable. In general, the addition amount of an antihalation dye in a photothermographic material is preferably in a range wherein an optical density (absorbance) exceeds 0.1, and more preferably 0.2 to 2.0. The amount of dye needed for obtaining those optical densities can be smaller by using an aggregation dye and generally is 0.001 g/m$^2$ to 0.2 g/m$^2$ and preferably 0.001 g/m$^2$ to 0.1 g/m$^2$ and more preferably 0.001 g/m$^2$ to 0.05 g/m$^2$. The addition amount of a base precursor (mol) preferably is 1 to 100 times toward the amount of dye (mol), and more preferably 3 to 30 times. A base precursor is preferably dispersed and contained in either layer of photothermographic material in a solid fine particle dispersing state.

As a method of adding an antihalation dye to a non-photosensitive layer, an addition of a solid fine particle dispersion or an aggregation dispersion of dye to the coating solution for the non-photosensitive layer can be adopted. The adding method is generally similar to the adding method of dye generally used in the photothermographic material.

3) Back Layer

Back layers usable in the invention are described in paragraph Nos. 0128 to 0130 of JP-A No. 11-65021.

In the invention, coloring agents having maximum absorption in the wavelength range from 300 nm to 450 nm may be added in order to improve color tone of developed silver images and a deterioration of the images during aging. Such coloring agents are described in, for example, JP-A Nos. 62-210458, 63-104046, 63-103235, 63-208846, 63-306436, 63-314535, 01-61745, 2001-100363, and the like. Such coloring agents are generally added in the range from 0.1 mg/m$^2$ to 1 g/m$^2$, preferably to the back layer which is provided to the surface side opposite to the image forming layer.

4) Matting Agent

A matting agent may be preferably added to the surface protective layer and to the back layer in order to improve transportability. Description on the matting agent can be found in paragraphs Nos. 0126 to 0127 of JP-A No.11-65021.

The addition amount of the matting agent is preferably in the range from 1 mg/m$^2$ to 400 mg/m$^2$, and more preferably, from 5 mg/m$^2$ to 300 mg/m$^2$, with respect to the coating amount per 1 m$^2$ of the photothermographic material.

The matt degree on the image forming layer surface is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in a range of 1200 seconds or less and 10 seconds or more; more preferably, 800 seconds or less and 20 seconds or more; and further preferably, 500 seconds or less and 40 seconds or more when expressed by Beck's smoothness.

In the present invention, a matting agent is preferably contained in an outermost layer, in a layer which can be function as an outermost layer, or in a layer nearer to outer surface, and also preferably is contained in a layer which can function as so-called protective layer.

5) Polymer Latex

A polymer latex can be incorporated in the surface protective layer and the back layer of the present invention.

As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

The polymer latex is preferably contained in an amount of 10% by weight to 90% by weight, particularly preferably, of 20% by weight to 80% by weight of the total weight of binder (including water-soluble polymer and polymer latex) in the surface protective layer or the back layer.

6) Surface pH

The surface pH of the photothermographic material according to the invention preferably yields a pH of 7.0 or lower, more preferably, 6.6 or lower, before thermal developing process. Although there is no particular restriction concerning the lower limit, the lower limit of pH value is about 3, and the most preferred surface pH range is from 4 to 6.2.

From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like.

As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for forming the protective layer 180 minutes before coating to just before coating, preferably 60 minutes before to 10 seconds before coating. However, so long as the effect of the invention is sufficiently exhibited, there is no particular restriction concerning the mixing method and the conditions of mixing.

As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbunsha, 1989), and the like.

8) Surfactant

As the surfactant applicable in the invention, there can be mentioned those disclosed in paragraph No. 0132 of JP-A No. 11-65021.

In the invention, preferably used are fluorocarbon surfactants. Specific examples of fluorocarbon surfactants can be found in those described in JP-A Nos. 10-197985, 2000-19680, and 2000-214554. Polymer fluorocarbon surfactants described in JP-A 9-281636 can be also used preferably.

9) Antistatic Agent

The photothermographic material of the invention may contain an electrically conductive layer including various kinds of metal oxides or electrically conductive polymers known to the public. The antistatic layer may serve as an undercoat layer described above, or a back surface protective layer, and the like, but can also be placed specially. As to the antistatic layer, technologies described in paragraph No. 0135 of JP-A No. 11-65021, JP-A Nos. 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898 can be applied.

10) Support

As the transparent support, favorably used is polyester, particularly, polyethylene terephthalate, which is subjected to heat treatment in the temperature range from 130° C. to 185° C. in order to relax the internal strain caused by biaxial stretching and remaining inside the film, and to remove strain ascribed to heat shrinkage generated during thermal development.

As the support of the photothermographic material used in combination with the ultraviolet light emission screen, PEN is preferably used, but the present invention is not limited thereto. As the PEN, polyethylene-2,6-naphthalate is preferred. The "polyethylene-2,6-naphthalate" herein means that the structure repeating units essentially may consist of ethylene-2,6-naphthalene dicarboxylate groups and also may include un-copolymerized polyethylene-2,6-naphthalene dicarboxylate, and the copolymer comprising 10% or less, and preferably 5% or less, of the structure repeating units denatured with the other components and mixtures or constituents of other polymer.

Polyethylene-2,6-naphthalate can be synthesized by reacting a naphthalene-2,6-dicarboxylic acid or functional derivatives thereof, and an ethylene glycol or functional derivatives thereof in the presence of a suitable catalyst at proper reaction condition. The polyethylene-2,6-naphthalate of the present invention may be copolymerized or blended polysters, where one or more kinds of suitable third component (denaturing agent) is added before the completion of polymerization of the polyethylene-2,6-aphthalate. As the suitable third component, compounds containing a divalent ester forming functional group, for example, dicarboxylic acids such as oxalic acid, adipic acid, phthalic acid, isophthalic acid, terephthalic acid, naphthalene-2,7-dicarboxylic acid, succinic acid, diphenylether dicarboxylic acid and the like, or lower alkylesters thereof, oxycarboxylic acids such as p-oxybenzoic acid, p-oxyethoxybenzoic acid, or lower alkylesters thereof, and divalent alcohols such as propylene glycol, trimethylene glycol and the like are described. Polyethylene-2,6-naphthalate and the denatured polymers thereof may include, for example, the polymer where the terminal hydroxy group and/or the carboxylic group is blocked by mono-functional compounds such as benzoic acid, benzoyl benzoic acid, benzyloxy benzoic acid, methoxy polyalkylene glycol and the like, or the polymer denatured with a very small amount of compounds having tri-functional or tetra-functional ester forming group such as glycerine and penta-erthritol in the extent to form linear chain copolymers substantially.

In the case of a photothermographic material for medical use, the transparent support may be colored with a blue dye (for instance, dye-1 described in Examples of JP-A No. 8-240877), or may be uncolored.

Exemplified embodiments of the support are described in paragraph No. 0134 of JP-A No. 11-65021.

As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684.

11) Other Additives

Furthermore, antioxidant, stabilizing agent, plasticizer, UV absorbent, or a film forming promoting agent may be added to the photothermographic material. A solvent described in paragraph No. 0133 of JP-A No. 11-65021 may be added. Each of the additives is added to either of the image forming layer (photosensitive layer) or the non-photosensitive layer. Reference can be made to WO No. 98/36322, EP-A No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the kind of hopper described in U.S. Pat. No. 2,681,294 are used. Preferably used is extrusion coating or slide coating described in pages 399 to 536 of Stephen F. Kistler and Petert M. Schweizer, "LIQUID FILM COATING" (Chapman & Hall, 1997), and particularly preferably used is slide coating.

Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095.

The coating solution for the image forming layer according to the invention is preferably a so-called thixotropic fluid. For the details of this technology, reference can be made to JP-A No. 11-52509.

In the invention, viscosity of the coating solution for the image forming layer at a shear velocity of 0.1 $S^{-1}$ is preferably from 400 mPa·s to 100,000 mPa·s, and more preferably, from 500 mPa·s to 20,000 mPa·s.

At a shear velocity of 1000 $S^{-1}$, the viscosity is preferably from 1 mPa·s to 200 mPa·s, and more preferably, from 5 mPa·s to 80 mPa·s.

13) Wrapping Material

In order to suppress fluctuation from occurring on the photographic property during a preservation of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-}m^{-2}day^{-1}$ or lower, and further preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{1}$ or lower, and further preferably, 1 $g \cdot atm^{-1}m^{-2}day^{-1}$ or lower. As specific examples of a wrapping material having low oxygen transmittance and/or vapor transmittance, reference can be made to, for instance, the wrapping material described in JP-A Nos.8-254793 and 2000-206653.

14) Other Applicable Techniques

Techniques which can be used for the photothermographic material of the invention also include those in EP-A No. 803764A1, EP-A No. 883022A1, WO No. 98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-20699, 2001-275471, 2001-275461, 2000-313204, 2001-292844, 2000-324888, 2001-293864 and 2001-348546.

2. Image Forming Method

The photothermographic material of the present invention may be either "single-sided type" having an image forming layer on one side of the support, or "double-sided type" having image forming layers on both sides of the support.

(Double-sided Type Photothermographic Material)

The photothermographic material of the present invention is preferably applied for an image forming method to record X-ray images using an X-ray intensifying screen.

The image forming method using the photothermographic materials described above comprises the steps of:

(a) providing an assembly for forming an image by placing the photothermographic material between a pair of the X-ray intensifying screens, (b) putting an analyte between the assembly and the X-ray source, (c) applying an X-ray having an energy level of 25 kvp to 125 kvp to the analyte, (d) taking the photothermographic material out of the assembly, and (e) heating the thus taken out photothermographic material in the temperature range of 90° C. to 180° C.

The photothermographic material used for the assembly in the present invention is subjected to X-ray exposure through a step wedge tablet and thermal development. On the photographic characteristic curve having an optical density (D) and an exposure amount (log E) along the rectangular coordinates having the equal axis-of-coordinate unit, it is preferred to adjust so that the thermal developed image may have the photographic characteristic curve where the average gamma (γ) made at the points of a density of fog+0.1 and a density of fog+0.5 is from 0.5 to 0.9, and the average gamma (γ) made at the points of a density of fog+1.2 and a density of fog+1.6 is from 3.2 to 4.0. For the X-ray radiography employed in the practice of the present invention, the use of photothermographic material having the aforesaid photographic characteristic curve would give the X-ray images with excellent photographic properties that exhibit an extended bottom portion and high gamma value at middle density area. According to this photogaraphic property, the photographic properties mentioned has the advantage of that the depiction in low density portion on the mediastinal region and the heart shadow region having little X-ray transmittance becomes excellent, and that the density becomes pleasing to the eye, and that the contrast in the images on the lung field region having much X-ray transmittance becomes excellent.

The photothermographic material having the preferred photographic characteristic curve mentioned above can be easily prepared, for example, by the method where each of the image forming layer of both sides may be constituted of two or more image forming layers containing silver halide and having a sensitivity different from each other. Especially, the aforesaid image forming layer preferably comprises an emulsion of high sensitivity for the upper layer and an emulsion with photographic properties of low sensitivity and high contrast for the lower layer. In the case of preparing the image forming layer comprising two layers, the sensitivity difference between the silver halide emulsion in each layer is preferably from 1.5 times to 20 times, and more preferably from 2 times to 15 times. The ratio of the amount of emulsion used for forming each layer may depend on the sensitivity difference between emulsions used and the covering power. Generally, as the sensitivity difference is large, the ratio of the using amount of high sensitivity emulsion is reduced. For example, if the sensitivity difference is two times, and the covering power is equal, the ratio of the amount of high sensitivity emulsion to low sensitivity emulsion would be preferably adjusted to be in the range from 1:20 to 1:50 based on silver amount.

As the techniques for crossover cut (in the case of double-sided coated photosensitive material) and anti-halation (in the case of single-sided coated photosensitive material), dyes or combined use of dye and mordant described in JP-A. No. 2-68539, (from page 13, left lower column, line 1 to page 14, left lower column, line 9) can be employed.

Next the fluorescent intensifying screen (radiographic intensifying screen) employed in the practice of the present invention is explained below. The radiographic intensifying screen essentially comprises a support and a fluorescent substance layer coated on one side of the support as the fundamental structure. The fluorescent substance layer is a layer where the fluorescent substance is dispersed in binders. On the surface of a fluorescent substance layer opposite to the support side (the surface of the side that does not face on the support), a transparent protective layer is generally disposed to protect the fluorescent substance layer from chemical degradation and physical shock.

Preferred fluorescent substances of the present invention are described below. Tungstate fluorescent substances ($CaWO_4$, $MgWO_4$, $CaWO_4$:Pb and the like), terbium activated rare earth sulfoxide fluorescent substances [$Y_2O_2S$:Tb, $Gd_2O_2S$:Tb, $La_2O_2S$:Tb, $(Y,Gd)_2O_2S$:Tb, $(Y,Gd)O_2S$:Tb, Tm and the like], terbium activated rare earth phosphate fluorescent substances ($YPO_4$:Tb, $GdPO_4$:Tb, $LaPO_4$:Tb and the like), terbium activated rare earth oxyhalogen fluorescent substances (LaOBr:Tb, LaOBr:Tb, Tm, LaOCl:Tb, LaOCl:Tb, Tm, LaOBr:Tb, GdOBr:Tb, GdOCl:Tb and the like), thulium activated rare earth oxyhalogen fluorescent substances (LaOBr:Tm, LaOCl:Tm and the like), barium sulfate fluorescent substances [$BaSO_4$:Pb, $BaSO_4$:$Eu^{2+}$, $(Ba,Sr)SO_4$:$Eu^{2+}$ and the like], divalent europium activated alkali earth metal phosphate fluorescent substances [$(Ba_2PO_4)_2$:$Eu^{2+}$, $(Ba_2PO_4)_2$:$Eu^{2+}$, and the like], divalent europium activated alkali earth metal fluorinated halogenide fluorescent substances [BaFCl:$Eu^{2+}$, BaFBr:$Eu^{2+}$, BaFCl:$Eu^{2+}$, Tb, BaFBr:$Eu^{2+}$, Tb, $BaF_2$.BaCl.KCl:$Eu^{2+}$, $(Ba,Mg)F_2$.BaCl.KCl:$Eu^{2+}$, and the like], iodide fluorescent substances (CsI:Na, CsI:Tl, NaI, KI:Tl and the like), sulfide fluorescent substances [ZnS:Ag(Zn,Cd)S:Ag, (Zn,Cd)S:Cu, (Zn,Cd)S:Cu, Al and the like], hafnium phosphate fluorescent substances ($HfP_2O_7$:Cu and the like), $YTaO_4$ and a substance in which various activator is added as an emission center to $YTaO_4$. However, the fluorescent substance used in the present invention is not particularly limited to these specific examples, so long as to emit light in visible or near ultraviolet region by exposure to a radioactive ray.

In the fluorescent intensifying screen used in the present invention, the fluorescent substances are preferably packed in the grain size graded structure. Especially, fluorescent substance particles having a large particle size is preferably coated at the side of the surface protective layer and fluorescent substance particles having a small particle size is preferably coated at the side of the support. Hereto, the small particle size of fluorescent substance is preferably in the range from 0.5 μm to 2.0 μm and the large size is preferably in the range from 10 μm to 30 μm.

(Single-sided Type Photothermographic Material)

The single-sided type photothermographic material of the present invention is favorably applied for an X-ray photosensitive material used for mammography.

To use the single-sided type photothermographic material for that purpose, it is very important to design the contrast of the obtained image in the suitable range.

Concerning the preferable constitution for a photosensitive material used for mammography, reference can be made to JP-A Nos. 5-45807, 10-62881, 10-54900, 11-109564.

(Combined use with Ultraviolet Fluorescent Intensifying Screen)

As for the image forming method using photothermographic material according to the present invention, it is preferred that the method comprising forming an image in combination with a fluorescent substance having a main emission peak at 400 nm or lower. And more preferably, the image forming method is performed in combination with a fluorescent substance having a main emission peak at 380 nm or lower. Either single-sided coated photosensitive material or double-sided coated photosensitive material can be applied for the assembly. As the screen having a main emission peak at 400 nm or lower, the screens described in JP-A No. 6-11804 and WO No. 93/01521 and the like are used, but the present invention is not limited to these. As the techniques of crossover cut (for double-sided coated photosensitive material) and anti-halation (for single-sided coated photosensitive material) of ultraviolet light, the technique described in JP-A No. 8-76307 can be applied. As ultraviolet absorbing dyes, the dye described in JP-A No. 2001-144030 is particularly preferred.

(Thermal Development)

Although any method may be used for the development of the photothermographic material of the invention, the thermal development process is usually performed by elevating the temperature of the photothermographic material exposed imagewise. The temperature for the development is preferably in the range from 80° C. to 250° C., and more preferably, from 100° C. to 140° C. Time period for development is preferably in the range from 1 second to 60 seconds, more preferably from 5 seconds to 30 seconds, and particularly preferably from 5 seconds to 20 seconds.

In the process for thermal development, plate type heater processes are preferred. Preferable process for thermal development by a plate type heater may be a process described in JP-A NO. 11-133572, which discloses a thermal developing device in which a visible image is obtained by bringing a photothermographic material with a formed latent image into contact with a heating means at a thermal developing portion, wherein the heating means comprises a plate heater, and plurality of retainer rollers are oppositely provided along one surface of the plate heater, the thermal developing device is characterized in that thermal development is performed by passing the photothermographic material between the retainer rollers and the plate heater. It is preferred that the plate heater is divided into 2 to 6 steps, with the leading end having the lower temperature by 1° C. to 10° C.

Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

(System)

Examples of a medical laser imager equipped with a light exposing portion and a thermal developing portion include Fuji Medical Dry Laser Imager FM-DP L and DRYPIX 7000. Concerning FM-DP L, description is found in Fuji Medical Review, No. 8, pages 39 to 55, and these techniques can be applied. In addition, the present photothermographic material can be also applied as a photothermographic material for the laser imager used in "AD network" which was proposed by Fuji Film Medical Co., Ltd. as a network system accommodated to DICOM standard.

3. Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

1. Preparation of PET Support and Undercoating 1-1. Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, and colored blue with the blue dye (1,4-bis(2,6-diethylanilinoanthraquinone). Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

1-2. Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 KV·A·minute·m$^{-2}$ was executed, judging from the readings of current and voltage on that occasion. The frequency upon this treatment was 9.6 kHz, and the gap clearance between the electrode and dielectric roll was 1.6 mm.

1-3. Preparation of Undercoated Support (1) Preparation of Coating Solution for Undercoat Layer

| | |
|---|---|
| Pesresin A520 manufactured by Takamatsu Oil & Fat Co., Ltd. (30% by weight solution) | 46.8 g |
| BAIRONAARU MD1200 manufactured by Toyo Boseki Co., Ltd. | 10.4 g |

-continued

| | |
|---|---|
| Polyethylene glycol monononylphenylether (average ethylene oxide number = 8.5) 1% by weight solution | 11.0 g |
| MP1000 manufactured by Soken Chemical & Engineering Co., Ltd. (PMMA polymer fine particle, mean particle diameter of 0.4 μm) | 0.91 g |
| distilled water | 931 mL |

(2) Undercoating

Both surfaces of the biaxially tentered polyethylene terephthalate support having the thickness of 175 μm were subjected to the corona discharge treatment as described above. Thereafter, the aforementioned coating solution for undercoat layer was coated with a wire bar so that the amount of wet coating became 6.6 mL/m$^2$ (per one side), and dried at 180° C. for 5 minutes. This was performed on both sides, and thus an undercoated support was produced.

2. Preparations of Coating Materials

1) Preparations of Photosensitive Silver Halide Emulsion

<Photosensitive Silver Halide Emulsion A>

This is a pure silver iodide host emulsion.

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Thereby an unripened pure silver iodide emulsion (hereinafter, expressed as the unripened emulsion A) was prepared.

The obtained silver halide grains had a mean projected area equivalent diameter of 0.93 μm, a variation coefficient of a projected area equivalent diameter distribution of 17.7%, a mean thickness of 0.057 μm and a mean aspect ratio of 16.3. Tabular grains having an aspect ratio of 2 or more occupied 80% or more of the total projected area. The mean equivalent spherical diameter of the grains was 0.42 μm. 30% or more of the silver iodide existed in γ phase from the result of powder X-ray diffraction analysis.

<Photosensitive Silver Halide Emulsion B>

This is a silver iodobromide host emulsion.

1500 mL of an aqueous solution containing 4.1 g of potassium bromide and 14.1 g of phthalated gelatin was stirred while maintaining the temperature thereof at 40° C. An aqueous solution containing silver nitrate (2.9 g) and an aqueous solution containing potassium bromide (2.0 g) and potassium iodide (0.39 g) were added to the mixture over a period of 40 seconds. After the addition of an aqueous solution containing 35.5 g of phthalated gelatin, the temperature of the mixture was elevated to 58° C. Thereafter, as the first growth stage, an aqueous solution containing silver nitrate (63.7 g) and an aqueous potassium bromide solution containing potassium iodide were added by double jet method at increasing flow rate. The concentration of the potassium iodide was adjusted to make the silver iodide content of 15 mol %. During the operation, the pAg was kept at 8.9. On the way, potassium hexachloroiridate (III) and sodium benzene thiosulfonic acid were added thereto. Thereafter, as the outermost layer growth stage, an aqueous solution containing silver nitrate (7.4 g) and an aqueous potassium bromide solution containing potassium iodide were added to the mixture over a period of 5 minutes. The concentration of the potassium iodide was adjusted to make the silver iodide content of 30 mol %. During the operation, the pAg was kept at 8.9. After water washing in a normal manner, the amounts of silver and gelatin per 1 kg of the emulsion were adjusted by the addition of phthalated gelatin to be equivalent to those of silver halide emulsion A, and then the pH and the pAg of the resulting emulsion at 40° C. were adjusted to 5.9 and 8.4, respectively.

Thereby an unripened silver iodobromide emulsion (hereinafter, expressed as the unripened emulsion B) was prepared.

The obtained silver halide grains had a mean equivalent circular diameter of 0.95 μm, a variation coefficient of an equivalent circular diameter distribution of 18.3%, a mean grain thickness of 0.055 μm and a mean aspect ratio of 17.2. Tabular grains having an aspect ratio of 2 or more occupied 80% or more of the total projected area. The mean equivalent spherical diameter of the grains was 0.42 μm.

<Photosensitive Silver Halide Emulsion C> Comparative Emulsion 1 mol of the unripened emulsion A prepared above was added to the reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion C.

<Silver Halide Emulsion D> Emulsion of the Present Invention

Preparation of silver halide emulsion D was conducted in a similar manner to the process in the preparation of the silver halide emulsion C except that: 1 mol of the unripened emulsion A was added to the reaction vessel, where the pAg of the mixture was adjusted to be 7.5 at 40° C., and then the silver nitrate solution of the double jet addition was added at addition speed of 20 mL/min over a period of 10 minutes; during the operation, the pAg was kept at 7.5; and the addition amount of tellurium sensitizer C was optimized in the chemical sensitization step. Thereby, silver halide emulsion D was prepared.

<Silver Halide Emulsion E> Emulsion of the Present Invention

Preparation of silver halide emulsion E was conducted in a similar manner to the process in the preparation of the silver halide emulsion C except that: 1 mol of the unripened emulsion A was added to the reaction vessel, where the pAg of the mixture was adjusted to be 7.0 at 60° C., and then the silver nitrate solution of the double jet addition were added at addition speed of 40 mL/min over a period of 5 minutes; during the operation, the pAg was kept at 7.0; and the addition amount of tellurium sensitizer C was optimized in the chemical sensitization step. Thereby, silver halide emulsion E was prepared.

<Silver Halide Emulsion F> Emulsion of the Present Invention

Preparation of silver halide emulsion F was conducted in a similar manner to the process in the preparation of the silver halide emulsion C except that: 1 mol of the unripened emulsion A was added to the reaction vessel, where the pAg of the mixture was adjusted to be 6.6 at 80° C., and then the silver nitrate solution of the double jet addition was added at addition speed of 80 mL/min over a period of 2 minutes and 30 seconds; during the operation, the pAg was kept at 6.6; and the addition amount of tellurium sensitizer C was optimized in the chemical sensitization step. Thereby, silver halide emulsion F was prepared.

<Silver Halide Emulsion G> Emulsion of the Present Invention

Preparation of silver halide emulsion G was conducted in a similar manner to the process in the preparation of the silver halide emulsion D except that 1 mol of the unripened emulsion B was added to the reaction vessel, and the addition amount of tellurium sensitizer C was optimized in the chemical sensitization step. Thereby, silver halide emulsion G was prepared.

From the carbon replica electron photomicrograph of silver halide emulsion B to E and G, 300 grains were sampled at random and classified for the epitaxial depositions. The results were summarized in the following Table 1.

TABLE 1

| Epitaxial emulsion | A1 Frequency of grains having epitaxial junctions on one or more apex portions (%) | A2 Frequency of grains having epitaxial junctions on main surface other than apex portion, or only on edge portion (%) | A3, B3, C3 Frequency of grains having no epitaxial junction (%) |
|---|---|---|---|
| | B1 Frequency of grains having epitaxial junctions on apex portions, of a number exceeding ⅔ of the number of apex portions (%) | B2 Frequency of grains having epitaxial junctions besides those described in B1 (%) | |
| | C1 Frequency of grains having epitaxial junctions on one or more apex portions and, the occupied area of the epitaxial junctions on major surfaces other than the apex portion is less than 10% of a projected area of the grain other than the apex portion or the length of edges occupied by the epitaxial junction on edge portions is less than 30% of the length of edges other than those of the apex portion (%) | C2 Frequency of grains having epitaxial junction besides those described in C1 (%) | |
| C | 46 | 13 | 41 |
| | 8 | 51 | |
| | 23 | 36 | |
| D | 71 | 6 | 23 |
| | 24 | 53 | |
| | 52 | 25 | |
| E | 92 | 3 | 5 |
| | 51 | 44 | |
| | 78 | 17 | |
| F | 94 | 4 | 2 |
| | 76 | 22 | |
| | 92 | 6 | |
| G | 92 | 6 | 2 |
| | 78 | 20 | |
| | 89 | 9 | |

<Preparations of Mixed Emulsion for Coating Solution>

Each of the silver halide emulsion C to G described above were dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the mixed emulsion for a coating solution.

2) Preparation of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid-being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<Reducing Agent-1 Dispersion>

To 10 kg of reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<Reducing Agent-2 Dispersion>

To 10 kg of reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Dispersions of Development Accelerator and Color-tone-adjusting Agent <Development Accelerator-1 Dispersion>

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minuets. Thereafter, 0.2 g of a benzoisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

<Solid Dispersions of Development Accelerator-2 and Color-tone-adjusting Agent-1>

Also concerning solid dispersions of development accelerator-2 and color-tone-adjusting agent-1, dispersion was executed in a similar manner to the development accelerator-1, and thus dispersions of 20% by weight and 15% by weight were respectively obtained.

6) Preparations of Organic Polyhalogen Compound Dispersion

<Organic Polyhalogen Compound-1 Dispersion>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Organic Polyhalogen Compound-2 Dispersion>

10 kg of organic polyhalogen compound-2 (N-butyl-3-tribromomethane sulfonylbenzoamide), 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Silver iodide Complex-forming Agent 8 kg of modified polyvinyl alcohol MP203 was dissolved in 174.57 kg of water, and thereto were added 3.15 kg of a 20% by weight aqueous solution of sodium triisopropylnaphthalenesulfonate and 14.28 kg of a 70% by weight aqueous solution of 6-isopropylphthalazine. Accordingly, a 5% by weight solution of silver iodide complex-forming agent compound was prepared.

8) Preparations of Aqueous Solution of Mercapto Compound

<Aqueous Solution of Mercapto Compound-1>

Mercapto compound-1 (1-(3-sulfophenyl)-5-mercaptotetrazole sodium salt) in an amount of 7 g was dissolved in 993 g of water to give a 0.7% by weight aqueous solution.

<Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

9) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.) and pH of 8.4.

3. Preparations of Coating Solution

1) Preparations of Coating Solution for Image Forming Layer

To the dispersion of the silver salt of fatty acid obtained as described above in an amount of 1000 g and 276 mL of water were serially added the organic polyhalogen compound-1 dispersion, the organic polyhalogen compound-2 dispersion, the SBR latex (Tg: 17° C.) solution, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the mixed emulsion for coating solution was added thereto in an amount of 0.22 mol per 1 mol of silver salt of fatty acid, followed by thorough mixing just prior to the coating, which was fed directly to a coating die, and was coated.

2) Preparation of Coating Solution for Intermediate Layer

To 1000 g of polyvinyl alcohol PVA-205 (manufactured by Kuraray Co., Ltd.), and 4200 mL of a 19% by weight solution of methyl methacrylate/styrene/butyl acrylate/hydroxyethyl methacrylate/acrylic acid copolymer (weight ratio of the copolymerization of 64/9/20/5/2) latex, were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 9.1 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In water was dissolved 64 g of inert gelatin, and thereto were added 112 g of a 19.0% by weight solution of methyl methacrylate/styrene/butyl acrylate/hydroxyethyl methacrylate/acrylic acid copolymer (weight ratio of the copolymerization of 64/9/20/5/2) latex, 30 mL of a 15% by weight methanol solution of phthalic acid, 23 mL of a 10% by weight aqueous solution of 4-metyl phthalic acid, 28 mL of 0.5 mol/L sulfuric acid, 5 mL of a 5% by weight aqueous solution of aerosol OT (manufactured by American Cyanamid Co.), 0.5 g of phenoxyethyl alcohol, and 0.1 g of benzoisothiazolinone. Water was added to give total amount of 750 g. Immediately before coating, 26 mL of a 4% by weight chrome alum which had been mixed with a static mixer was fed to a coating die so that the amount of the coating solution became 18.6 mL/m$^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight solution of methyl methacrylate/styrene/butyl acrylate/hydroxyethyl methacrylate/acrylic acid copolymer (weight ratio of the copolymerization of 64/9/20/5/2) latex, 5.4 mL of a 2% by weight solution of a fluorocarbon surfactant (F-1), 5.4 mL of a 2% by weight aqueous solution of another fluorocarbon surfactant (F-2), 23 mL of a 5% by weight aqueous solution of aerosol OT (manufactured by American Cyanamid Co.), 4 g of polymethyl methacrylate fine particles (mean particle diameter of 0.7 μm, distribution of volume weighted average being 30%) and 21 g of polymethyl methacrylate fine particles (mean particle diameter of 3.6 μm, distribution of volume weighted average being 60%), 1.6 g of 4-methyl phthalic acid, 4.8 g of phthalic acid, 44 mL of 0.5 mol/L sulfuric acid, and 10 mg of benzoisothiazolinone. Water was added to give total amount of 650 g. Immediately before coating, 445 mL of a aqueous solution containing 4% by weight chrome alum and 0.67% by weight phthalic acid were added and admixed with a static mixer to give a coating solution for the second layer of the surface protective layers, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

4. Preparations of Photothermographic Material

Simultaneous overlaying coating by a slide bead coating method was subjected, on both sides of the support, in order of the image forming layer, intermediate layer, first layer of the surface protective layers and second layer of the surface protective layers, and thus samples of the photothermographic material (see Table 2) were produced. In this method, the temperature of the coating solution was adjusted to 31° C. for the image forming layer and intermediate layer, to 36° C. for the first layer of the surface protective layers, and to 37° C. for the second layer of the surface protective layers. The amount of coated silver in the image forming layer was 0.821 g/m$^2$ per one side, with respect to the sum of the amounts of silver salt of fatty acid and silver halide.

The coating amount of each compound (g/m$^2$) for the image forming layer per one side is as follows.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |
| SBR latex | 5.20 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |

-continued

| | |
|---|---|
| Mercapto compound-2 | 0.003 |
| Silver halide (on the basis of Ag content) | 0.146 |

Conditions for coating and drying were as follows.

The support was decharged by ionic wind. Coating was performed at the speed of 160 m/min. Conditions for coating and drying were adjusted within the range described below, and conditions were set to obtain the most stable surface state.

The clearance between the leading end of the coating die and the support was 0.10 mm to 0.30 mm.

The pressure in the vacuum chamber was set to be lower than atmospheric pressure by 196 Pa to 882 Pa.

In the subsequent cooling zone, the coating solution was cooled by wind having the dry-bulb temperature of 10° C. to 20° C.

Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH.

Then, the film surface was heated to be 70° C. to 90° C., and after heating, the film surface was cooled to 25° C.

Thus prepared photothermographic material had a matt degree of 550 seconds as Beck's smoothness. In addition, measurement of the pH of the film surface gave the result of 6.0.

Chemical structures of the compounds used in Examples of the invention are shown below.

Tellurium sensitizer C

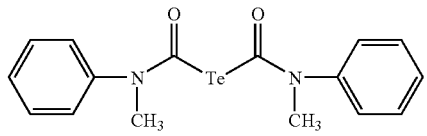

Compound 1 that can be one-electron-oxidized to provide a one-electron oxidation product which releases one or more electrons

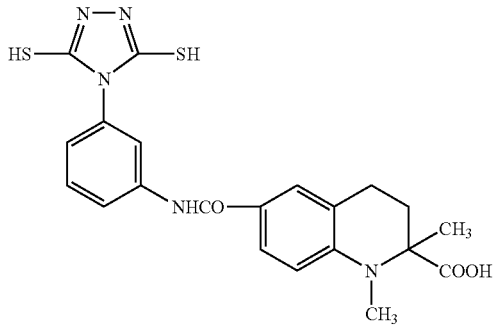

Compound 2 that can be one-electron-oxidized to provide a one-electron oxidation product which releases one or more electrons

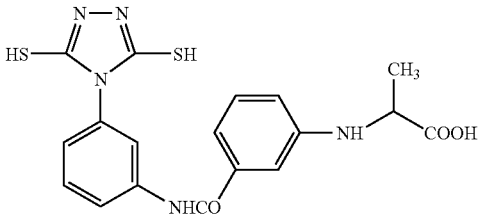

Compound 3 that can be one-electron-oxidized to provide a one-electron oxidation product which releases one or more electrons

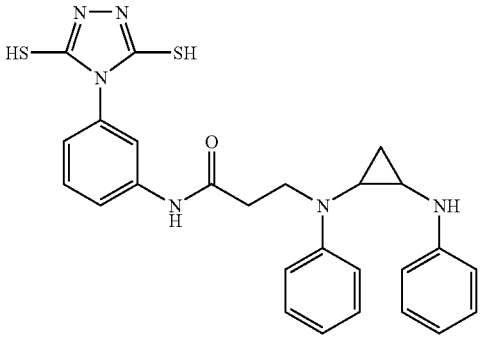

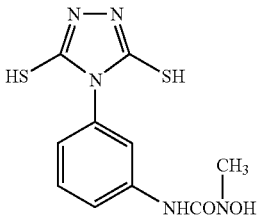

Compound 1 having adsorptive group and reducible group

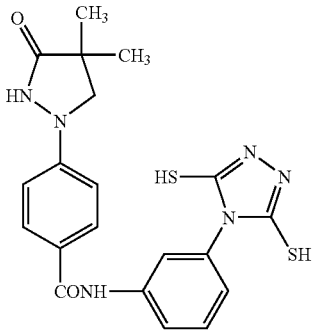

Compound 2 having adsorptive group and reducible group

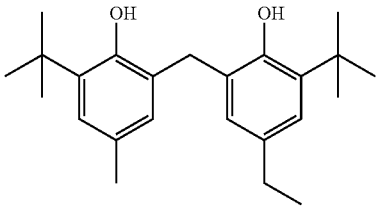

Reducing agent-1

-continued

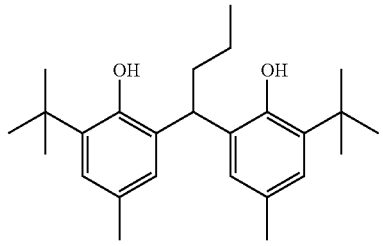

Reducing agent-2

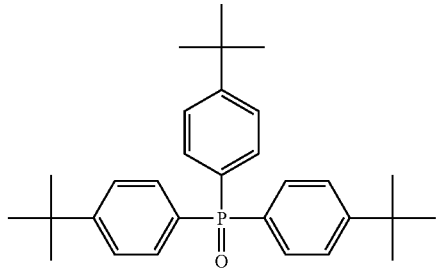

Hydrogen bonding compound-1

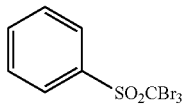

Organic polyhalogen compound-1

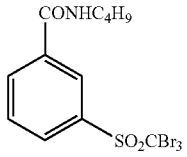

Organic polyhalogen compound-2

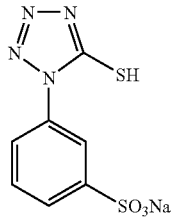

Mercapto compound-1

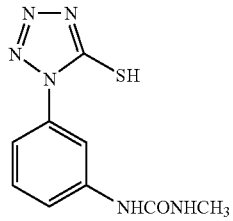

Mercapto compound-2

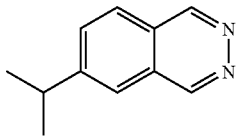

Silver iodide complex - forming agent

-continued

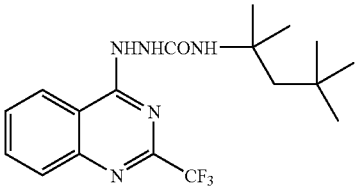

Development accelerator-1

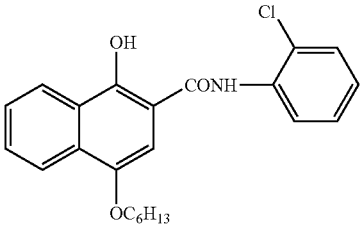

Development accelerator-2

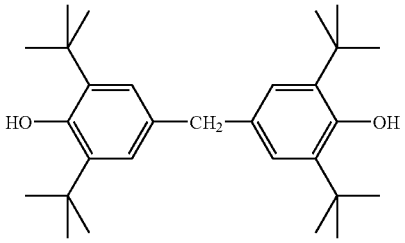

Color-tone-adjusting agent-1

(F-1)

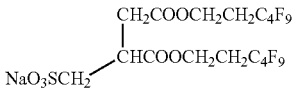

(F-2)

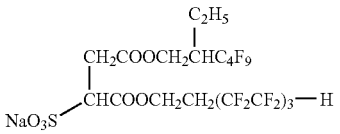

5. Evaluation of Photographic Properties

1) Preparation

The resulting sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$, vapor permeability at 25° C.: 0.10 $g \cdot atm^{-1}m^{-2}day^{-1}$.

2) Exposure and Thermal Development

Thus prepared double-sided coated photothermographic material was evaluated as follows.

Two sets of X-ray regular screen HI-SCREEN-B3 ($CaWO_4$ was used as fluorescent substance, the emission peak wavelength of 425 nm) produced by Fuji Photo Film Co., Ltd. were used, and the assembly for image formation was provided by inserting the sample between them.

This assembly was subjected to X-ray exposure for 0.05 seconds, and then X-ray sensitometry was performed. The X-ray apparatus used was DRX-3724HD (trade name) produced by Toshiba Corp., and a tungsten target tube was used. X-ray emitted by a pulse generator operated at three phase voltage of 80 kvp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E. After exposure, the exposed sample was subjected to thermal development with the condition mentioned below, and then the obtained image was evaluated by a densitometer.

The thermal developing portion of Fuji Medical Dry Laser Imager FM-DP L was modified so that it can heat from both sides, and by another modification the transportation rollers in the thermal developing portion were changed to the heating drum so that the sheet of film could be conveyed. The temperature of four panel heaters were set to 112° C.-118° C.- 120° C.- 120° C., and the temperature of the heating drum was set to 120° C. By increasing the speed of transportation, the total time period for thermal development was set to be 14 seconds.

3) Results of Evaluation (Phtographic Properties and Image Storability)

Densities of the obtained image were measured by using a Macbeth densitometer to draw a photographic characteristic curve representing a relationship between density and the common logarithm of exposure value.

Sensitivity: Sensitivity is the inverse of the exposure value giving image density of fog+1.0. The sensitivities are shown in relative value, detecting the sensitivity of Sample No. 1 to be 100. The bigger the value is, it shows that sensitivity is higher.

Fog: The density of the unexposed part was measured using a Macbeth densitometer.

Image Storability (Print-out): After thermal development, the samples were cut in a half-cut size and stored, under the environment of 30° C. and 70% RH, for 24 hours under 1000 Lux fluorescent lamp. Thereafter the increase of fog was measured.

TABLE 2

| Sample | Photosensitive Silver Halide Emulsion | | | | |
|---|---|---|---|---|---|
| No | No | Kind | Sensitivity | Fog | Print-out |
| 1 | C | Pure silver iodide host × polydispersed epitaxial emulsion | 100 | 0.19 | 0.02 |
| 2 | D | Pure silver iodide host × monodispersed epitaxial emulsion | 204 | 0.18 | 0.02 |
| 3 | E | Pure silver iodide host × monodispersed epitaxial emulsion | 251 | 0.18 | 0.01 |
| 4 | F | Pure silver iodide host × monodispersed epitaxial emulsion | 288 | 0.19 | 0.01 |
| 5 | G | Silve iodobromide host × monodispersed epitaxial emulsion | 282 | 0.19 | 0.03 |

4) Results

It is apparent from the results shown in the table that the photothermographic materials (sample Nos. 2 to 5) of the present invention exhibit high sensitivity by 2 to 3 times with respect to the comparative sample No. 1, but astonishingly almost no deterioration in fog and in print-out resistance after thermal development. Especially, it is worthy of special mention that the photothermographic materials comprising the epitaxial emulsion of the present invention having a silver iodide content of 40 mol % or higher exhibit excellent performances in sensitivity and print-out resistance.

Example 2

Double-sided coated photothermographic materials were prepared in a similar manner to Example 1 except that changing the support to PEN (polyethylene naphthalene).

The commercially available polyethylene-2,6-naphthalate polymer was melted at 300° C., extruded from a T-die, and the film was stretched along the longitudinal direction by 3.3 times and then stretched along the transverse direction by 3.3 times. The temperatures used for these operations were 140° C., respectively. Then the film was subjected to thermal fixation at 250° C. for 6 seconds to give the film having a thickness of 175 μm. The corona treatment of the support was performed as follows. The surface of the support having a width of 30 cm was treated at 20 m/minute using a Solid State Corona Discharge Treatment Machine Model 6KVA manufactured by Pillar GmbH. It was proven that treatment of 0.375 KV·A·minute·$m^{-2}$ was executed, judging from the readings of current and voltage on that occasion. The frequency upon this treatment was 9.6 KHz and the gap clearance between the electrode and the dielectric roll was 1.6 mm. Coating of undercoat layer was performed in a similar manner to the process in the preparation of the support of Example 1.

The obtained double-sided coated photothermographic material was evaluated as follows.

As for the fluorescent intensifying screen, Ultravision Fast Detail (UV) produced by Du Pont Co., Ltd. was used. Both sides of the photothermographic material of the invention were contacted with the screens, and the combination was subjected to X-ray exposure for 0.05 seconds to make X-ray sensitometry. The exposure value was adjusted by changing the distance between the X-ray tube and the cassette. After exposure, thermal development was performed in a similar manner to Example 1.

The results with excellent images similar to those of Example 1 were obtained.

Example 3

1. Preparation of Samples

Double-sided coated materials were prepared in a similar manner to the preparation of Example 1 except that using, as the silver halide emulsion, silver halide emulsion C and F of Example 1 and emulsion H to J prepared as described below.

<<Preparation of Silver Halide Emulsion H>>

Preparation of silver halide emulsion H was conducted in a similar manner to the preparation of silver halide emulsion F of Example 1 except that at 2 minutes before the epitaxial deposition, the entire amount of potassium hexacyanoruthenate (II) in an aqueous solution was added at $3\times10^{-4}$ mol per 1 mol of silver. Thereby, silver halide emulsion H containing 10 mol % of epitaxial silver bromide was prepared.

<<Preparation of Silver Halide Emulsion I>>

Preparation of silver halide emulsion I was conducted in a similar manner to the preparation of silver halide emulsion F of Example 1 except that at 2 minutes before the epitaxial deposition, the entire amount of potassium hexacyanoferrate (II) in an aqueous solution was added at $1\times10^{-4}$ mol per 1 mol of silver. Thereby, silver halide emulsion I containing 10 mol % of epitaxial silver bromide was prepared.

<<Preparation of Silver Halide Emulsion J>>

Preparation of silver halide emulsion J was conducted in a similar manner to the preparation of silver halide emulsion F of Example 1 except that at 2 minutes before the epitaxial deposition, the entire amount of potassium aquopentachloroiridate (III) in an aqueous solution was added at $3\times10^{-6}$ mol per 1 mol of silver. Thereby, silver halide emulsion J containing 10 mol % of epitaxial silver bromide was prepared.

The above silver halide emulsion H to J were silver halide emulsions containing a transition metal in the epitaxial parts according to the present invention.

2. Evaluation of Photographic Properties

The results evaluated similar to Example 1 are shown in Table 3.

TABLE 3

| Sample | Photosensitive Silver Halide Emulsion | | | | |
|---|---|---|---|---|---|
| No | No | Kind | Sensitivity | Fog | Print-out |
| 11 | C | Pure silver iodide host × polydispersed epitaxial emulsion | 100 | 0.19 | 0.02 |
| 12 | F | Pure silver iodide host × monodispersed epitaxial emulsion | 288 | 0.19 | 0.01 |
| 13 | H | Emulsion including transition metal in epitaxial part | 374 | 0.18 | 0.02 |
| 14 | I | Emulsion including transition metal in epitaxial part | 346 | 0.19 | 0.03 |
| 15 | J | Emulsion including transition metal in epitaxial part | 357 | 0.18 | 0.02 |

It is apparent from the results shown in the table that the photothermographic materials (sample Nos. 12 to 15) of the present invention exhibit high sensitivity by 3 to 3.5 times with respect to the comparative sample No. 11, but astonishingly almost no deterioration in fog and print-out resistance after thermal development.

Especially, it is worthy of special mention that the photothermographic materials comprising the epitaxial emulsion of the present invention having a silver iodide content of 40 mol % or higher exhibit excellent performances in sensitivity and print-out resistance.

Example 4

1. Preparations of Sample

A single-sided photothermographic material having the image forming layer only on one side and disposing a back layer on the opposite surface side of the image forming layer was prepared, similarly to Example 1. Image forming layer was double-coated to give an upper layer and a lower layer, and each coating amount of silver (sum of the amounts of silver salt of fatty acid and silver halide) was adjusted to be 0.8 g/$m^2$.

The silver halide emulsion L was used for the upper layer, and the silver halide emulsion F was used for the lower layer. An optimal orthochromatic sensitization was performed by using the sensitizing dye-1 and -2, respectively.

<Preparation of Silver Halide Emulsion K (Tabular AgI Host Grains, Grain Size of 0.30 μm)>

Preparation of silver halide emulsion K was conducted in a similar manner to the process in the preparation of the silver halide emulsion A except that adequately changing the addition amount of a 5% by weight methanol solution of 2,2'-(ethylene dithio)diethanol, the temperature at grain formation step, and the time for adding the solution A. The silver halide emulsion K was a pure silver iodide emulsion. The obtained silver halide grains had a mean projected area equivalent diameter of 0.565 μm, a variation coefficient of a projected area equivalent diameter distribution of 18.5%, a mean thickness of 0.056 μm and a mean aspect ratio of 10.0. Tabular grains having an aspect ratio of 2 or more occupied 80% or more of the total projected area. The mean equivalent spherical diameter of the grains was 0.30 μm. 30% or more of the silver iodide existed in γ phase from the result of powder X-ray diffraction analysis.

<Preparation of Silver Halide Emulsion L (Epitaxial Grains, Grain Size of 0.30 μm)>

Preparation of silver halide emulsion L was conducted in a similar manner to the process in the preparation of the silver halide emulsion F except that using silver halide emulsion K. Thereby, silver halide emulsion L containing 10 mol % of epitaxial silver bromide was prepared.

<Constitution of Back Layer>

1) Preparation of Coating Solution for Antihalation Layer

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L sodium hydroxide aqueous solution, 40 g of the following dispersion solution of the solid fine particles of the orthochromatic thermal bleaching dye, 90 g of the following dispersion solution of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

2) Crossover Cut Layer (Preparation of Dispersion of Solid Fine Particles (a) of Base Precursor)

2.5 kg of base precursor-1, 300 g of a surfactant (trade name: DEMOL N, manufactured by Kao Corporation), 800 g of diphenyl sulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by IMEX Co., Ltd.). Process for dispersion includs feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor becomes 25% by weight, and filtrated (with a polypropylene filter having a mean fine pore diameter of 3 μm) for eliminating dust to put into practical use.

(Preparation of Dispersion of Solid Fine Particle of Orthochromatic Thermal Bleaching Dye)

Orthochromatic thermal bleaching dye-1 (λmax=566 nm) described in JP-A No. 11-231457 in an amount of 6.0 kg, 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total amount of 60 kg. The mixed solution was subjected to dispersion with 0.5 mm zirconia beads using a horizontal sand mill (UVM-2: manufactured by IMEX Co., Ltd.). The dispersion was dispersed until the ratio of the optical density at 650 nm and the optical density at 750 nm for the spectral absorption of the dispersion ($D_{650}/D_{750}$) becomes 5.0 or higher upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Crossover Cut Layer)

17 g of polyvinyl alcohol PVA-205 (manufactured by Kuraray Co., Ltd.), 9.6 g of polyacrylamide, 70 g of the dispersion of the solid fine particles (a) of the base precursor, 56 g of the aforementioned dispersion of the solid fine particles of the orthochromatic thermal bleaching dye (solid content of dye of 3% by weight), 0.03 g of benzoisothiazolinone, 2.2 g of sodium polystyrenesulfonate, and 844 mL of water were admixed to give a coating solution for the crossover cut layer.

3) Preparation of Coating Solution for Back Surface Protective Layer

A vessel was kept at 40° C., and thereto were added 40 g of gelatin, 35 mg of benzoisothiazolinone and 840 mL of water to allow gelatin to be dissolved. Additionally, 5.8 mL of a 1 mol/L sodium hydroxide aqueous solution, 5 g of a 10% by weight emulsion of liquid paraffin, 5 g of a 10% by weight emulsion of tri(isostearic acid)-trimethylol-propane, 10 mL of a 5% by weight aqueous solution of di(2-ethylhexyl)sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (weight ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

4) Coating of Back Layer

The back surface side of the undercoated support described above was subjected to simultaneous double coating so that the coating solution for the antihalation layer gave the coating amount of gelatin of 0.52 g/m$^2$, and so that the coating solution for the back surface protective layer gave the coating amount of gelatin of 1.7 g/m$^2$, followed by drying to produce a back layer.

Chemical structures of the compounds used in Example 4 are shown below.

Thiosulfonate compound-1

$C_2H_5SO_2SNa$

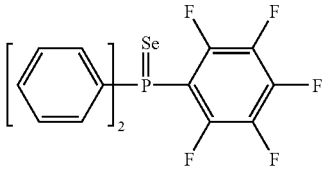

Selenium compound-1

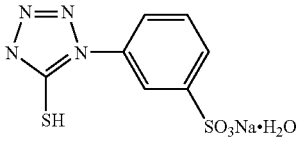

Water soluble mercapto compound-1

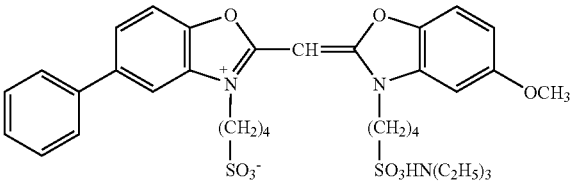

Sensitizing dye-1

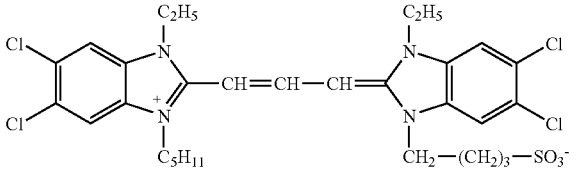

Sensitizing dye-2

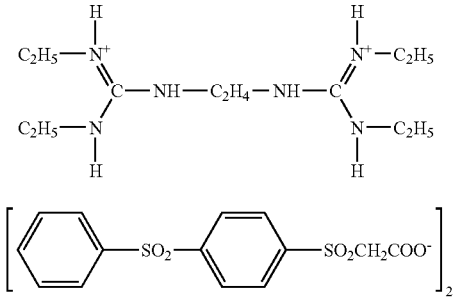

Base precursor-1

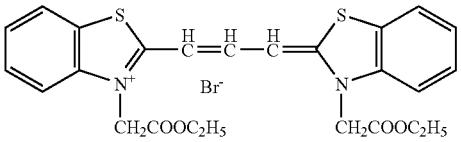

Orthochromatic thermal bleaching dye-1

2. Evaluation of Photographic Properties

Thus obtained orthochromatic sensitized single-sided coated photothermographic material was evaluated as follows.

As for fluorescent intensifying screen, the fluorescent intensifying screen UM MAMMO FINE for mammography (using as fluorescent substance, a terbium activated gadolinium oxysulfide fluorescent substance, the emission peak wavelength of 545 nm) produced by Fuji Photo Film Co., Ltd. was used. The photothermographic material and the intensifying screen were loaded in ECMA cassette produced by Fuji Photo Film Co., Ltd. so as the image forming layer of the photothermographic material came in contact with the surface protective layer of the screen. The X-ray exposure was performed after arranging so that the top plate of cassette, the photothermographic material and the screen might be set, from X-ray tube, in turn.

The commercially available mammography apparatus DRX-B1356EC produced by Toshiba Corp. was used as for X-ray source. The X-ray emitted from the molydenum target tube operated by three-phase electric power at 26 kVp, which penetrated Be of 1 mm, Mo of 0.03 mm and an acrylic filter of 2 cm, was used. By the method of distance, the exposure value of X-ray was changed. The photothermographic material was subjected to exposure for one second with a step wedge tablet having a width of 0.15 in terms of log E.

After exposure, the photothermographic material was subjected to thermal development in a similar manner to Example 1.

On the other hand, UM-MAHC film for mammographic use produced by Fuji Photo Film Co., Ltd. was subjected to X-ray exposure as the same condition as above, and processed for 90 seconds with the automatic photographic processor CEPROS-M2 and Developer CE-D1 (both produced by Fuji Photo Film Co., Ltd.) to obtain an image.

As a result of comparing photographic properties of both images, the similar excellent properties were attained.

Example 5

1. Preparation of PET Support and Undercoating

Preparation of PET support and undercoating were done similar to Example 1.

2. Preparations of Coating Materials

1) Preparations of Photosensitive Silver Halide Emulsion

<Host Emulsion 2A> (Silver Iodide Emulsion)

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Thereby a pure silver iodide emulsion (hereinafter, expressed as the host emulsion 2A) was prepared.

The obtained silver halide grains had a mean projected area equivalent diameter of 0.93 μm, a variation coefficient of a projected area equivalent diameter distribution of 17.7%, a mean thickness of 0.057 μm and a mean aspect ratio of 16.3. Tabular grains having an aspect ratio of 2 or more occupied 80% or more of the total projected area. The mean equivalent spherical diameter of the grains was 0.42 μm. 30% or more of the silver iodide existed in γ phase from the result of powder X-ray diffraction analysis.

<Photosensitive Silver Halide Emulsion 2B> (Epitaxial Silver Bromide)

1 mol of the host emulsion 2A prepared above was added to the reaction vessel. The pAg measured at 38° C. was 10.2. 0.5 mol/L potassium bromide solution and 0.5 mol/L silver nitrate solution were added at an addition speed of 10 mL/min over 20 minutes by the method of double jet addition to precipitate substantially a 10 mol % of silver bromide on the silver iodide host grains as epitaxial form while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion 2B.

<Photosensitive Silver Halide Emulsion 2C>

Preparation of silver halide emulsion 2C was conducted in a similar manner to the preparation of silver halide emulsion 2B except that: 1 mol of the host emulsion 2A described above was added to the reaction vessel, and subjected to physical ripening for 20 minutes at 75° C.; thereafter, the mixture was cooled down to 40° C., and the pAg was adjusted to be 7.5; while keeping the pAg at 7.5 during the operation, 0.5 mol/L potassium bromide solution and 0.5 mol/L silver nitrate solution were added at an addition speed of 20 mL/min over 10 minutes by the method of double jet addition; and the addition amount of tellurium sensitizer C was optimized in the chemical sensitization step. Thereby, silver halide emulsion 2C was prepared.

<Photosensitive Silver Halide Emulsion 2D>

Preparation of silver halide emulsion 2D was conducted in a similar manner to the preparation of silver halide emulsion 2B except that: 1 mol of the host emulsion 2A described above was added to the reaction vessel, and adjusted the pAg to be 7.0 at 60° C.; then the mixture was subjected to physical ripening for 20 minutes; while keeping the pAg at 7.0 during the operation, 0.5 mol/L potassium bromide solution and 0.5 mol/L silver nitrate solution were added at addition speed of 40 mL/min over 5 minutes by the method of double jet addition; and the addition amount of tellurium sensitizer C was optimized in the chemical sensitization step. Thereby, silver halide emulsion 2D was prepared.

<Photosensitive Silver Halide Emulsion 2E>

1 mol of the host emulsion 2A described above was added to the reaction vessel, and subjected to physical ripening for 20 minutes at 75° C. The mixture was cooled down to 40° C., and adjusted the pAg to be 7.5. While keeping the pAg at 7.5 during the operation, 0.5 mol/L sodium chloride solution and 0.5 mol/L silver nitrate solution were added at an addition speed of 40 mL/min over 2 minutes and 30 seconds by the method of double jet addition to precipitate substantially a 5 mol % of silver chloride on the silver iodide host grains as epitaxial form. And then, the temperature was elevated to 60° C., and the mixture was subjected to physical ripening again for 20 minutes. Thereafter, the mixture was cooled down to 40° C. By the method of double jet addition, 0.5 mol/L potassium bromide solution and 0.5 mol/L silver nitrate solution were added at an addition speed of 20 mL/min over 5 minutes. During the operation, the pAg was kept at 7.5. The following steps were conducted in a similar manner to those in the preparation of silver halide emulsion 2B except that the addition amount of tellurium sensitizer C was optimized in the chemical sensitization step. Thereby, silver halide emulsion 2E was prepared.

<Host Emulsion 2F> (Silver Iodobromide Emulsion)

1500 mL of an aqueous solution prepared by dissolving 4.1 g of potassium bromide and 14.1 g of phthalated gelatin was stirred while maintaining the temperature thereof at 40° C. An aqueous solution containing silver nitrate (2.9 g) and an aqueous solution containing potassium bromide (2.0 g) and potassium iodide (0.39 g) were added to the mixture over a period of 40 seconds. After the addition of an aqueous solution containing 35.5 g of phthalated gelatin, the temperature of the mixture was elevated to 58° C. Thereafter, as the first growth stage, an aqueous solution containing silver nitrate (63.7 g) and an aqueous potassium bromide solution containing potassium iodide were added by double jet method at increasing flow rate. The concentration of the potassium iodide was adjusted to make the silver iodide content of 15 mol %. During the operation, the pAg was kept at 8.9. On the way, a solution of potassium hexachloroiridate (III) and a solution of sodium benzene thiosulfonate were added thereto. Thereafter, as the outermost layer growth stage, an aqueous solution containing silver nitrate (7.4 g) and an aqueous potassium bromide solution containing a potassium iodide were added to the mixture over a period of 5 minutes. The concentration of the potassium iodide was adjusted to make the silver iodide content of 30 mol %. During the operation, the pAg was kept at 8.9. After water washing in a normal manner, the amount of silver and gelatin per 1 kg of the emulsion was adjusted by the addition of phthalated gelatin to be equivalent to those of silver halide emulsion 2A, and then the pH and the pAg of the resulting emulsion at 40° C. were adjusted to 5.9 and 8.4, respectively.

Thereby an unripened silver iodobromide emulsion (hereinafter expressed as host emulsion 2F) was prepared.

The obtained silver halide grains had a mean equivalent circular diameter of 0.95 μm, a variation coefficient of an equivalent circular diameter distribution of 18.3%, a mean thickness of 0.055 μm and a mean aspect ratio of 17.2. Tabular grains having an aspect ratio of 2 or more occupied 80% or more of the total projected area. The mean equivalent spherical diameter of the grains was 0.42 μm.

<Photosensitive Silver Halide Emulsion 2G>

1 mol of the host emulsion 2F prepared above was added to the reaction vessel, and adjusted the pAg to be 7.5 at 40° C. While keeping the pAg at 7.5 during the operation, 0.5 mol/L sodium chloride solution and 0.5 mol/L silver nitrate solution were added at an addition speed of 40 mL/min over 2 minutes and 30 seconds by the double jet method, to precipitate substantially 5 mol % silver chloride on the silver iodide host grains in an epitaxial form. Thereafter, while keeping the pAg at 7.5 during the operation, 0.5 mol/L potassium bromide solution and 0.5 mol/L silver nitrate solution were added at an addition speed of 20 mL/min over 5 minutes by the double jet method. The following steps were conducted in a similar manner to those in the preparation of silver halide emulsion 2E except that the addition amount of tellurium sensitizer C was optimized in the chemical sensitization step. Thereby, silver halide emulsion 2G was prepared.

Concerning the photosensitive silver halide emulsion 2B to 2E and 2G, 300 grains were sampled at random therefrom, and the dislocation lines existed in the grains were observed by a transmission electron microscope. The obtained results are given in the following Table 4. All of the emulsions had epitaxial junctions at the apex portion.

TABLE 4

| Silver halide emulsion No | Frequency of grains having at least one dislocation line (%) | Frequency of grains having reticulate dislocation line (%) |
|---|---|---|
| B | 41 | 23 |
| C | 76 | 52 |
| D | 89 | 74 |
| E | 96 | 87 |
| G | 98 | 93 |

<Preparations of Mixed Emulsion for Coating Solution>

Each of the silver halide emulsion 2B to 2E and 2G were dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide.

Further, water was added thereto to give the content of silver halide of 15.6 g in terms of silver, per 1 liter of the mixed emulsion for a coating solution.

For comparative experiments, mixed emulsions for coating solution using each of unripened emulsions of silver halide emulsion 2B to 2E and 2G were prepared.

2) Preparation of Dispersion of Silver Salt of Fatty Acid

It was done similar to Example 1.

3) Preparations of Reducing Agent Dispersion

They were done similar to Example 1.

4) Preparation of Hydrogen Bonding Compound Dispersion

It was done similar to Example 1.

5) Preparations of Development Accelerator Dispersion and Color-tone-adjusting Agent Dispersion They were done similar to Example 1.

6) Preparations of Organic Polyhalogen Compound Dispersion

They were done similar to Example 1.

7) Preparation of Silver Iodide Complex-forming Agent

It was done similar to Example 1.

8) Preparations of Aqueous Solution of Mercapto Compound

They were done similar to Example 1.

9) Preparation of SBR Latex Solution

It was done similar to Example 1.

3. Preparations of Coating Solution

1) Preparation of Coating Solution for Image Forming Layer

To the dispersion of the silver salt of fatty acid obtained as described above in an amount of 1000 g and 276 mL of water were serially added the organic polyhalogen compound-1 dispersion, the organic polyhalogen compound-2 dispersion, the SBR latex (Tg: 17° C.) solution, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the mixed emulsion for coating solution was added thereto in an amount of 0.22 mol based on silver per 1 mol of silver salt of fatty acid, followed by thorough mixing just prior to the coating, which is fed directly to a coating die.

2) Preparation of Coating Solution for Intermediate Layer

It was done similar to Example 1.

3) Preparation of Coating Solution for First Layer of Surface Protective Layers

It was done similar to Example 1.

4) Preparation of Coating Solution for Second Layer of Surface Protective Layers It was done similar to Example 1.

4. Preparations of Photothermographic Material

Simultaneous overlaying coating by a slide bead coating method was subjected on both sides of the support in order of the image forming layer, intermediate layer, first layer of the surface protective layers and second layer of the surface protective layers, and thus samples of the photothermographic material (see Table 5) were produced. In this method, the temperature of the coating solution was adjusted to 31° C. for the image forming layer and intermediate layer, to 36° C. for the first layer of the surface protective layers, and to 37° C. for the second layer of the surface protective layers. The amount of coated silver in the image forming layer was 0.821 g/m$^2$ per one side, with respect to the sum of the amounts of silver salt of fatty acid and silver halide.

The coating amount of each compound (g/m$^2$) for the image forming layer per one side is as follows.

| | |
|---|---|
| Silver salt of fatty acid | 2.80 |
| Organic polyhalogen compound-1 | 0.028 |
| Organic polyhalogen compound-2 | 0.094 |
| Silver iodide complex-forming agent | 0.46 |

-continued

| | |
|---|---|
| SBR latex | 5.20 |
| Reducing agent-1 | 0.33 |
| Reducing agent-2 | 0.13 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.146 |

Conditions for coating and drying were similar to Example 1.

Thus prepared photothermographic material had the matt degree of 550 seconds when expressed by Beck's smoothness. In addition, measurement of the pH of the film surface gave the result of 6.0.

5. Evaluation of Photographic Properties

Evaluation of photographic properties was conducted similar to Example 1, and the obtained results shown in Table 5.

TABLE 5

| Sample No | Emulsion | Kind | Unripened Emulsion | After Chemical Sensitization | Fog | Relative Dmax | Print-Out |
|---|---|---|---|---|---|---|---|
| 21 | B | AgI host + AgBr epitaxial | 100 | 100 | 0.19 | 100 | 0.02 |
| 22 | C | AgI host + AgBr epitaxial dislocation line | 186 | 209 | 0.18 | 104 | 0.02 |
| 23 | D | AgI host + AgBr epitaxial dislocation line increase | 204 | 229 | 0.18 | 113 | 0.02 |
| 24 | E | AgI host + conversion AgBr | 234 | 257 | 0.18 | 118 | 0.02 |
| 25 | G | AgBrI host + conversion AgBr | 219 | 224 | 0.19 | 107 | 0.03 |

In the table, sensitivities of both unripened and ripened emulsions for each silver halide emulsion were shown. Concerning fog and relative Dmax, only the values of ripened emulsion were shown.

It is apparent from the results shown in Table 5 that the sample No. 22 to 25, in which a dislocation line was introduced to the epitaxial part, exhibits high sensitivity by 2 to 2.5 times with respect to the comparative sample No. 21, and almost no deterioration in fog and, astonishingly exhibits almost no deterioration in print-out resistance after thermal development. Especially, it is worthy of special mention that the photothermographic materials comprising the epitaxial emulsion of the present invention having a silver iodide content of 40 mol % or higher exhibit excellent performances in sensitivity and print-out resistance.

Example 6

A double-sided coated photothermographic material was prepared similar to Example 5, except that changing the support to PEN (poly(ethylene naphthalate)).

The commercially available polyethylene-2,6-naphthalate polymer was melted at 300° C., extruded from a T-die, and the film was stretched along the longitudinal direction by 3.3 times and then stretched along the transverse direction by 3.3 times. The temperatures used for these operations were 140° C., respectively. Then the film was subjected to thermal fixation at 250° C. for 6 seconds to give the film having a thickness of 175 μm. The corona treatment of the support was performed as follows. The surface of the support having a width of 30 cm was treated at 20 m/minute using a Solid State Corona Discharge Treatment Machine Model 6KVA manufactured by Pillar GmbH. It was proven that treatment of 0.375 KV·A·minute·$m^{-2}$ was executed, judging from the readings of current and voltage on that occasion. The frequency upon this treatment was 9.6 KHz and the gap clearance between the electrode and the dielectric roll was 1.6 mm. Coating of undercoat layer was performed in a similar manner to the process in the preparation of the support of Example 1.

The obtained double-sided coated photothermographic material was evaluated as follows. As for the fluorescent intensifying screen, Ultravision Fast Detail (UV) produced by Du Pont Co., Ltd. was used. Both sides of the photothermographic material of the invention were contacted with the screens, and the combination was subjected to X-ray exposure for 0.05 seconds to make X-ray sensitometry. The exposure value was adjusted by changing the distance between the X-ray tube and the cassette.

After exposure, thermal development was performed in a similar manner to Example 5.

The results with excellent images similar to those of Example 5 were obtained.

Example 7

1. Preparation of PET Support and Undercoating

Preparation of PET support and undercoating were done similar to Example 1.

2. Preparations of Coating Material

1) Preparations of Photosensitive Silver Halide Emulsion <Host Emulsion 3A>

A solution was prepared by adding 4.3 mL of a 1% by weight potassium iodide solution, and then 3.5 mL of 0.5 mol/L sulfuric acid, 36.5 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

Thereby an unripened pure silver iodide emulsion (hereinafter, expressed as the host emulsion 3A) was prepared.

The obtained silver halide grains had a mean projected area equivalent diameter of 0.93 μm, a variation coefficient of a projected area equivalent diameter distribution of 17.7%, a mean thickness of 0.057 Mm and a mean aspect ratio of 16.3. Tabular grains having an aspect ratio of 2 or more occupied 80% or more of the total projected area. The mean equivalent spherical diameter of the grains was 0.42 μm. 30% or more of the silver iodide existed in γ phase from the result of powder X-ray diffraction analysis.

<Photosensitive Silver Halide Emulsion 3B1>

1 mol of the host emulsion 3A prepared above was added to the reaction vessel. The pAg measured at 38° C. was 10.2. 0.5 mol/L potassium bromide solution and 0.5 mol/L silver nitrate solution were added at an addition speed of 2.5 mL/min over 80 minutes by the method of double jet addition, while keeping the pAg at 10.2 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The above-mentioned silver halide dispersion was kept at 38° C. with stirring, and thereto was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $7.6\times10^{-5}$ mol per 1 mol of silver. At additional 5 minutes later, tellurium sensitizer C in a methanol solution was added at $2.9\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $8.5\times10^{-3}$ mol per 1 mol of silver were added to produce silver halide emulsion 3B1.

<Photosensitive Silver Halide Emulsion 3B2>

Preparation of silver halide emulsion 3B2 was conducted in a similar manner to the preparation of silver halide emulsion 3B1 except that: 1 mol of the host emulsion 3A was added to the reaction vessel, and adjusted the pAg to be 6.7 at 75° C.; while keeping the pAg at 6.7 during the operation, 0.5 mol/L potassium bromide solution and 0.5 mol/L silver nitrate solution were added at an addition speed of 5 mL/min over 40 minutes by the method of double jet addition; and the addition amount of tellurium sensitizer C was optimized in the chemical sensitization step. Thereby, silver halide emulsion 3B2 was prepared.

<Photosensitive Silver Halide Emulsion 3B3>

Preparation of silver halide emulsion 3B3 was conducted in a similar manner to the preparation of silver halide emulsion 3B2 except that: 1 mol of the host emulsion 3A was added to the reaction vessel, and adjusted the pAg to be 6.7 at 75° C.; while keeping the pAg at 6.7 during the operation, 0.5 mol/L potassium bromide solution and 0.5 mol/L silver nitrate solution were added at an addition speed of 5 mL/min over 20 minutes by the method of double jet addition; thereafter, the mixture was cooled down to 40° C.; and then the pAg of the mixture was adjusted to 7.5 at 40° C.; while keeping the pAg at 7.5 during the operation, 0.5 mol/L potassium bromide solution and 0.5 mol/L silver nitrate solution were added at an addition speed of 10 mL/min over 10 minutes by the method of double jet addition; and the addition amount of tellurium sensitizer C was optimized in the chemical sensitization step. Thereby, silver halide emulsion 3B3 was prepared.

<Preparation of Silver Halide Emulsion 3B4>

Preparation of silver halide emulsion 3B4 was conducted in a similar manner to the preparation of silver halide emulsion 3B2 except that: 1 mol of the host emulsion 3A was added to the reaction vessel, and adjusted the pAg to be 6.7 at 75° C.; while keeping the pAg at 6.7 during the operation, 0.5 mol/L potassium bromide solution and 0.5 mol/L silver nitrate solution were added at an addition speed of 5 mL/min over 8 minutes by the method of double jet addition; thereafter, the mixture was cooled down to 40° C.; and then the pAg of the mixture was adjusted to 7.5 at 40° C.; while keeping the pAg at 7.5 during the operation, 0.5 mol/L potassium bromide solution and 0.5 mol/L silver nitrate solution were added at an addition speed of 10 mL/min over 16 minutes by the method of double jet addition; and the addition amount of tellurium sensitizer C was optimized in the chemical sensitization step. Thereby, silver halide emulsion 3B4 was prepared.

<Photosensitive Silver Halide Emulsion 3B5>

Preparation of silver halide emulsion 3B5 was conducted in a similar manner to the preparation of silver halide emulsion 3B2 except that: 1 mol of the host emulsion 3A was added to the reaction vessel, and adjusted the pAg to be 6.7 at 75° C.; while keeping the pAg at 6.7 during the operation, 0.5 mol/L potassium bromide solution and 0.5 mol/L silver nitrate solution were added at an addition speed of 5 mL/min over 8 minutes by the method of double jet addition; thereafter, the mixture was cooled down to 25° C.; and then the pAg of the mixture was adjusted to 8.0 at 25° C.; while keeping the pAg at 8.0 during the operation, 0.5 mol/L potassium bromide solution and 0.5 mol/L silver nitrate solution were added at an addition speed of 8 mL/min over 20 minutes by the method of double jet addition; and the addition amount of tellurium sensitizer C was optimized in the chemical sensitization step. Thereby, silver halide emulsion 3B5 was prepared.

<Photosensitive Silver Halide Emulsion 3B6>

Preparation of silver halide emulsion 3B6 was conducted in a similar manner to the preparation of silver halide emulsion 3B2 except that: 1 mol of the host emulsion 3A was added to the reaction vessel, and adjusted the pAg to be 7.0 at 60° C.; while keeping the pAg at 7.0 during the operation, 0.5 mol/L potassium bromide solution and 0.5 mol/L silver nitrate solution were added at an addition speed of 5 mL/min over 8 minutes by the method of double jet addition; thereafter, the mixture was cooled down to 50° C.; and then the pAg of the mixture was adjusted to 7.3 at 50° C.; while keeping the pAg at 7.3 during the operation, 0.5 mol/L potassium bromide solution and 0.5 mol/L silver nitrate solution were added at an addition speed of 10 mL/min over 16 minutes by the method of double jet addition; and the addition amount of tellurium sensitizer C was optimized in the chemical sensitization step. Thereby, silver halide emulsion 3B6 was prepared.

<Photosensitive Silver Halide Emulsion 3B7>

Preparation of silver halide emulsion 3B7 was conducted in a similar manner to the preparation of silver halide emulsion 3B2 except that: 1 mol of the host emulsion 3A was added to the reaction vessel, and adjusted the pAg to be 7.0 at 60° C.; while keeping the pAg at 7.0 during the operation, 0.5 mol/L potassium bromide solution and 0.5 mol/L silver nitrate solution were added at an addition speed of 5 mL/min over 8 minutes by the method of double jet addition; thereafter, the mixture was cooled down to 25° C.; and then the pAg of the mixture was adjusted to 8.0 at 25° C.; while keeping the pAg at 8.0 during the operation, 0.5 mol/L potassium bromide solution and 0.5 mol/L silver nitrate solution were added at an addition speed of 8 mL/min over 20 minutes by the method of double jet addition; and the addition amount of tellurium sensitizer C was optimized in the chemical sensitization step. Thereby, silver halide emulsion 3B7 was prepared.

<Photosensitive Silver Halide Emulsion 3B8>

1500 mL of an aqueous solution prepared by dissolving 4.1 g of potassium bromide and 14.1 g of phthalated gelatin was stirred while maintaining the temperature thereof at 40° C. An aqueous solution containing silver nitrate (2.9 g) and an aqueous solution containing potassium bromide (2.0 g) and potassium iodide (0.39 g) were added to the mixture over a period of 40 seconds. After the addition of an aqueous solution containing 35.5 g of phthalated gelatin, the temperature of the mixture was elevated to 58° C. Thereafter, as the first growth stage, an aqueous solution containing silver nitrate (63.7 g) and an aqueous potassium bromide solution containing a potassium iodide were added by double jet method at increasing flow rate. The concentration of the potassium iodide was adjusted to make the silver iodide content of 0.5 mol %. During the operation, the pAg was kept at 8.9. On the way, a solution of potassium hexachloroiridate (III) and a solution of sodium benzene thiosulfonate were added thereto. Thereafter, as the outermost layer growth stage, an aqueous solution containing silver nitrate (7.4 g) and an aqueous potassium bromide solution containing potassium iodide were added to the mixture over a period of 5 minutes. The concentration of the potassium iodide was adjusted to make the silver iodide content of 10 mol %. During the operation, the pAg was kept at 8.9. After water washing in a normal manner, the amounts of silver and gelatin per 1 kg of the emulsion were adjusted by the addition of phthalated gelatin to be equivalent to those of silver halide emulsion 3A, and then the pH and the pAg of the resulting emulsion at 40° C. were adjusted to 5.9 and 8.4, respectively.

The obtained silver halide grains had a mean equivalent circular diameter of 0.95 μm, a variation coefficient of an equivalent circular diameter distribution of 12.6%, a mean thickness of 0.055 μm and a mean aspect ratio of 17.2. Tabular grains having an aspect ratio of 2 or more occupied 80% or more of the total projected area. The mean equivalent spherical diameter of the grains was 0.42 μm.

Preparation of silver halide emulsion 3B8 was conducted in a similar manner to the preparation of silver halide emulsion 3B1 except that: 1 mol of this unripened emulsion was added to the reaction vessel, and adjusted the pAg to be 8.0 at 25° C.; while keeping the pAg at 8.0 during the operation, 0.5 mol/L potassium bromide solution and 0.5 mol/L silver nitrate solution were added at an addition speed of 5 mL/min over 40 minutes by the method of double jet addition; and the addition amount of tellurium sensitizer C was optimized in the chemical sensitization step. Thereby, silver halide emulsion 3B8 was prepared.

Concerning the photosensitive silver halide emulsion 3B1 to 3B8, the frequency of grains having epitaxial junctions, the average silver iodide content of the epitaxial junction parts, and the surface silver iodide content of the epitaxial junction parts were measured. The results of the measurements are shown in Table 6. All of the emulsions had epitaxial junctions at the apex portion.

TABLE 6

| Silver halide No | Frequency of grains having epitaxial junctions (%) | Average silver iodide content of epitaxial junction parts (mol %) | Surface silver iodide content of epitaxial junction parts (mol %) |
|---|---|---|---|
| B1 | 43 | 5 | 8 |
| B2 | 91 | 24 | 35 |
| B3 | 91 | 10 | 14 |
| B4 | 91 | 8 | 10 |
| B5 | 91 | 4 | 7 |
| B6 | 86 | 9 | 12 |
| B7 | 86 | 2 | 5 |
| B8 | 94 | 1 | 3 |

<Preparations of Mixed Emulsion-31 to -38 for Coating Solution>

Each of the silver halide emulsion 3B1 to 3B8 was dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide. Further, water was added thereto to give the content of silver halide of 15.6 g in terms of silver, per 1 liter of the mixed emulsion for a coating solution.

As for silver halide emulsion 3B8, sensitizing dye-1, -2, and -3 were added in an amount of $1.3\times10^{-3}$ mol per 1 mol of silver halide, respectively, just prior to the coating.

Sensitizing dye-1

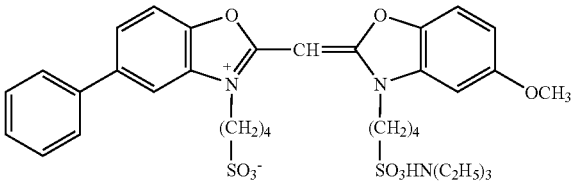

Sensitizing dye-2

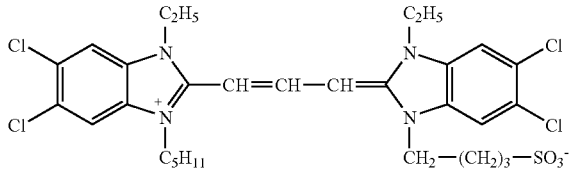

Sensitizing dye-3

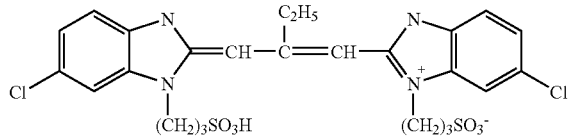

2) Preparation of Dispersion of Silver Salt of Fatty Acid

It was done similar to Example 1.

3) Preparation of Reducing Agent Dispersion

<Preparation of Reducing Agent-3 Dispersion>

To 10 kg of reducing agent-3 (1,1-bis(2-hydroxy-3,5-dimethylphenyl)-3,5,5-trimethylhexane) and 16 kg of a 10% by weight aqueous solution of modified polyvinyl alcohol (manufactured by Kuraray Co., Ltd., Poval MP203) is added 10 kg of water, and thoroughly mixed to give a slurry. This slurry is fed with a diaphragm pump, and is subjected to dispersion with a horizontal sand mill (UVM-2: manufactured by IMEX Co., Ltd.) packed with zirconia beads having a mean particle diameter of 0.5 mm for 3 hours. Thereafter, 0.2 g of a benzoisothiazolinone sodium salt and water are added thereto, thereby adjusting the concentration of the reducing agent to be 25% by weight. This dispersion is subjected to heat treatment at 60° C. for 5 hours to obtain reducing agent-3 dispersion. Particles of the reducing agent included in the resulting reducing agent dispersion have a median diameter of 0.40 μm, and a maximum particle diameter of 1.4 μm or less. The resultant reducing agent dispersion is subjected to filtration with a polypropylene filter having a pore size of 3.0 μm to remove foreign substances such as dust, and stored.

4) Preparation of Nucleator Dispersion 2.5 g of polyvinyl alcohol (manufactured by Kuraray Co., Ltd., PVA-217) and 87.5 g of water are added to 10 g of nucleator SH-7, and thoroughly admixed to give a slurry. This slurry is allowed to stand for 3 hours. Zirconia beads having a mean particle diameter of 0.5 mm are provided in an amount of 240 g, and charged in a vessel with the slurry. Dispersion is performed with a dispersing machine (1/4G sand grinder mill: manufactured by IMEX Co., Ltd.) for 10 hours to obtain a solid fine particle dispersion of nucleator. Particles of the nucleator included in the resulting nucleator dispersion have a mean particle diameter of 0.5 μm, and 80% by weight of the particles has a particle diameter of 0.1 μm to 1.0 μm.

5) Preparation of Hydrogen Bonding Compound Dispersion

It was done similar to Example 1.

6) Preparations of Development Accelerator Dispersion and Color-tone-adjusting Agent Dispersion They were done similar to Example 1.

7) Preparations of Organic Polyhalogen Compound Dispersion

They were done similar to Example 1.

8) Preparation of Silver Iodide Complex-forming Agent

It was done similar to Example 1.

9) Preparations of Aqueous Solution of Mercapto Compound

They were done similar to Example 1.

10) Preparation of SBR Latex Solution

It was done similar to Example 1.

3. Preparations of Coating Solution

1) Preparation of Coating Solution for Crossover Cut Layer 17 g of polyvinyl alcohol PVA-205 (manufactured by Kuraray Co., Ltd.), 9.6 g of polyacrylamide, 4.2 g of the following ultraviolet absorber-1, 0.03 g of benzoisothiazolinone, 2.2 g of sodium polystyrenesulfonate, and 844 mL of water were admixed to give a coating solution for the crossover cut layer.

The coating solution for the crossover cut layer was fed to the coating station by controlling the flow speed of the coating solution to give the coating amount of solid content of the ultraviolet absorber-1 of 0.04 g/m$^2$.

Ultraviolet absorber-1

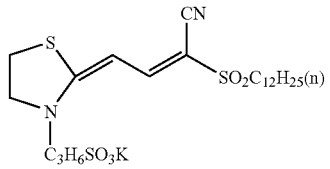

2) Preparation of Coating Solution for Image Forming Layer-31 to -38

To the dispersion of the silver salt of fatty acid obtained as described above in an amount of 1000 g and 276 mL of water were serially added the organic polyhalogen compound-1 dispersion, the organic polyhalogen compound-2 dispersion, the SBR latex (Tg: 17° C.) solution, the reducing agent-3 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the mixed emulsion for coating solution was added thereto in an amount of 0.255 mol per 1 mol of silver salt of fatty acid, followed by thorough mixing just prior to the coating, which is fed directly to a coating die.

3) Preparation of Coating Solution for Intermediate Layer

It was done similar to Example 1.

4) Preparation of Coating Solution for First Layer of Surface Protective Layers

It was done similar to Example 1.

5) Preparation of Coating Solution for Second Layer of Surface Protective Layers It was done similar to Example 1.

4. Preparations of Photothermographic Matrial-31 to -38

Simultaneous overlaying coating by a slide bead coating method was subjected in order of the crossover cut layer, the image forming layer, intermediate layer, first layer of the surface protective layers and second layer of the surface protective layers, starting from the undercoated face, and thus sample of the photothermographic material was produced. In this method, the temperature of the coating solution was adjusted to 31° C. for the image forming layer and intermediate layer, to 36° C. for the first layer of the surface protective layers, and to 37° C. for the second layer of the surface protective layers. The amount of coated silver in the image forming layer was 0.862 g/m$^2$ per one side, with respect to the sum of the amounts of silver salt of fatty acid and silver halide. This was coated on both sides of the support.

The coating amount of each compound (g/m$^2$) for the image forming layer per one side is as follows.

| | |
|---|---|
| Silver salt of fatty acid | 2.85 |
| Organic polyhalogen compound-1 | 0.028 |
| Organic polyhalogen compound-2 | 0.094 |
| Silver iodide complex forming agent | 0.46 |
| SBR latex | 5.20 |
| Reducing agent-3 | 0.46 |
| Nucleator-1 | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Chemical structures of the compounds used in Examples of the invention are shown below.

Reducing agent-3

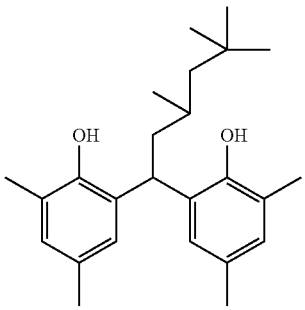

Conditions for coating and drying were similar to Example 1.

5. Evaluation of Photographic Properties

1) Preparation

It was done similar to Example 1.

2) Exposure and Thermal Development

<Exposure>

As for the sample-31 to -37, two sets of X-ray regular screen HI-SCREEN B3 ($CaWO_4$ is used as fluorescent substance, the emission peak wavelength of 425 nm) produced by Fuji Photo Film Co., Ltd. were used. The assembly for image formation was provided by inserting the sample between them.

As for the sample-38, two sets of X-ray Orthochomatic Screen HG-M (using as fluorescent substance a terbium activated gadolinium oxysulfide fluorescent substance, emission peak wavelength of 545 nm) produced by Fuji Photo Film Co., Ltd. were used. The assembly for image formation was provided by inserting the sample between them.

This assembly was subjected to X-ray exposure for 0.05 seconds, and then X-ray sensitometry is performed. The X-ray apparatus used was DRX-3724HD (trade name) produced by Toshiba Corp., and a tungsten target tube was used. X-ray emitted by a pulse generator operated at three phase voltage of 80 kvp and penetrated through a filter comprising 7 cm thickness of water having the absorption ability almost the same as human body was used as the light source. By the method of distance, varying the exposure value of X-ray, the sample was subjected to exposure with a step wedge tablet having a width of 0.15 in terms of log E.

<Thermal Development>

The thermal developing portion of Fuji Medical Dry Laser Imager FM-DP L was modified so that it can heat from both sides, and by another modification the transportation rollers in the thermal developing portion were changed to the heating drum so that the sheet of film could be conveyed. The temperature of four panel heaters were set to 112° C.-118° C.- 120° C.- 120° C., and the temperature of the heating drum was set to 120° C. By increasing the speed of transportation, the total time period for thermal development was set to be 14 seconds.

After thermal developing the sample on the above condition, densities of the obtained image were measured by using a Macbeth densitometer.

3) Evaluation Items

Fog: The optical density of the unexposed part was defined as fog.

Sensitivity: Sensitivity was represented as the inverse of the exposure value giving image density of fog+0.2. The sensitivities are shown in relative value, detecting the sensitivity of Sample No. 32 to be 100.

Raw stock storability: Each sample was stored under the environment of 45° C. and 40% RH for 3 days. Thereafter similar processing was performed.

TABLE 7

| Sample No | Photosensitive Silver Halide Emulsion No | Kind | Photographic Properties Fog | Photographic Properties Sensitivity | Raw Stock Storability Fog | Raw Stock Storability Sensitivity |
|---|---|---|---|---|---|---|
| 31 | B1 | Low silver iodide content polydispersed epitaxial emulsion | 0.19 | 65 | 0.23 | 49 |
| 32 | B2 | High silver iodide content epitaxial emulsion | 0.18 | 100 | 0.21 | 76 |
| 33 | B3 | Low silver iodide content epitaxial emulsion | 0.18 | 174 | 0.22 | 141 |
| 34 | B4 | Low silver iodide content epitaxial emulsion | 0.18 | 195 | 0.2 | 157 |
| 35 | B5 | Low silver iodide content epitaxial emulsion | 0.19 | 219 | 0.2 | 180 |
| 36 | B6 | Low silver iodide content epitaxial emulsion | 0.19 | 178 | 0.22 | 149 |
| 37 | B7 | Low silver iodide content epitaxial emulsion | 0.18 | 246 | 0.2 | 198 |
| 38 | B8 | Low silver iodide content epitaxial emulsion | 0.19 | 239 | 0.21 | 203 |

4) Results

The obtained results are shown in Table 7.

It is apparent from the results shown in Table 7 that the sample Nos. 33 to 38 of the invention which contain grains having a low silver iodide content in the epitaxial junction parts, exhibit high sensitivity by about 1.7 to 2.4 times with respect to the comparative sample No. 32, and almost no deterioration in fog and, astonishingly exhibits almost no deterioration in raw stock storability. Especially, it is worthy of special mention that the photothermographic materials comprising the epitaxial emulsion having a surface silver iodide content of the epitaxial parts of 10 mol % or lower exhibit excellent performances in raw stock storability.

Example 8

A double-sided coated photothermographic material was prepared in a similar manner to Example 7 except that the support was changed to PEN (polyethylene naphthalene).

The commercially available polyethylene-2,6-naphthalate polymer was melted at 300° C., extruded from a T-die, and the film was stretched along the longitudinal direction by 3.3 times and then stretched along the transverse direction by 3.3 times. The temperatures used for these operations were 140° C., respectively. Then the film was subjected to thermal fixation at 250° C. for 6 seconds to give the film having a thickness of 175 μm. The corona treatment of the support was performed as follows. The surface of the support having a width of 30 cm was treated at 20 m/minute using a Solid State Corona Discharge Treatment Machine Model 6KVA manufactured by Pillar GmbH. It was proven that treatment of 0.375 KV·A·minute·$m^{-2}$ was executed, judging from the readings of current and voltage on that occasion. The frequency upon this treatment was 9.6 KHz and the gap clearance between the electrode and the dielectric roll was 1.6 mm. Coating of undercoat layer was performed in a similar manner to the process in the preparation of the support of Example 7.

The obtained double-sided coated photothermographic material was evaluated as follows. As for the fluorescent intensifying screen, Ultravision Fast Detail (UV) produced by Du Pont Co., Ltd. was used. Both sides of the photothermographic material of the invention were contacted with the screens, and the combination was subjected to X-ray exposure for 0.05 seconds to make X-ray sensitometry. The exposure value was adjusted by changing the distance between the X-ray tube and the cassette.

After exposure, thermal development was performed in a similar manner to Example 7.

The results with excellent images similar to those of Example 7 were obtained.

Example 9

1. Preparation of Photosensitive Silver Halide Emulsion

Preparation of Silver Halide Emulsion 3C1 was conducted in a similar manner to the preparation of silver halide emulsion 3B1 of Example 7 except that the temperature of the chemical sensitization step was changed from 47° C. to 37° C., and tellurium sensitizer C was changed to sulfur sensitizer No. 1 which is shown in the specific examples, and the addition amount thereof was optimized. Thereby, silver halide emulsion 3C1 was prepared. Silver halide emulsion 3C2 to 3C8 were prepared by performing the similar modification set forth above to the silver halide emulsion 3B2 to 3B8, respectively.

2. Preparation of Coated Sample

Double-sided coated photothermographic material-41 to -48 were prepared using the photosensitive silver halide emulsion 3C1 to 3C8 in the similar manner in Example 7, and were evaluated similar to Example 7.

3. Results of Evaluation

The obtained results are shown in Table 8.

It is apparent from Table 8 that the sample Nos. 43 to 48 of the invention, which comprise grains having a low silver iodide content in the epitaxial junction parts, exhibit high sensitivity by about 1.8 to 2.6 times with respect to the comparative sample No. 42 and exhibit almost no deterioration in fog and in raw stock storability astonishingly. Especially, it is worthy of special mention that the photothermographic materials using the epitaxial emulsion having a surface silver iodide content of the epitaxial parts of 10% or less attain improvement in sensitivity reduction when the raw materials are stocked.

TABLE 8

| Sample | Photosensitive Silver Halide Emulsion | | Photographic Properties | | Raw Stock Storability | |
|---|---|---|---|---|---|---|
| No | No | Kind | Fog | Sensitivity | Fog | Sensitivity |
| 41 | C1 | Low silver iodide content polydispersed epitaxial emulsion | 0.19 | 67 | 0.24 | 52 |
| 42 | C2 | High silver iodide content epitaxial emulsion | 0.2 | 100 | 0.23 | 78 |
| 43 | C3 | Low silver iodide content epitaxial emulsion | 0.21 | 182 | 0.24 | 147 |
| 44 | C4 | Low silver iodide content epitaxial emulsion | 0.21 | 200 | 0.23 | 167 |
| 45 | C5 | Low silver iodide content epitaxial emulsion | 0.2 | 229 | 0.23 | 191 |
| 46 | C6 | Low silver iodide content epitaxial emulsion | 0.2 | 191 | 0.24 | 153 |
| 47 | C7 | Low silver iodide content epitaxial emulsion | 0.21 | 257 | 0.23 | 216 |
| 48 | C8 | Low silver iodide content epitaxial emulsion | 0.23 | 257 | 0.25 | 226 |

Example 10

1. Preparations of Silver Halide Emulsion D44 to D46

Preparations of silver halide emulsion D44 to D46 were conducted in a similar manner to the preparation of silver halide emulsion 3B3 of Example 7, except that the 0.5 mol/L potassium bromide solution used in the twice double jet additions was changed to a solution containing 0.4 mol of potassium bromide and 0.1 mol of sodium chloride per 1 liter, a solution containing 0.35 mol of potassium bromide and 0.15 mol of sodium chloride per 1 liter, or a solution containing 0.3 mol of potassium bromide and 0.2 mol of sodium chloride per 1 liter, respectively.

Concerning the photosensitive silver halide emulsion D44 to D46 prepared newly and silver halide emulsion 3B2 and 3B3, the frequency of grains having epitaxial junctions, the average silver iodide content of the epitaxial junction parts, and the surface silver iodide content of the epitaxial junction parts were measured. The results of the measurements are shown in Table 9.

TABLE 9

| Silver halide No | Frequency of grains having epitaxial junction (%) | Average silver iodide content of epitaxial junction parts (mol %) | Surface silver iodide content of epitaxial junction parts (mol %) |
|---|---|---|---|
| B2 | 91 | 24 | 35 |
| B3 | 91 | 10 | 14 |
| D44 | 89 | 9 | 12 |
| D45 | 86 | 8 | 10 |
| D46 | 85 | 8 | 10 |

2. Preparation of Coated Sample

Double-sided coated photothermographic material-53 to -55 were prepared in the similar manner in Example 7, except that using the photosensitive silver halide emulsion D44 to D46 respectively. Double-sided coated photothermographic material-51 and -52 were prepared using again the photosensitive silver halide emulsion 3B2 and 3B3 respectively.

3. Results of Evaluation

The results were evaluated similar to Example 7, and the obtained results are shown in Table 10.

It is apparent from the results in Table 10 that the photothermographic materials according to the present invention (sample Nos. 52 to 55) exhibit excellent performance in high sensitivity by about 2 times with respect to the comparative sample No. 51, and almost no deterioration in fog and astonishingly, exhibit almost no deterioration in raw stock storability, similar to Example 7. Especially, the photothermographic materials using silver halide emulsion D44 to D46 containing a silver chloride in the epitaxial parts attain improvement in sensitivity, extreme depression of fog and extreme improvement in raw stock storability. Those results can not be expected entirely from the information until now.

TABLE 10

| Sample | Photosensitive Silver Halide Emulsion | | Photographic Properties | | Raw Stock Storability | |
|---|---|---|---|---|---|---|
| No | No | Kind | Fog | Sensitivity | Fog | Sensitivity |
| 51 | B2 | High silver iodide content epitaxial emulsion | 0.18 | 100 | 0.21 | 76 |
| 52 | B3 | Low silver iodide content epitaxial emulsion | 0.18 | 174 | 0.22 | 141 |
| 53 | D44 | Low silver iodide content epitaxial emulsion | 0.18 | 182 | 0.22 | 147 |
| 54 | D45 | Low silver iodide content epitaxial emulsion | 0.18 | 200 | 0.21 | 161 |
| 55 | D46 | Low silver iodide content epitaxial emulsion | 0.18 | 190 | 0.21 | 154 |

Example 11

1. Preparations of Silver Halide Emulsion

Preparations of silver halide emulsion D47 and D48 were conducted in a similar manner to the process in the preparation of silver halide emulsion D44 of Example 10 except that the composition ratio of the potassium bromide solution and the sodium chloride solution was changed. Thereby, silver halide emulsion D47 having a silver chloride content of the epitaxial parts of 2 mol %, and silver halide emulsion D48 having a silver chloride content of the epitaxial parts of 75 mol % were prepared.

2. Preparations of Coated Sample

Double-sided coated photothermographic materials were prepared in a similar manner to the preparation of photothermographic material-53 of Example 10 except that using the silver halide emulsion D47 or D48.

3. Results of Evaluation of Photographic Properties

Evaluation was performed similar to Example 10. The photothermographic material using silver halide emulsion D47 give a similar result of the material using silver halide emulsion B3, where high sensitivity is attained as the effect of the present invention, but minor improvement in the depression of fog and raw stock storability. The material using silver halide emulsion D48 attain the depression of fog as the purpose of the invention, but show a drawback to depress the maximum density.

Therefore, it is understood from the results that preferred range of the silver chloride content exsists in the case where silver halide in the epitaxial junction parts is silver chlorobromide.

Example 12

Preparations of new silver halide emulsion were conducted in a similar manner to the preparation of silver halide emulsion D44 and D45 of Example 10 except that the chemical sensitization condition was changed to 60 minutes at 60° C., and the addition amount of tellurium sensitizer C was optimized. Coated samples were prepared using each of these emulsions in a similar manner to Example 10. Evaluation of photographic properties was performed similar to that in Example 10. The photothermographic materials exhibit extremely preferable result in low fog, high sensitivity, and improved raw stock storability similar to Example 10.

Example 13

1. Preparation of Fluorescent Intensifying Screen A (1) Preparation of Undercoat Layer A light reflecting layer comprising alumina powder was coated on a polyethylene terephthalate film (support) having a thickness of 250 μm in a similar manner to Example 4 in JP-A. No. 2001-124898. The light reflecting layer which had a film thickness of 50 μm after drying, was prepared.

(2) Preparation of Fluorescent Substance Sheet 250 g of BaFBr:Eu fluorescent substance (mean particle size of 3.5 μm), 8 g of polyurethane type binder resin (manufactured by Dai Nippon Ink & Chemicals, Inc., trade name: PANDEX T5265M), 2 g of epoxy type binder resin (manufactured by Yuka Shell Epoxy Co., Ltd., trade name: EPIKOTE 1001) and 0.5 g of isocyanate compounds (manufactured by Nippon Polyurethane Industry Co., Ltd., trade name: CORONATE HX) were added into methylethylketone, and the mixture was then dispersed by a propeller mixer to prepare the coating solution for the fluorescent substance layer having a viscosity of 25 PS (25° C.). This coating solution was coated on the surface of a temporary support (pretreated by coating a silicone agent on the surface of polyethylene terephthalate film), and dried to make the fluorescent substance layer. Thereafter, the fluorescent substance sheet was prepared by peeling the fluorescent substance layer from the temporary support.

(3) Overlaying the Fluorescent Substance Sheet on Light Reflective Layer.

The fluorescent substance sheet prepared above was overlaid on the surface of the light reflective layer of the support having a light reflective layer made in the above process (1), and then pressed by a calendar roller at the pressure of 400 kgw/cm$^2$ and the temperature of 80° C. to form the fluorescent substance layer on the light reflective layer. The thickness of the obtained fluorescent substance layer was 125 μm and the volume filling factor of fluorescent substance particles in the fluorescent substance layer was 68%.

(4) Preparation of Surface Protective Layer

Polyester type adhesive agents were coated on one side of a polyethylene terephthalate (PET) film having a thickness of 6 μm, and thereafter the surface protective layer was formed on the fluorescent substance layer by a laminating method. As described above, the fluorescent intensifying screen A comprising a support, a light reflective layer, a fluorescent substance layer and a surface protective layer was prepared.

(5) Emission Characteristics

The emission spectrum of the intensifying screen A was measured by X-ray at 40 kVp and is shown in FIG. 1. The fluorescent intensifying screen A showed an emission having a peak at 390 nm and a narrow half band width.

2. Evaluation of Photographic Properties

Using the sample-31 to -38 of Example 7, evaluation was performed similar to Example 7 except that changing the screen used at exposure to the fluorescent intensifying screen A. Excellent results similar to those of Example 7 were obtained by using the photothermographic material of the present invention.

Example 14

1. Preparations of Fluorescent Intensifying Screen

Preparations of fluorescent intensifying screen C, D and E were conducted in a similar manner to the process in the preparation of fluorescent intensifying screen A, except that changing the coating amount of the fluorescent substance coating solution. The thickness of the fluorescent substance layer and the volume filling factor of the fluorescent substance in the fluorescent intensifying screen prepared above are shown in Table 11.

TABLE 11

| Fluorescent Intensifying Screen | Fluorescent Substance | Thickness of Fluorescent Substance Layer (μm) | Volume Filling Factor of Fluorescent Substance (%) |
|---|---|---|---|
| A | BaFBr:Eu | 125 | 68 |
| C | BaFBr:Eu | 70 | 70 |
| D | BaFBr:Eu | 160 | 66 |
| E | BaFBr:Eu | 250 | 64 |

2. Evaluation of Photographic Properties

The double-sided coated photothermographic material-31 to -38 were subjected to an X-ray exposure in combination with the fluorescent intensifying screen as described below instead of using the fluorescent intensifying screen A in Example 13. The frontscreen used herein means a screen located in near side to X-ray source against the material, and the backscreen herein means a screen located in far side from X-ray source.

The photothermographic material of the present invention gives preferable results similar to those in Example 13.

Moreover, using the photothermographic material-52 to -55 of Example 10, more excellent results were attained.

TABLE 12

| Frontscreen | Backscreen |
|---|---|
| A | A |
| C | C |
| C | A |
| C | D |
| C | E |
| A | E |

Example 15

1. Preparations of Photothermographic Material

Preparations of photothermographic material were conducted as described below similar to Example 7.

1) Preparations of Coating Materials (1) Preparations of Photosensitive Silver Halide Emulsion <Photosensitive Silver Halide Emulsion 4A>

This is an emulsion having host grains.

A solution was prepared by adding 4.3 mL of a 1% by weight potassium iodide solution, and then 3.5 mL of 0.5 mol/L sulfuric acid, 4.6 g of phthalated gelatin, and 160 mL of a 5% by weight methanol solution of 2,2'-(ethylene dithio)diethanol to 1421 mL of distilled water. The solution was kept at 75° C. while stirring in a stainless steel reaction vessel, and thereto were added total amount of: solution A prepared through diluting 22.22 g of silver nitrate by adding distilled water to give the volume of 218 mL; and solution B prepared through diluting 36.6 g of potassium iodide with distilled water to give the volume of 366 mL. A method of controlled double jet was executed through adding total amount of the solution A at a constant flow rate over 16 minutes, accompanied by adding the solution B while maintaining the pAg at 10.2. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 508.2 mL and a solution D prepared through diluting 63.9 g of potassium iodide with distilled water to give the volume of 639 mL were added. A method of controlled double jet was executed through adding total amount of the solution C at a constant flow rate over 80 minutes, accompanied by adding the solution D while maintaining the pAg at 10.2. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 11.0.

The obtained silver halide grains had a mean projected area equivalent diameter of 1.6 μm, a variation coefficient of a projected area equivalent diameter distribution of 14.4%, a mean thickness of 0.082 μm and a mean aspect ratio of 19.5. Tabular grains having an aspect ratio of 2 or more occupied 80% or more of the total projected area. The mean equivalent spherical diameter of the grains was 0.68 μm. 30% or more of the silver iodide existed in γ phase from the result of powder X-ray diffraction analysis.

<Photosensitive Silver Halide Emulsion 4B1>

1 mol of the host emulsion 4A prepared above was added to the reaction vessel. The pAg measured at 50° C. was adjusted to be 8.8. 0.5 mol/L potassium bromide solution and 0.5 mol/L silver nitrate solution were added at an addition speed of 10 mL/min over 20 minutes by the method of double jet addition while keeping the pAg at 8.8 during the operation. Furthermore, the mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.5.

The above-mentioned silver halide dispersion was kept at 38° C. with stirring, and thereto was added 5 mL of a 0.34% by weight methanol solution of 1,2-benzoisothiazoline-3-one, and after 40 minutes the temperature was elevated to 47° C. At 20 minutes after elevating the temperature, sodium benzene thiosulfonate in a methanol solution was added at $5.0\times10^{-5}$ mol per 1 mol of silver. At additional 5 minutes later, tellurium sensitizer C in a methanol solution was added at $2.0\times10^{-5}$ mol per 1 mol of silver and subjected to ripening for 91 minutes. And then, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $3.2\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureido phenyl)-5-mercaptotetrazole in an aqueous solution at $5.7\times10^{-3}$ mol per 1 mol of silver were added to produce silver halide emulsion 4B1.

<Photosensitive Silver Halide Emulsion 4B2>

Preparation of silver halide emulsion 4B2 was conducted in a similar manner to the preparation of silver halide emulsion 4B1 except that: 1 mol of the host emulsion 4A was added to the reaction vessel, and adjusted the pAg to be 7.5 at 40° C.; while keeping the pAg at 7.5 during the operation, 0.5 mol/L potassium bromide solution and 0.5 mol/L silver nitrate solution were added at an addition speed of 10 mL/min over 20 minutes by the method of double jet addition; and the addition amount of tellurium sensitizer C was optimized in the chemical sensitization step. Thereby, silver halide emulsion 4B2 was prepared.

<Photosensitive Silver Halide Emulsion 4B3>

Preparation of silver halide emulsion 4B3 was conducted in a similar manner to the preparation of silver halide emulsion 4B2 except that: 1 mol of the host emulsion 4A was added to the reaction vessel, and adjusted the pAg to be 6.7 at 75° C.; while keeping the pAg at 6.7 during the operation, 0.5 mol/L potassium bromide solution and 0.5 mol/L silver nitrate solution were added at an addition speed of 10 mL/min over 4 minutes by the method of double jet addition; thereafter, the mixture was cooled down to 40° C.; and then the pAg of the mixture was adjusted to 7.5 at 40° C.; while keeping the pAg at 7.5 during the operation, 0.5 mol/L potassium bromide solution and 0.5 mol/L silver nitrate solution were added at an addition speed of 10 mL/min over 16 minutes by the method of double jet addition; and the addition amount of tellurium sensitizer C was optimized in the chemical sensitization step. Thereby, silver halide emulsion 4B3 was prepared.

<Photosensitive Silver Halide Emulsion 4B4 and 4B5>

Preparations of silver halide emulsion 4B4 and 4B5 were conducted in a similar manner to the preparation of silver halide emulsion 4B2 except that the 0.5 mol/L potassium bromide solution used in the double jet additions was changed to a solution containing 0.4 mol of potassium bromide and 0.1 mol of sodium chloride per 1 liter, or a solution containing 0.35 mol of potassium bromide and 0.15 mol of sodium chloride per 1 liter, respectively.

Concerning the photosensitive silver halide emulsion 4B1 to 4B5, the frequency of grains having epitaxial junctions, the average silver iodide content of the epitaxial junction parts, and the surface silver iodide content of the epitaxial junction parts were measured. The results of the measurements are shown in Table 13.

TABLE 13

| | Epitaxial junction part | | | | |
|---|---|---|---|---|---|
| Silver halide No | Frequency of grains having epitaxial junction (%) | Frequency of grains having corner - epitaxial (%) | Frequency of grains having dislocation line(%) | Average silver iodide content of epitaxial junction parts (mol %) | Surface silver iodide content of epitaxial junction parts (mol %) |
| 4B1 | 68 | 47 | 40 | 6 | 9 |
| 4B2 | 96 | 85 | 80 | 4 | 7 |
| 4B3 | 99 | 96 | 92 | 6 | 8 |
| 4B4 | 93 | 87 | 83 | 3 | 6 |
| 4B5 | 89 | 88 | 84 | 2 | 5 |

<Preparations of Mixed Emulsion for Coating Solution>

Each of the above described silver halide emulsion 4B1 to 4B5 was dissolved, and thereto was added benzothiazolium iodide in a 1% by weight aqueous solution at $7\times10^{-3}$ mol per 1 mol of silver. Further, as "a compound that can be one-electron-oxidized to provide a one-electron oxidation product, which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducible group", the compound Nos. 1 and 2 were added respectively in an amount of $8\times10^{-3}$ mol per 1 mol of silver halide. Further, water was added thereto to give the content of silver halide of 15.6 g in terms of silver, per 1 liter of the mixed emulsion for a coating solution.

2) Preparations of Coating Solution

Preparations of coating solution for image forming layer-61 to -65 were conducted as described below.

To the dispersion of the silver salt of fatty acid in an amount of 1000 g and 276 mL of water were serially added the organic polyhalogen compound-1 dispersion, the organic polyhalogen compound-2 dispersion, the SBR latex (Tg: 17° C.) solution, the reducing agent-3 dispersion, the nucleator dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. After adding thereto the silver iodide complex-forming agent, the mixed emulsion for coating solution was added thereto in an amount of 0.255 mol per 1 mol of silver salt of fatty acid, followed by thorough mixing just prior to the coating, which is fed directly to a coating die.

3) Preparations of Coated Sample

Preparations of photothermographic material-61 to -65 were conducted in a similar manner in Example 7, except that using the above coating solution-61 to -65 as a coating solution for image forming layer.

Coating was subjected on both surface of the support in order of the crossover cut layer, image forming layer, intermediate layer, first layer of the surface protective layers and second layer of the surface protective layers. The amount of coated silver in the image forming layer was 0.862 g/m$^2$ per one side, with respect to the sum of the amounts of silver salt of fatty acid and silver halide.

The coating amount of each compound (g/m$^2$) for the image forming layer per one side is as follows.

| | |
|---|---|
| Silver salt of fatty acid | 2.85 |
| Organic polyhalogen compound-1 | 0.028 |
| Organic polyhalogen compound-2 | 0.094 |
| Silver iodide complex forming agent | 0.46 |
| SBR latex | 5.20 |
| Reducing agent-3 | 0.46 |
| Nucleator | 0.036 |
| Hydrogen bonding compound-1 | 0.15 |
| Development accelerator-1 | 0.005 |
| Development accelerator-2 | 0.035 |
| Color-tone-adjusting agent-1 | 0.002 |
| Mercapto compound-1 | 0.001 |
| Mercapto compound-2 | 0.003 |
| Silver halide (on the basis of Ag content) | 0.175 |

Further, photothermographic material-66 to -70 were prepared by changing the coating amount of organic polyhalogen compound-1 and -2 to be 1.6 times per one side respectively with respect to photothermographic material-61 to -65.

2. Evaluation of Photographic Properties

Evaluation was performed similar to Example 7.

Image storability was evaluated under the following condition.

After thermal development, the samples were stored, under the environment of 30° C. and 70% RH, for 24 hours under 1000 Lux fluorescent lamp. Thereafter the increase of fog was measured.

TABLE 14

| Sample No | Silver Halide Emulsion No | Organic Polyhalogen Compound (relative amount) | Fog | Sensitivity | Image Storability |
|---|---|---|---|---|---|
| 61 | 4B1 | 1 | 0.23 | 100 | 0.04 |
| 62 | 4B2 | 1 | 0.23 | 195 | 0.03 |
| 63 | 4B3 | 1 | 0.23 | 209 | 0.03 |
| 64 | 4B4 | 1 | 0.18 | 214 | 0.03 |
| 65 | 4B5 | 1 | 0.17 | 229 | 0.04 |
| 66 | 4B1 | 1.6 | 0.21 | 26 | 0.01 |
| 67 | 4B2 | 1.6 | 0.2 | 158 | 0.01 |

TABLE 14-continued

| Sample No | Silver Halide Emulsion No | Organic Polyhalogen Compound (relative amount) | Fog | Sensitivity | Image Storability |
|---|---|---|---|---|---|
| 68 | 4B3 | 1.6 | 0.2 | 170 | 0.01 |
| 69 | 4B4 | 1.6 | 0.16 | 163 | 0.01 |
| 70 | 4B5 | 1.6 | 0.15 | 174 | 0.01 |

The obtained results are shown in Table 14.

It is apparent from the results shown in Table 14 that the samples (sample No. 62 to 65) using emulsion 4B2 to 4B5 of the present invention exhibit high sensitivity with no deteriration in fog with respect to the sample No. 61 using emulsion 4B1. Especially, when the amount of organic polyhalogen compound was inceased by 1.6 times, the sample (sample No. 66) using the emulsion 4B1 exhibits big deterioration in sensitivity, but the samples (sample No. 67 to 70) using the emulsion 4b2 to 4B5 exhibit small deterioration in sensitivity and further improved performances in fog and in image storability.

What is claimed is:

1. A black and white photothermographic material comprising, on at least one surface of a support, at least a photosensitive silver halide, a non-photosensitive organic silver salt, a reducing agent and a binder, wherein 50% or more of a total projected area of photosensitive silver halide grains is occupied by tabular grains having an aspect ratio of 2 or more, and at least one apex portion of each tabular grain has an epitaxial junction.

2. The black and white photothermographic material according to claim 1, wherein apex portions, of a number exceeding ⅔ of the number of host apex portions of each tabular grain, each have an epitaxial junction.

3. The black and white photothermographic material according to claim 1, wherein a silver iodide content of the photosensitive silver halide is 40 mol % or higher.

4. The black and white photothermographic material according to claim 3, further comprising an organic polyhalogen compound.

5. The black and white photothermographic material according to claim 1, wherein a projected area occupied by the epitaxial junction on principal planes other than the apex portion of the silver halide is less than 10% of a total projected area other than that of the apex portion.

6. The black and white photothermographic material according to claim 1, wherein the length of edges occupied by the epitaxial junction on edge portions other than the apex portion of the silver halide is less than 30% of the length of edges other than those of the apex portion.

7. The black and white photothermographic material according to claim 1, wherein a mean equivalent spherical diameter of the silver halide is 0.3 μm to 5.0 μm.

8. The black and white photothermographic material according to claim 1, wherein a mean aspect ratio of the silver halide is 5 or more.

9. The black and white photothermographic material according to claim 1, wherein the silver halide contains a complex of a heteroatom other than a silver atom.

10. The black and white photothermographic material according to claim 9, wherein the heteroatom other than a silver atom is selected from transition metals belonging to groups 3 to 11 in the periodic table.

11. The black and white photothermographic material according to claim 9, wherein the complex of the heteroatom is contained in a host part.

12. The black and white photothermographic material according to claim 9, wherein the complex of the heteroatom is contained in the epitaxial junction part.

13. The black and white photothermographic material according to claim 1, further comprising a compound that substantially reduces visible light absorption by the photosensitive silver halide after thermal development.

14. The black and white photothermographic material according to claim 13, wherein a silver iodide complex-forming agent is contained as the compound that substantially reduces visible light absorption by the photosensitive silver halide after thermal development.

15. The black and, white photothermographic material according to claim 1, having image forming layers on both surfaces of the support.

16. The black and white photothermographic material according to claim 1, having an image forming layer on one surface of the support.

17. The black and white photothermographic material according to claim 1, wherein the epitaxial part has at least one dislocation line.

18. The black and white photothermographic material according to claim 17, wherein the dislocation line is a reticulate dislocation line.

* * * * *